US011051625B2

(12) United States Patent
Sartor

(10) Patent No.: US 11,051,625 B2
(45) Date of Patent: Jul. 6, 2021

(54) HOLDER ASSEMBLY HAVING VISUALLY ENHANCED APPEARANCE

(71) Applicant: Raymond Virginio Sartor, Queensville (CA)

(72) Inventor: Raymond Virginio Sartor, Queensville (CA)

(73) Assignee: Marketology Inc., Sharon, CA (US)

( * ) Notice: Subject to any disclaimer, the term of this patent is extended or adjusted under 35 U.S.C. 154(b) by 705 days.

(21) Appl. No.: 15/825,426

(22) Filed: Nov. 29, 2017

(65) Prior Publication Data

US 2019/0159600 A1 May 30, 2019

(51) Int. Cl.

| | |
|---|---|
| ***A47C 7/68*** | (2006.01) |
| ***A47C 1/12*** | (2006.01) |
| ***A47G 19/06*** | (2006.01) |
| ***B65D 8/00*** | (2006.01) |
| ***A47C 1/124*** | (2006.01) |
| ***A47C 7/62*** | (2006.01) |

(52) U.S. Cl.

CPC ..... *A47C 7/68* (2013.01); *A47C 1/12* (2013.01); *A47C 1/124* (2013.01); *A47C 7/624* (2018.08); *A47G 19/06* (2013.01); *B65D 15/00* (2013.01)

(58) Field of Classification Search

CPC .. A47C 7/68; A47C 7/624; A47C 1/12; A47C 1/124; A47G 19/06; B65D 15/00

See application file for complete search history.

(56) References Cited

U.S. PATENT DOCUMENTS 1,304,753 A 5/1919 Dwyer
1,489,113 A * 4/1924 Brookbank ..... G09F 23/00 40/320
1,678,691 A 7/1928 De La Cuesta
(Continued)

FOREIGN PATENT DOCUMENTS

CA 2349356 A1 5/2000
CA 2301387 A1 9/2001
(Continued)

OTHER PUBLICATIONS

Office Action dated Jan. 19, 2021 for related US Application No. 2020/0352340 (20 pages).
(Continued)

*Primary Examiner* — Anita M King

(57) ABSTRACT

Apparatus includes a liner with a liner image. The liner is configured to be selectively positioned over a holder surface of a holder assembly. This is done in such a way that the liner, in use, positions the liner image in such a way that the liner image, in use, faces away from the holder assembly. A cover assembly is configured to selectively cover the liner image of the liner. The cover assembly is also configured to reveal the liner image formed on the liner once: (A) the liner, in use, is selectively positioned over the holder assembly, and (B) the cover assembly, in use, selectively covers the liner image formed on the liner. The liner, in use, visually enhances (changes) an appearance of the holder assembly once the liner is selectively positioned between the cover assembly and the holder assembly. The cover assembly is configured to protect, in use, the liner once the cover assembly, in use, is positioned proximate (adjacent) to the liner.

15 Claims, 31 Drawing Sheets

(56) References Cited

U.S. PATENT DOCUMENTS

| | | | | |
|---|---|---|---|---|
| 2,635,681 | A | 4/1953 | Hiltman | |
| 4,262,962 | A | 4/1981 | Yust | |
| 4,795,211 | A | 1/1989 | Stern | |
| 5,010,668 | A * | 4/1991 | Zeligson | B60N 3/002 40/320 |
| 5,320,406 | A | 6/1994 | North | |
| 5,413,035 | A * | 5/1995 | Fernandez | B60N 3/005 100/44 |
| D365,958 | S | 1/1996 | Bolewski | |
| 5,533,782 | A | 7/1996 | Goldman | |
| 5,707,107 | A | 1/1998 | Melone | |
| 5,720,515 | A | 2/1998 | Haffner | |
| 5,720,516 | A | 2/1998 | Young | |
| 6,082,816 | A | 7/2000 | Gottlieb | |
| 6,109,580 | A | 8/2000 | Stern et al. | |
| 6,113,049 | A * | 9/2000 | Miljanich | B60N 3/103 248/311.2 |
| 6,641,101 | B2 * | 11/2003 | Bergin | A47C 7/62 248/223.41 |
| 6,685,790 | B2 | 2/2004 | Apel | |
| D505,032 | S | 5/2005 | Bergin | |
| 6,899,391 | B1 | 5/2005 | Schneller | |
| 6,976,735 | B1 | 12/2005 | Bergin | |
| RE39,392 | E | 11/2006 | Bergin | |
| 7,198,327 | B2 | 4/2007 | Bergin | |
| 7,243,991 | B2 * | 7/2007 | Ojeda | B60N 3/002 297/188.14 |
| D592,418 | S | 5/2009 | Bergin | |
| 7,614,703 | B2 | 11/2009 | Bergin | |
| 7,621,593 | B2 * | 11/2009 | Dickinson | B64D 11/00151 297/163 |
| 7,681,345 | B2 | 3/2010 | Suprina | |
| RE41,624 | E | 9/2010 | Bergin | |
| 8,550,550 | B2 * | 10/2013 | Cassese | B65D 15/00 297/188.18 |
| D711,162 | S | 8/2014 | Wilson | |
| 8,814,263 | B2 * | 8/2014 | Cassese | A47G 19/06 297/188.18 |
| 9,254,708 | B2 | 2/2016 | Aikey | |
| 10,772,435 | B2 * | 9/2020 | Bergin | A47C 7/705 |
| 2001/0030454 | A1 * | 10/2001 | Mehl | A47C 3/12 297/217.1 |
| 2001/0035484 | A1 | 11/2001 | Ellinidis | |
| 2006/0220423 | A1 | 10/2006 | Bergin | |
| 2008/0093901 | A1 | 4/2008 | Hodge | |
| 2008/0209777 | A1 | 9/2008 | Suprina | |
| 2011/0139948 | A1 | 6/2011 | Bergin | |
| 2011/0277903 | A1 | 11/2011 | Adams | |
| 2020/0352340 | A1 | 11/2020 | Sartor | |

FOREIGN PATENT DOCUMENTS

| | | | | |
|---|---|---|---|---|
| CN | 2896428 | Y | 5/2007 | |
| CN | 201157175 | Y | 12/2008 | |
| CN | 202071774 | U | 12/2011 | |
| CN | 205053488 | U | 3/2016 | |
| DE | 9412171 | U1 | 1/1995 | |
| DE | 202012002628 | | 8/2012 | |
| EP | 2168460 | A1 | 3/2010 | |
| EP | 3064401 | A1 | 9/2016 | |
| ES | 1039283 | U | 12/1998 | |
| ES | 1069357 | U | 3/2009 | |
| FR | 461996 | A1 | 1/1914 | |
| FR | 2677791 | A1 | 12/1992 | |
| FR | 2822663 | A1 | 10/2002 | |
| GB | 191313391 | A * | 11/1913 | A47C 7/68 |
| GB | 2311887 | A1 | 10/1997 | |
| KR | 20130050638 | A1 | 5/2013 | |
| WO | 9917639 | A1 | 4/1999 | |
| WO | 03105112 | A2 | 12/2003 | |
| WO | 2004093038 | A1 | 10/2004 | |
| WO | 2006135276 | A1 | 12/2006 | |
| WO | 2011004220 | A1 | 1/2011 | |
| WO | 2019104415 | A1 | 6/2019 | |

OTHER PUBLICATIONS

International Search Report dated Jan. 8, 2019, (Corresponding PCT Application No. PCT/CA2018/051340 (WO 2019/104415) (8 pages).

Written Opinion dated Jan. 8, 2019, (Corresponding PCT Application No. PCT/CA2018/051340 (WO 2019/104415) (8 pages).

* cited by examiner

HOLDER ASSEMBLY HAVING VISUALLY ENHANCED APPEARANCE

TECHNICAL FIELD

This document relates to the technical field of (and is not limited to) a holder assembly having a visually enhanced appearance, and/or this document relates to the technical field of (and is not limited to) any permutation and combination of a holder assembly, a liner, a cover, and/or this document relates to the technical field of (and is not limited to) a method associated with a holder assembly having a visually enhanced appearance, and/or this document relates to the technical field of (and is not limited to) a method associated with any permutation and combination of a holder assembly, a liner, and a cover.

BACKGROUND

A holder assembly is a device configured to hold an item. The holder assembly may include, for instance, a tray (a serving tray, a cafeteria tray, a food-service tray, any other kind, and any equivalent thereof) configured to hold a food item (such as a drink item, a food item, etc., any other kind, and any equivalent thereof). The holder assembly may be made from (include) a material that is relatively durable (such as, a plastic material, etc.), and is reusable. The holder assembly is configured to be utilized many times before replacement becomes necessary.

SUMMARY

It will be appreciated that there exists a need to mitigate (at least in part) at least one problem associated with the existing holder assemblies (also called the existing technology). After much study of the known systems and methods with experimentation, an understanding (at least in part) of the problem and its solution has been identified (at least in part) and is articulated (at least in part) as follows:

A holder assembly is configured to be utilized many times before replacement is considered. It may be appreciated that users of the holder assembly may become bored with the holder assembly (over time) since the holder assembly is not replaced and is utilized many times (before replacement is considered as a result of wear). What may be needed is a way or an apparatus that is configured to change the visual appearance of the holder assembly (so that boredom experience by the user is reduced at least in part). In addition, From time to time, it may be desirable to enhance (change or visually enhance) the appearance of a holder assembly, so that the users of the holder assembly may improve their enjoyment of (and/or appreciation for) the experience of using (and/or seeing) the holder assembly, and/or reduce (at least in part) the boredom associated with holder assembly.

More specifically, it may be desirable to selectively visually enhance (change) the appearance of a holder assembly in such a way that the overall visual enhancement of the holder assembly may be changed (from time to time, when needed).

For instance, it may be desirable to selectively provide an indication (indicia) on (or with) the holder assembly, in which then the holder assembly with the indication is provided to users in a commercial situation (such as, a cafeteria, a sporting event, a movie theater, a place of business, a residential setting, etc., any other kind, and any equivalent thereof). The selective provision of the indication (such as, the changing of the indication with a newer or different indication, etc.) may help enhance the user experience and/or enjoyment associated with the holder assembly.

Since the holder assembly is reusable, it may be desirable to selectively change or enhance the visual aspect of the holder assembly (from time to time, whenever appropriate). The holder assembly (such as, a tray, etc.) may provide an apparatus (or method) for conveying an indication (such as, information, indicia, advertising, etc.) to the user of the holder assembly. The indication (symbol, etc.) may provide and/or enhance the entertainment value of the holder assembly.

For the case where the holder assembly (especially if made from a hard plastic, or other material that is relatively durable) may be utilized many times before replacement becomes necessary, it may be advantageous to have the indication (information) carried by the holder assembly to be selectively changed (replaced) easily (from time to time).

In view of the foregoing, it may be desirable to provide an indication (indicia or symbol, any other kind, and any equivalent thereof) upon a holder (such as a tray, a food tray, etc.) that is then provided to users in a commercial situation (setting, such as a cinema, a movie theater, a live-event theater, a sporting event, a music event, a place of business, a residential setting, etc., any other kind, and any equivalent thereof). The indication (indicia or symbol) may provide improvement to the visual aspects of the holder (such as, the tray), and/or the user experience (appreciation) of the holder assembly. It is may be particularly desirable to change (replace) the indication (indicia or symbol) whenever appropriate (such as, relatively frequently, from time to time, etc.), so that the visual aspects of the holder assembly may be kept updated, as needed or when required, etc.

It may be desirable to provide the holder assembly to be utilized by a customer (a user) that provides a mechanism (or way) for conveying information or an indication (such as, indicia, advertising, etc.) to the customer. For the case where the holder assembly is made from hard plastic or other such materials (a relatively durable material that may be used many times before replacement becomes necessary), it may be advantageous if the indication (indicia or symbol) carried by holder assembly can be changed relatively easily (from time to time).

To mitigate, at least in part, at least one problem associated with the existing technology, there is provided (in accordance with a first major aspect) an apparatus, in which the apparatus includes and is not limited to (comprises) a synergistic combination of a holder assembly, a liner, and a cover assembly.

The liner has (is with) a liner image formed thereon.

The liner is configured to be selectively positioned over, at least in part, the holder assembly (this is done in such a way that the liner, in use, positions the liner image formed thereon so that (such that) the liner image, in use, faces away from the holder assembly).

The cover assembly is configured to selectively cover, at least in part, the liner image formed on the liner.

The cover assembly is also configured to reveal (such as to an observer), at least in part, the liner image formed on the liner (once the liner, in use, is selectively positioned over, at least in part, the holder assembly).

The cover assembly is also configured to reveal (such as to an observer), at least in part, the liner image formed on the liner (once the cover assembly, in use, selectively covers, at least in part, the liner image formed on the liner).

The liner, in use, visually enhances (changes) an appearance of the holder assembly once the liner is (selectively) positioned between the cover assembly and the holder assembly.

To mitigate, at least in part, at least one problem associated with the existing technology, there is provided (in accordance with a second major aspect) an apparatus, in which the apparatus includes and is not limited to (comprises) a holder assembly configured to cooperate with a liner with a liner image formed thereon.

The liner is configured to be selectively positioned over, at least in part, the holder assembly (this is done in such a way that the liner, in use, positions the liner image formed thereon so that (such that) the liner image, in use, faces away from the holder assembly).

The holder assembly is also configured to cooperate with a cover assembly, in which the cover assembly is configured to selectively cover, at least in part, the liner image formed on the liner.

The cover assembly is also configured to reveal (such as to an observer), at least in part, the liner image formed on the liner (once the liner, in use, is selectively positioned over, at least in part, the holder assembly).

The cover assembly is also configured to reveal (such as to an observer), at least in part, the liner image formed on the liner (once the cover assembly, in use, selectively covers, at least in part, the liner image formed on the liner).

The liner, in use, visually enhances (changes) an appearance of the holder assembly once the liner is selectively positioned between the cover assembly and the holder assembly.

To mitigate, at least in part, at least one problem associated with the existing technology, there is provided (in accordance with a third major aspect) an apparatus, in which the apparatus includes and is not limited to (comprises) a synergistic combination of a liner and a cover assembly.

The liner has (is with) a liner image formed thereon.

The liner is configured to be selectively positioned over, at least in part, a holder assembly (this is done in such a way that the liner, in use, positions the liner image formed thereon so that (such that) the liner image, in use, faces away from the holder assembly).

The cover assembly is configured to selectively cover, at least in part, the liner image formed on the liner.

The cover assembly is also configured to reveal (such as to an observer), at least in part, the liner image formed on the liner (once the liner, in use, is selectively positioned over, at least in part, the holder assembly).

The cover assembly is also configured to reveal (such as to an observer), at least in part, the liner image formed on the liner (once the cover assembly, in use, selectively covers, at least in part, the liner image formed on the liner).

The liner, in use, visually enhances (changes) an appearance of the holder assembly once the liner is selectively positioned between the cover assembly and the holder assembly.

To mitigate, at least in part, at least one problem associated with the existing technology, there is provided (in accordance with a fourth major aspect) an apparatus, in which the apparatus includes and is not limited to (comprises) a liner with a liner image being formed thereon.

The liner is configured to be selectively positioned over, at least in part, a holder assembly in such a way that the liner, in use, positions the liner image formed thereon so that (such that) the liner image, in use, faces away from the holder assembly.

The liner is configured to cooperate with a cover assembly, in which the cover assembly is configured to selectively cover, at least in part, the liner image formed on the liner.

The cover assembly is also configured to reveal (such as to an observer), at least in part, the liner image formed on the liner (once the liner, in use, is selectively positioned over, at least in part, the holder assembly).

The cover assembly is also configured to reveal (such as to an observer), at least in part, the liner image formed on the liner (once the cover assembly, in use, selectively covers, at least in part, the liner image formed on the liner).

The liner, in use, visually enhances (changes) an appearance of the holder assembly once the liner is selectively positioned between the cover assembly and the holder assembly.

To mitigate, at least in part, at least one problem associated with the existing technology, there is provided (in accordance with a fifth major aspect) an apparatus, in which the apparatus includes and is not limited to (comprising) a cover assembly configured to selectively cover, at least in part, a liner image formed on a liner, in which the liner is configured to be selectively positioned over, at least in part, a holder assembly (this is done in such a way that the liner, in use, positions the liner image formed thereon so that (such that) the liner image, in use, faces away from the holder assembly).

The cover assembly is also configured to reveal (such as to an observer), at least in part, the liner image formed on the liner (once the liner, in use, is selectively positioned over, at least in part, the holder assembly).

The cover assembly is also configured to reveal (such as to an observer), at least in part, the liner image formed on the liner (once the cover assembly, in use, selectively covers, at least in part, the liner image formed on the liner).

The liner, in use, visually enhances (changes) an appearance of the holder assembly once the liner is selectively positioned between the cover assembly and the holder assembly.

To mitigate, at least in part, at least one problem associated with the existing technology, there is provided (in accordance with a sixth major aspect) an apparatus, in which the apparatus includes and is not limited to (comprises) a synergistic combination of a liner and a cover assembly.

The liner has a liner surface with a liner image formed on the liner surface.

The liner is configured to be selectively positioned over, at least in part, (and/or to contact, at least in part) a holder surface of a holder assembly (this is done in such a way that the liner, in use, positions the liner image being formed on the liner surface so that (such as that) the liner image, in use, faces away from the holder surface of the holder assembly).

The cover assembly has a cover surface.

The cover surface of the cover assembly is configured to selectively cover, at least in part, the liner image formed on the liner surface of the liner.

The cover assembly is also configured to reveal (such as to an observer), at least in part, the liner image formed on the liner (once the liner, in use, is selectively positioned over, at least in part, (and/or contacts, at least in part) the holder assembly).

The cover assembly is also configured to reveal (such as to an observer), at least in part, the liner image formed on the liner surface of the liner (once the cover assembly, in use, selectively covers, at least in part, the liner image formed on the liner surface of the liner).

The liner, in use, visually enhances (changes) an appearance of the holder assembly once the liner is selectively positioned between the cover assembly and the holder assembly.

To mitigate, at least in part, at least one problem associated with the existing technology, there is provided (in accordance with a seventh major aspect) an apparatus, in which the apparatus includes and is not limited to (comprises) a liner having a liner surface with a liner image formed on the liner surface.

The liner is configured to be selectively positioned over, at least in part, (and/or to contact, at least in part) a holder surface of a holder assembly (this is done in such a way that the liner, in use, positions the liner image being formed on the liner surface so that (such as that) the liner image, in use, faces away from the holder surface of the holder assembly).

The liner image formed on the liner surface of the liner is configured to be selectively covered, at least in part, by a cover assembly having a cover surface.

The cover assembly is also configured to reveal (such as to an observer), at least in part, the liner image formed on the liner (once the liner, in use, is selectively positioned over, at least in part, (and/or contacts, at least in part) the holder surface of the holder assembly).

The cover assembly is also configured to reveal (such as to an observer), at least in part, the liner image formed on the liner surface of the liner (once the cover assembly, in use, selectively covers, at least in part, the liner image formed on the liner surface of the liner).

The liner, in use, visually enhances (changes) an appearance of the holder assembly once the liner is selectively positioned between the cover assembly and the holder assembly.

To mitigate, at least in part, at least one problem associated with the existing technology, there is provided (in accordance with an eighth major aspect) an apparatus, in which the apparatus includes and is not limited to (comprises) a holder assembly also called a tray assembly) having a holder surface (also called a tray surface).

The holder assembly also has a joiner assembly.

The joiner assembly is configured to be selectively receivable, at least in part, in a first drink hole feature of a first seating system.

The joiner assembly is also configured to be selectively receivable, at least in part, in a second drink hole feature of a second seating system.

The joiner assembly is also configured to selectively securely engage with the first drink hole feature of the first seating system once the joiner assembly is received, at least in part, in the first drink hole feature of the first seating system.

The joiner assembly is also configured to selectively securely engage with the second drink hole feature of the second seating system once the joiner assembly is received, at least in part, in the second drink hole feature of the second seating system.

The joiner assembly is also configured to cooperate with the first drink hole feature of the first seating system has a first inner diameter.

The joiner assembly is also configured to cooperate with the second drink hole feature of the second seating system, in which the second drink hole feature has a second inner diameter, in which the first inner diameter of the first drink hole feature and the second inner diameter of the second drink hole feature are different from each other.

To mitigate, at least in part, at least one problem associated with the existing technology, there is provided (in accordance with a ninth major aspect) a method for visually enhancing (improving, visually changing) an appearance of) a holder assembly (a method for enhancing a holder assembly).

The method includes and is not limited to (comprises) positioning a liner, at least in part, over (and/or contacting, at least in part) a holder surface of a holder assembly, in which the liner has a liner surface with a liner image formed on the liner surface, in such a way that the liner, in use, positions the liner image formed on the liner surface so that (such as that) the liner image, in use, faces away from the holder surface of the holder assembly.

The method also includes selectively covering, at least in part, the liner image formed on the liner surface of the liner with a cover assembly having a cover surface, in which the cover surface of the cover assembly is configured to reveal (such as to an observer), at least in part, the liner image being formed on the liner surface once the liner, in use, is selectively positioned over, at least in part, (and/or contacts, at least in part) the holder surface of the holder assembly.

The method also includes selectively covering, at least in part, the liner image formed on the liner surface of the liner with a cover assembly having a cover surface, in which the cover surface of the cover assembly is configured to reveal (such as to an observer), at least in part, the liner image being formed on the liner surface once the cover surface of the cover assembly, in use, selectively covers, at least in part, the liner image being formed on the liner surface of the liner.

The liner, in use, visually enhances (changes) an appearance of the holder assembly once the liner is selectively positioned between the cover assembly and the holder assembly.

To mitigate, at least in part, at least one problem associated with the existing technology, there is provided (in accordance with a tenth major aspect) an apparatus, in which the apparatus includes and is not limited to (comprises) a synergistic combination of a holder assembly, a liner, and a cover assembly.

The liner has (is with) a liner image formed thereon.

The liner is configured to be selectively positioned, at least in part, between the holder assembly and the cover assembly (this is done in such a way that the liner, in use, positions the liner image formed thereon so that (such that) the liner image, in use, faces away from the holder assembly).

The cover assembly is also configured to reveal (such as to an observer), at least in part, the liner image formed once the liner, in use, is selectively positioned, at least in part, between the holder assembly and the cover assembly.

The liner, in use, enhances (changes) an appearance of the holder assembly once the liner is selectively positioned between the cover assembly and the holder assembly.

To mitigate, at least in part, at least one problem associated with the existing technology, there is provided (in accordance with an eleventh major aspect) an apparatus, in which the apparatus includes and is not limited to (comprises) a liner (for use with a holder assembly and a cover assembly).

The liner has (is with) a liner image formed thereon.

The liner is configured to be selectively positioned, at least in part, between the holder assembly and the cover assembly (this is done in such a way that the liner, in use, positions the liner image formed thereon so that (such that) the liner image, in use, faces away from the holder assembly).

The cover assembly is also configured to reveal (such as to an observer), at least in part, the liner image formed once the liner, in use, is selectively positioned, at least in part, between the holder assembly and the cover assembly.

The liner, in use, enhances (changes) an appearance of the holder assembly once the liner is selectively positioned between the cover assembly and the holder assembly.

To mitigate, at least in part, at least one problem associated with the existing technology, there is provided (in accordance with a twelfth major aspect) an apparatus, in which the apparatus includes and is not limited to (comprises) a holder assembly (for use with a liner and a cover assembly).

The liner has (is with) a liner image formed thereon.

The liner is configured to be selectively positioned, at least in part, between the holder assembly and the cover assembly (this is done in such a way that the liner, in use, positions the liner image formed thereon so that (such that) the liner image, in use, faces away from the holder assembly).

The cover assembly is also configured to reveal (such as to an observer), at least in part, the liner image formed once the liner, in use, is selectively positioned, at least in part, between the holder assembly and the cover assembly.

The liner, in use, enhances (changes) an appearance of the holder assembly once the liner is selectively positioned between the cover assembly and the holder assembly.

To mitigate, at least in part, at least one problem associated with the existing technology, there is provided (in accordance with a thirteenth major aspect) an apparatus, in which the apparatus includes and is not limited to (comprises) a cover assembly (for use with a holder assembly and a liner).

The liner has (is with) a liner image formed thereon.

The liner is configured to be selectively positioned, at least in part, between the holder assembly and the cover assembly (this is done in such a way that the liner, in use, positions the liner image formed thereon so that (such that) the liner image, in use, faces away from the holder assembly).

The cover assembly is also configured to reveal (such as to an observer), at least in part, the liner image formed once the liner, in use, is selectively positioned, at least in part, between the holder assembly and the cover assembly.

The liner, in use, enhances (changes) an appearance of the holder assembly once the liner is selectively positioned between the cover assembly and the holder assembly.

To mitigate, at least in part, at least one problem associated with the existing technology, there is provided (in accordance with a fourteenth major aspect) a method for visually enhancing (changing an appearance of or improving) a holder assembly (a method for enhancing a holder assembly).

The method includes and is not limited to (comprises) positioning, at least in part, a liner between a holder assembly and a cover assembly, in which the liner has (is with) a liner image formed thereon (this is done in such a way that the liner, in use, positions the liner image formed thereon so that (such that) the liner image, in use, faces away from the holder assembly), and in which the cover assembly is configured to reveal (such as to an observer), at least in part, the liner image formed on the liner (once the liner, in use, is selectively positioned, at least in part, between the holder assembly and the cover assembly).

The liner, in use, enhances (changes) an appearance of the holder assembly once the liner is selectively positioned between the cover assembly and the holder assembly.

To mitigate, at least in part, at least one problem associated with the existing technology, there is provided (in accordance with a fifteenth major aspect) an apparatus, in which the apparatus includes and is not limited to (comprises) a holder assembly having a holder surface. For instance, the holder assembly may include or be called a tray assembly, and the holder surface may include or be called a tray surface.

The holder assembly also has a joiner assembly.

The joiner assembly is configured to be selectively receivable, at least in part, in a first drink hole feature of a first seating system.

The joiner assembly is also configured to be selectively receivable, at least in part, in a second drink hole feature of a second seating system.

The joiner assembly is also configured to selectively securely engage with the first drink hole feature of the first seating system once the joiner assembly is received, at least in part, in the first drink hole feature of the first seating system.

The joiner assembly is also configured to selectively securely engage with the second drink hole feature of the second seating system once the joiner assembly is received, at least in part, in the second drink hole feature of the second seating system.

The joiner assembly is also configured to cooperate with the first drink hole feature of the first seating system, in which the first drink hole feature has a first inner diameter.

The joiner assembly is also configured to cooperate with the second drink hole feature of the second seating system, in which the second drink hole feature has a second inner diameter, in which the first inner diameter of the first drink hole feature and the second inner diameter of the second drink hole feature are different from each other.

Also included is a liner and a cover assembly.

The liner has (is with) a liner image formed thereon.

The liner is configured to be selectively positioned over, at least in part, the holder assembly (this is done in such a way that the liner, in use, positions the liner image formed thereon so that (such that) the liner image, in use, faces away from the holder assembly).

The cover assembly is configured to selectively cover, at least in part, the liner image formed on the liner.

The cover assembly is also configured to reveal (such as to an observer), at least in part, the liner image formed once the liner, in use, is selectively positioned over, at least in part, the holder assembly.

The cover assembly is also configured to reveal (such as to an observer), at least in part, the liner image formed on the liner once the cover assembly, in use, selectively covers, at least in part, the liner image formed on the liner.

The liner, in use, enhances (changes) an appearance of the holder assembly once the liner is (selectively) positioned between the cover assembly and the holder assembly.

To mitigate, at least in part, at least one problem associated with the existing technology, there is provided (in accordance with a sixteenth major aspect) an apparatus, in which the apparatus includes and is not limited to (comprises) a holder assembly including a POS holder (point-of-sale holder) configured for utilization with a point-of-sale device (POS device).

The POS holder is configured to be located proximate (adjacent) to the point-of-sale device.

A liner is configured to be positioned above the POS holder.

The liner has a liner image formed thereon.

A cover assembly is configured to be positioned above the liner.

The cover assembly is also configured to reveal (such as to an observer), at least in part, the liner image formed on the liner.

The liner image, in use, improves (changes) an appearance of the point-of-sale device once the liner is positioned proximate (adjacent) to the POS holder, and once the POS holder is positioned proximate (adjacent) to the point-of-sale device.

The cover assembly is configured to protect, in use, the liner once the cover assembly, in use, is positioned proximate (adjacent) to the liner.

To mitigate, at least in part, at least one problem associated with the existing technology, there is provided (in accordance with a seventeenth major aspect) an apparatus, in which the apparatus includes and is not limited to (comprises) a holder assembly including a POS holder configured for utilization with a point-of-sale device (POS device).

The POS holder is configured to be located proximate to the point-of-sale device.

A liner is configured to be positioned above the POS holder.

The liner has a liner image formed thereon.

The liner image, in use, improves (changes) an appearance of the point-of-sale device once the liner is positioned proximate to the POS holder, and once the POS holder is positioned proximate to the point-of-sale device.

To mitigate, at least in part, at least one problem associated with the existing technology, there is provided (in accordance with an eighteenth major aspect) an apparatus, in which the apparatus includes and is not limited to (comprises) a holder image configured to be positioned, at least in part, proximate to (on an external surface of) a holder assembly in such a way that the holder image, in use, faces away from the holder assembly once the holder image, in use, is positioned proximate to (on) the holder assembly.

The holder image is also configured to face away from the holder assembly once the holder image, in use, is positioned, at least in part, proximate to (on) the holder assembly.

The holder image, in use, visually enhances an appearance of the holder assembly once the holder image, in use, is positioned proximate to the holder assembly.

In accordance with an option, the holder image is configured to selectively connect (couple) with, and selectively disconnect from, the holder assembly.

In accordance with an option, the holder image is integral with the holder assembly.

To mitigate, at least in part, at least one problem associated with the existing technology, there is provided (in accordance with a nineteenth major aspect) an apparatus, in which the apparatus includes and is not limited to (comprises) a cover assembly having a cover image formed thereon.

The cover assembly is configured to be selectively positioned proximate to (over), at least in part, a holder assembly in such a way that the cover assembly, in use, positions the cover image so that the cover image, in use, faces away from the holder assembly once the cover assembly, in use, is selectively positioned proximate to, at least in part, the holder assembly.

The cover assembly is also configured to visually display, at least in part, the cover image formed on the cover assembly once the cover assembly, in use, is selectively positioned proximate to (over), at least in part, the holder assembly.

The cover assembly, in use, visually enhances an appearance of the holder assembly once the cover assembly is selectively positioned proximate to (over) the holder assembly.

The cover assembly is configured to physically protect (protect) the appearance of the holder assembly once the cover assembly is selectively positioned proximate to the liner, and the liner is positioned proximate to the holder assembly.

In accordance with an option, the cover assembly is configured to selectively connect (couple) with, and selectively disconnect from, the holder assembly.

To mitigate, at least in part, at least one problem associated with the existing technology, there is provided (in accordance with a twentieth major aspect) an apparatus, in which the apparatus includes and is not limited to (comprises) a liner having a liner image formed thereon.

The liner is configured to be selectively positioned proximate to (over), at least in part, a holder assembly in such a way that the liner, in use, positions the liner image formed on the liner so that the liner image, in use, faces away from the holder assembly once the liner, in use, is selectively positioned, at least in part, proximate to the holder assembly.

The liner is also configured to visually display, at least in part, the liner image being formed on the liner once the liner, in use, is selectively positioned proximate to (over), at least in part, the holder assembly.

The liner, in use, visually enhances an appearance of the holder assembly once the liner is selectively positioned proximate to the holder assembly.

In accordance with an option, the liner is configured to selectively connect (couple) with, and selectively disconnect from, the holder assembly.

To mitigate, at least in part, at least one problem associated with the existing technology, there is provided (in accordance with a twenty first major aspect) an apparatus, in which the apparatus includes and is not limited to (comprises) a liner having a liner surface with a liner image formed on the liner surface.

The liner is configured to be selectively positioned proximate to (over), at least in part, a holder surface of a holder assembly in such a way that the liner, in use, positions the liner image formed on the liner surface so that the liner image, in use, faces away from the holder surface of the holder assembly once the liner, in use, is selectively positioned proximate to (over), at least in part, the holder surface of the holder assembly.

The apparatus further includes a cover assembly having a cover surface.

The cover assembly is configured to selectively cover, at least in part, the liner image formed on the liner surface of the liner.

The cover assembly is also configured to reveal, at least in part, the liner image formed on the liner surface once: (A) the liner, in use, is selectively positioned over, at least in part, the holder assembly; and (B) the cover assembly, in use, selectively covers, at least in part, the liner image formed on the liner surface of the liner.

The cover assembly has a cover image formed on the cover surface in such a way that the cover image, in use, is displayed once the cover assembly, in use, selectively covers, at least in part, the liner, in which the liner is positioned proximate to the holder assembly.

The liner, in use, visually enhances an appearance of the holder assembly once the liner is selectively positioned between the cover assembly and the holder assembly.

The cover assembly, in use, visually enhances the appearance of the holder assembly once the cover assembly is selectively positioned proximate to the liner, and the liner is positioned proximate to the holder assembly.

The cover assembly is configured to physically protect (protect) the appearance of the holder assembly once the cover assembly is selectively positioned proximate to the liner, and the liner is positioned proximate to the holder assembly.

In accordance with an option, the liner is configured to selectively connect (couple) with, and selectively disconnect from, the holder assembly.

In accordance with an option, the cover assembly is configured to selectively connect (couple) with, and selectively disconnect from, the holder assembly.

To mitigate, at least in part, at least one problem associated with the existing technology, there is provided (in accordance with a twenty second major aspect) an apparatus, in which the apparatus includes and is not limited to (comprises) a liner configured to be selectively positioned over, at least in part, a holder assembly.

The apparatus also includes a cover assembly configured to selectively cover, at least in part, the liner once the liner, in use, is selectively positioned over, at least in part, the holder assembly.

The cover assembly has a cover image formed thereon in such a way that the cover image, in use, is displayed once the cover assembly, in use, selectively covers, at least in part, the liner, in which the liner is positioned over, at least in part, the holder assembly.

The cover assembly, in use, visually enhances the appearance of the holder assembly and the liner once the cover assembly is selectively positioned over the liner, and the liner is positioned over the holder assembly.

The cover assembly is configured to physically protect (protect) the appearance of the holder assembly once the cover assembly is selectively positioned proximate to the liner, and the liner is positioned proximate to the holder assembly.

In accordance with an option, the liner is configured to selectively connect (couple) with, and selectively disconnect from, the holder assembly.

In accordance with an option, the cover assembly is configured to selectively connect (couple) with, and selectively disconnect from, the holder assembly.

To mitigate, at least in part, at least one problem associated with the existing technology, there is provided (in accordance with a twenty third major aspect) an apparatus and/or a method for improving advertising revenue in association with a holder assembly (that is, for monetizing the holder assembly). The method of advertisement provides a notice or announcement in a public medium promoting a product, service, or event or publicizing a job vacancy, etc., and any other kind, and any equivalent thereof. The method (or apparatus) is for enhancing advertising revenue in association with the holder assembly, which is described below in detail.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
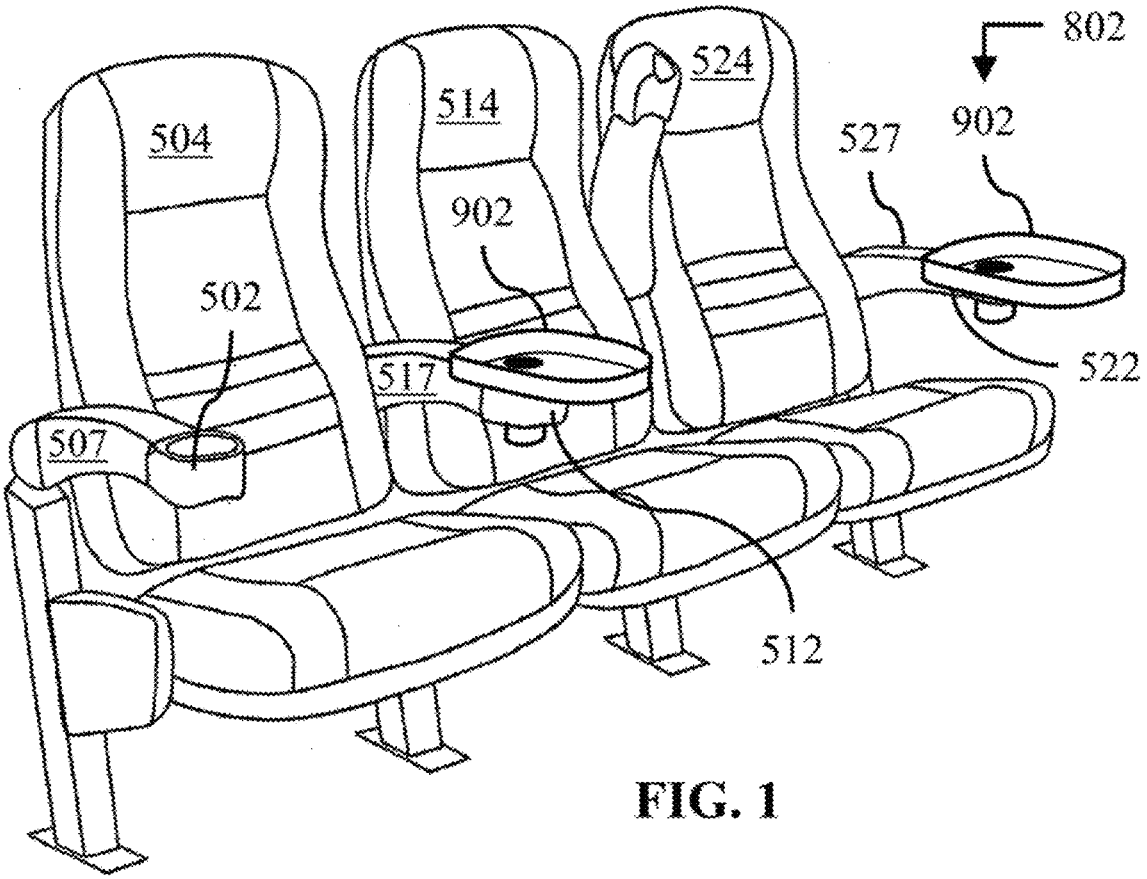
FIG. 1 and FIG. 2 depict a perspective view (FIG. 1) and a side view (FIG. 2) of the embodiments of a holder assembly.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

101 cover image
102 cover assembly
103 interior zone
104 cover surface
105 engagement feature
106 lateral cover side walls
107 upstanding wall
108 rear cover wall
109 front cover wall
110 cover-engagement feature
112A first cover passageway
112B second cover passageway
112C third cover passageway
112 cover passageway
400 point-of-sale device
402 POS holder
404 POS holder surface
502 first drink hole feature
503 first drink hole
504 first seating system
506 first inner diameter
507 first chair arm
512 second drink hole feature
514 second seating system
516 second inner diameter
517 second chair arm
522 third drink hole feature
524 third seating system
527 third chair arm
530 cup holder
532 interior holder zone
534 interface structure
536 complementary interface structure
602 booster seat assembly
604 booster-seat surface
606 stacked formation
702 liner
704 liner surface
705 liner image
706 lateral liner side walls
708 rear liner wall
709 front liner wall
712A first liner passageway
712B second liner passageway
712C third liner passageway
712 liner passageway
714 liner side opening
802 holder assembly
804 holder surface
805 holder image
808 holder-engagement feature
810 joiner assembly
811 holder passageway
812 first joiner finger

814 second joiner finger
816 third joiner finger
902 food-service tray
903 food-receiver
904 tray surface
905 direction
906 lateral tray side walls
908 rear tray wall
909 front tray wall
912A first tray passageway
912B second tray passageway
912C third tray passageway
912 tray passageway
914 front tray stand
916 rear tray stand
918 drink holder
920 stand assembly
950 observer
952 user
953 food container
954 movement direction
955 drink container
956 positioning direction

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the claim is defined by the claims (in which the claims may be amended during patent examination after the filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that the scope of the meaning of a device configured to be coupled to an item (that is, to be connected to, to interact with the item, etc.) is to be interpreted as the device being configured to be coupled to the item, either directly or indirectly. Therefore, "configured to" may include the meaning "either directly or indirectly" unless specifically stated otherwise.

Figure 2:
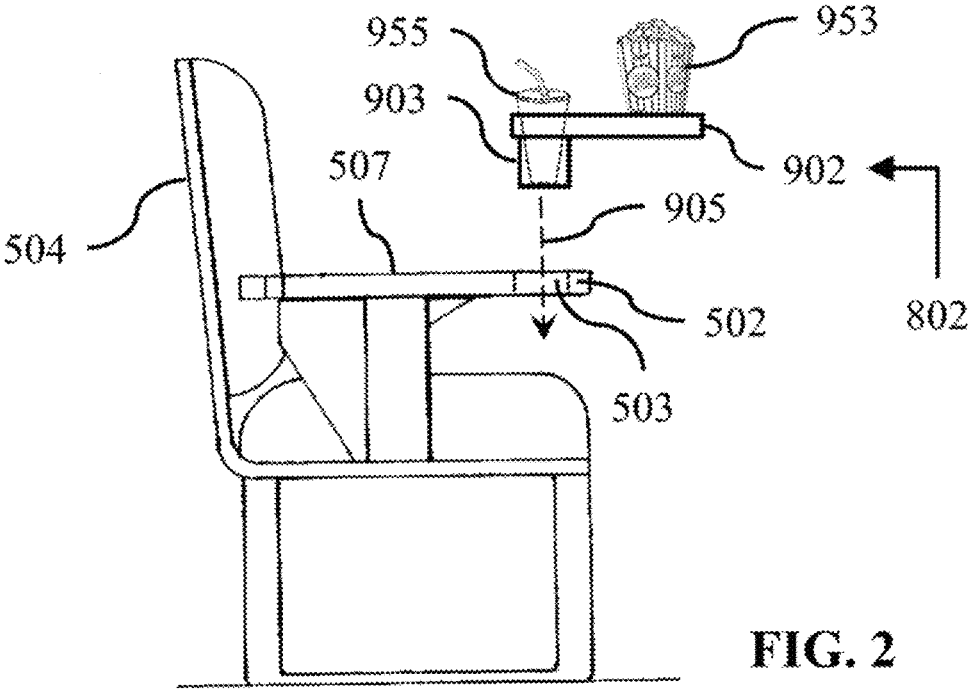

FIG. 1 and FIG. 2 depict a perspective view (FIG. 1) and a side view (FIG. 2) of the embodiments of a holder assembly 802. The holder assembly 802 may have any configuration, shape, size, physical features, etc. The holder assembly 802 may be formed from any suitable material, such as a plastic material, etc.

Referring to the embodiment as depicted in FIG. 1, a first seating system 504 includes a first chair arm 507 providing (defining) a first drink hole feature 502. A second seating system 514 includes a second chair arm 517 providing (defining) a second drink hole feature 512. A third seating system 524 includes a third chair arm 527 providing (defining) a third drink hole feature 522. The first seating system 504, the second seating system 514 and the third seating system 524 are of the type found in an entertainment venue, such as a movie theater, a sports arena, etc.

A holder assembly 802 is configured to be received (at least in part) and supported by any one of the first drink hole feature 502, the second drink hole feature 512 and/or the third drink hole feature 522. The holder assembly 802 may include, for instance, a food-service tray 902. The food-service tray 902 may have any configuration, shape, size, physical features, etc. The food-service tray 902 may be formed from any suitable material, such as a plastic material, etc.

Referring to the embodiment as depicted in FIG. 2, the first chair arm 507 provides (defines) the first drink hole feature 502. The first drink hole feature 502 provides (defines) a first drink hole 503. The holder assembly 802 includes, for instance, the food-service tray 902. The food-service tray 902 includes a food-receiver 903 (such as, a drink-receiver). The food-service tray 902 is moved along a direction 905 so that the food-receiver 903 is received (at least in part) in the first drink hole 503. The first drink hole 503 is configured to receive and support the food-receiver 903 of the food-service tray 902. The food-service tray 902 is configured to receive and support a food item 953 (such as, a bag of popcorn. Etc.) and/or a drink container 955.

Figure 3:
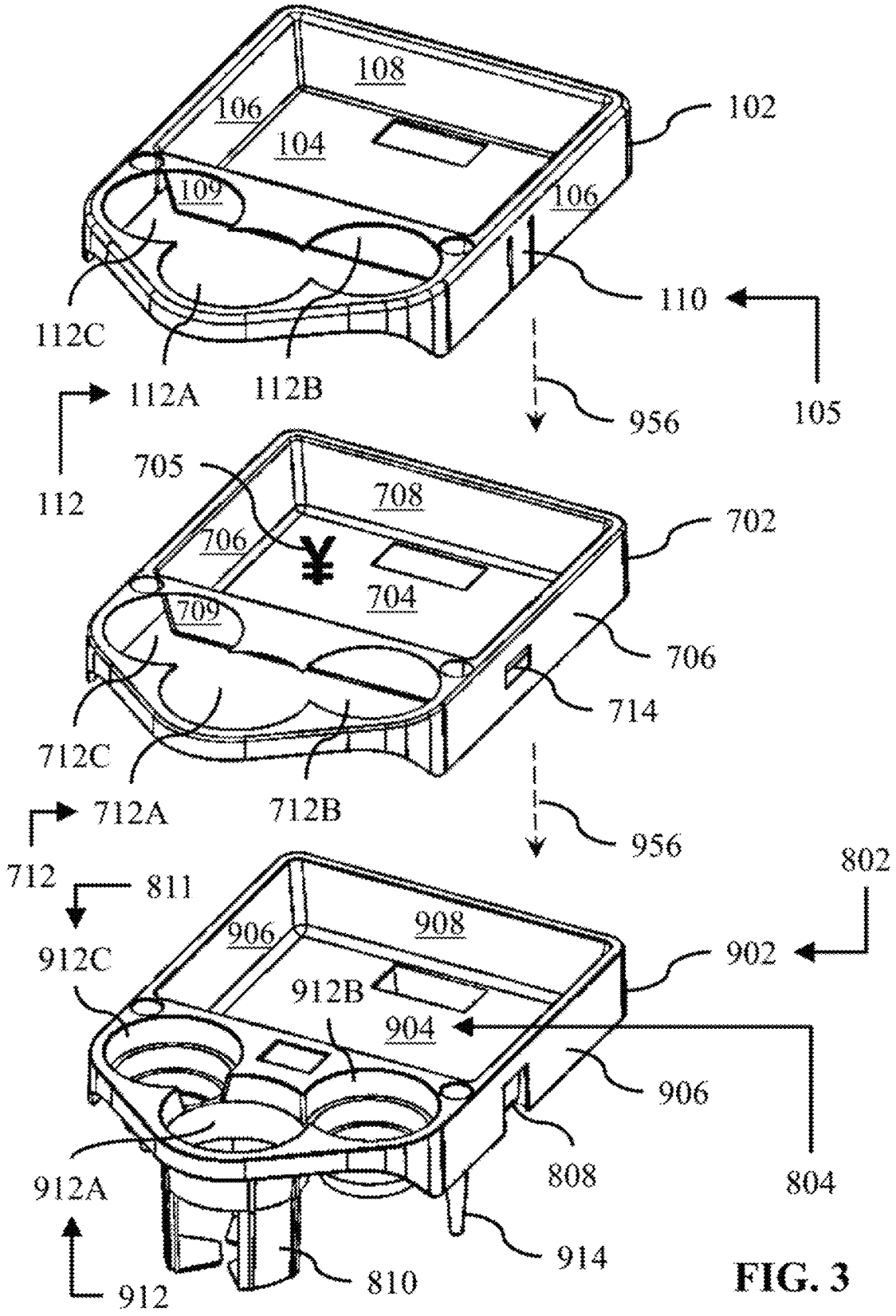
FIG. 3 depicts a perspective view of the embodiments of a cover assembly, a holder assembly, and a liner.

FIG. 3 depicts a perspective view of the embodiments of a cover assembly 102 (also called a cover), a holder assembly 802 (also called a holder), and a liner 702 (also called a liner assembly).

Referring to the embodiment as depicted in FIG. 3, an apparatus includes and is not limited to (comprises) a synergistic combination of a liner 702 and a cover assembly 102. The liner 702 has (includes) a liner surface 704 with a liner image 705 (also called an icon, such as ¥, a symbol, text, etc., any other kind, and any equivalent thereof) formed on the liner surface 704. The liner 702 is configured to be selectively positioned over, at least in part, (and to contact, or to cover, at least in part) a holder surface 804 of a holder assembly 802. This is done in such a way that the liner 702, in use, positions the liner image 705 formed on the liner surface 704 so that (such as that) the liner image 705, in use, faces away from the holder surface 804 of the holder assembly 802.

The liner 702 may be made of suitable material, such as a paper material, plastic material, etc., any other kind, and any equivalent thereof. The liner image 705 may be made of ink placed on the liner 702 via a printing process, etc., any other kind, and any equivalent thereof. The cover assembly 102 may be made of suitable material, such as a plastic material, a durable material, etc., any other kind, and any equivalent thereof. The cover assembly 102 is, preferably transparent, and may be translucent. The cover assembly 102 is configured to be light transmissive. The cover assembly 102 is configured to permit the passage (transmission) of light, at least in part, through the cover assembly 102.

The cover assembly 102 has (includes) a cover surface 104. The cover surface 104 of the cover assembly 102 is configured to selectively cover, at least in part, the liner image 705 formed on the liner surface 704 of the liner 702. The cover surface 104 of the cover assembly 102 is also configured to reveal (such as to an observer 950, as depicted in FIG. 4), at least in part, the liner image 705 formed on the liner surface 704 once the liner 702, in use, is selectively positioned over, at least in part, (and/or contacts, at least in part) the holder surface 804 of the holder assembly 802.

Figure 4:
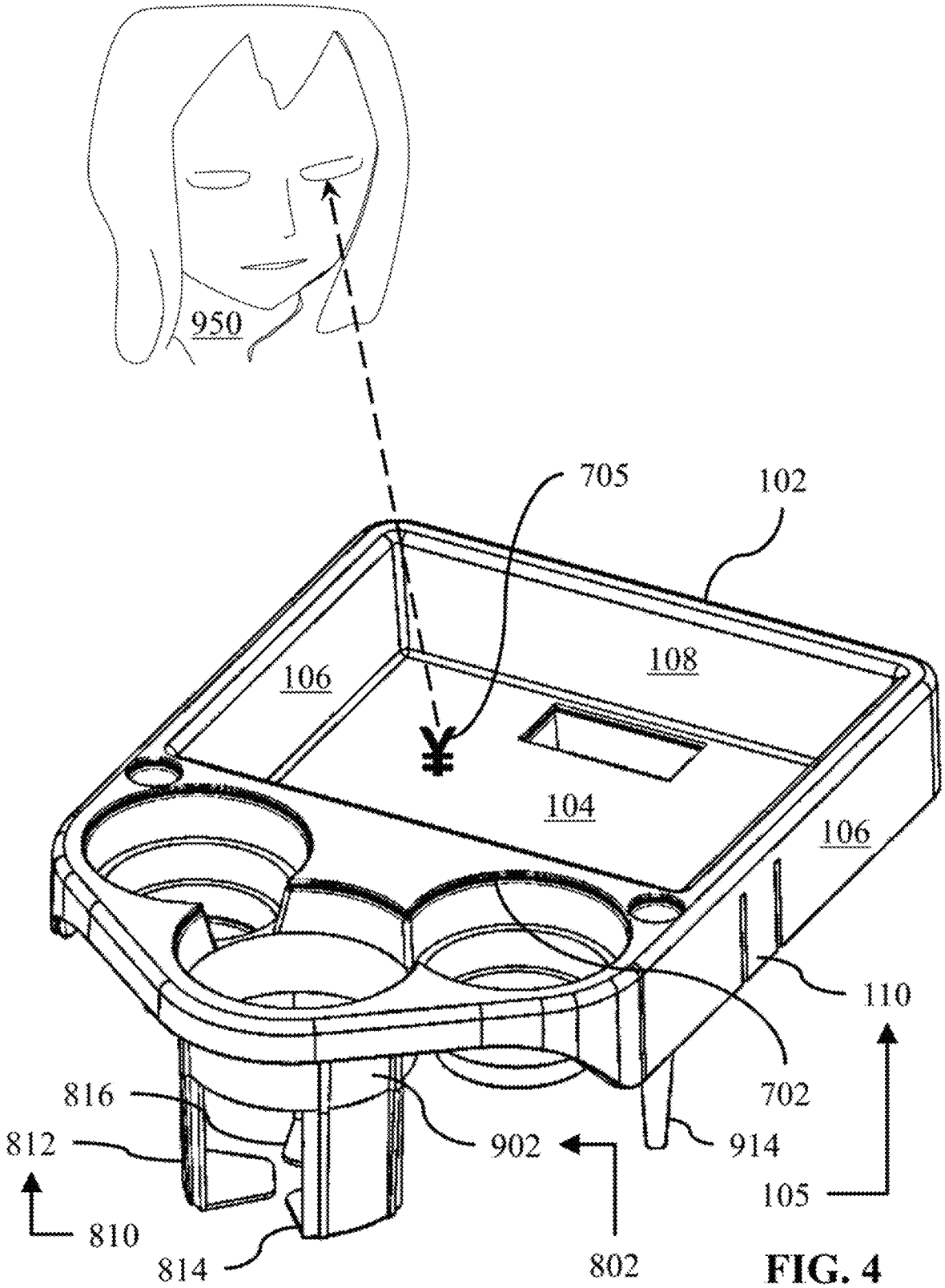
FIG. 4 depicts a perspective view of the embodiments of the cover assembly, the holder assembly, and the liner of FIG. 3.

In addition, the cover surface 104 of the cover assembly 102 is also configured to reveal (such as to an observer 950, as depicted in FIG. 4), at least in part, the liner image 705 formed on the liner surface 704 once the cover surface 104 of the cover assembly 102, in use, selectively covers, at least in part, the liner image 705 being formed on the liner surface 704 of the liner 702.

The liner 702, in use, enhances (visually enhances, improves or changes an appearance of) the holder assembly 802 once the liner 702 is selectively positioned between the cover assembly 102 and the holder assembly 802. The liner 702, in use, visually enhances (changes) an appearance of the holder assembly 802 once the liner 702 is selectively positioned between the cover assembly 102 and the holder assembly 802. The cover assembly 102, in use, visually protects the liner 702 from inadvertent (unwanted) damage. The cover assembly 102 is configured to protect or physically protect (at least in part) the liner 702 from inadvertent (unwanted) damage. The cover assembly 102 is configured to physically protect (protect) the appearance of the holder assembly 802 once the cover assembly 102 is selectively positioned proximate to the liner 702, and the liner 702 is positioned proximate to the holder assembly 802.

Referring to the embodiment as depicted in FIG. 3, an apparatus includes and is not limited to (comprises) a liner 702. The liner 702 has (includes) a liner surface 704 with a liner image 705 formed on the liner surface 704.

The liner 702 is configured to be selectively positioned over, at least in part, (and to contact, at least in part) a holder surface 804 of a holder assembly 802. This is done in such a way that the liner 702, in use, positions the liner image 705 being formed on the liner surface 704 so that (such as that) the liner image 705, in use, faces away from the holder surface 804 of the holder assembly 802.

The liner image 705 formed on the liner surface 704 of the liner 702 is configured to be selectively covered, at least in part, by a cover assembly 102 having a cover surface 104 (in which the cover surface 104 of the cover assembly 102 is also configured to reveal (such as to an observer 950, as depicted in FIG. 4), at least in part, the liner image 705 formed on the liner surface 704) once: (A) the liner 702, in use, is selectively positioned over, at least in part, (and/or contacts, at least in part) the holder surface 804 of the holder assembly 802, and (B) the cover surface 104 of the cover assembly 102, in use, selectively covers, at least in part, the liner image 705 being formed on the liner surface 704 of the liner 702.

Advantageously, the liner 702, in use, visually enhances (changes) an appearance of the holder assembly 802 once the liner 702 is selectively positioned between the cover assembly 102 and the holder assembly 802.

Referring to the embodiment as depicted in FIG. 3, a method is provided for visually enhancing (improving, visually changing an appearance of) a holder assembly 802 (a method for enhancing a holder assembly 802). The method includes and is not limited to (comprises) a first step. The first step includes positioning a liner 702, at least in part, over (and/or contacting at least in part) a holder surface 804 of a holder assembly 802 (the liner 702 has a liner surface 704 with a liner image 705 formed on the liner surface 704). This is done in such a way that the liner 702, in use, positions the liner image 705 formed on the liner surface 704 so that (such as that) the liner image 705, in use, faces away from the holder surface 804 of the holder assembly 802.

The method also includes a second step. The second step includes selectively covering, at least in part, the liner image 705 formed on the liner surface 704 of the liner 702 with a cover assembly 102 having a cover surface 104 (the cover surface 104 of the cover assembly 102 is configured to reveal (such as to an observer 950, as depicted in FIG. 4), at least in part, the liner image 705 formed on the liner surface 704). The second step is done (performed) once: (A) the liner 702, in use, is selectively positioned over, at least in part, (and/or contacts, at least in part) the holder surface 804 of the holder assembly 802, and (B) the cover surface 104 of the cover assembly 102, in use, selectively covers, at least in part, the liner image 705 being formed on the liner surface 704 of the liner 702.

The liner 702, in use, visually enhances (changes) an appearance of the holder assembly 802 once the liner 702 is selectively positioned between the cover assembly 102 and the holder assembly 802. The cover assembly 102, in use, physically protects an appearance of the holder assembly 802 once the cover assembly 102 is selectively positioned proximate to the holder assembly 802 (and/or preferably once the cover assembly 102 is selectively connected or attached to the holder assembly 802). The cover assembly 102, in use, physically protects an appearance of the liner 702 once the cover assembly 102 is selectively positioned proximate to the liner 702 (and/or preferably once the cover assembly 102 is selectively connected to the holder assembly 802).

Referring to the embodiment as depicted in FIG. 3, the apparatus further includes an engagement feature 105. The engagement feature 105 is configured to selectively engage the cover assembly 102 and the holder assembly 802 with each other. This is done in such a way that the engagement feature 105 securely positions the cover surface 104, in use, to cover, at least in part, the liner image 705 formed on the liner surface 704 of the liner 702. The liner 702 is selectively positioned over, at least in part, the holder surface 804 of the holder assembly 802.

Referring to the embodiment as depicted in FIG. 3, the apparatus is further adapted such that the engagement feature 105 is configured to selectively disengage the cover assembly 102 and the holder assembly 802 from each other.

Referring to the embodiment as depicted in FIG. 3, the apparatus is further adapted such that the engagement feature 105 includes a synergistic combination of a cover-engagement feature 110 and a holder-engagement feature 808. The cover-engagement feature 110 is provided by (positioned on) the cover assembly 102. The holder-engagement feature 808 is provided by (positioned on) the holder assembly 802. The cover-engagement feature 110 and the holder-engagement feature 808 are configured to selectively engage with each other.

Referring to the embodiment as depicted in FIG. 3, the apparatus is further adapted such that the holder assembly 802 includes a food-service tray 902. The holder surface 804 includes a tray surface 904 being provided by the food-service tray 902.

The food-service tray 902 may be made by an injection molding machine (known and not depicted). In accordance with an option, it will be appreciated that the liner 702 and the cover assembly 102 are formed as an integral unit (formed as a single unit). In accordance with an option, it will be appreciated that the liner 702 and the holder assembly 802 are formed as an integral unit (fused as a single unit). In accordance with an option, it will be appreciated that the cover assembly 102 and the liner 702 and the holder assembly 802 are formed as an integral unit (fused as a single unit).

Referring to the embodiment as depicted in FIG. 3, the cover assembly 102 includes lateral cover side walls 106 positioned on opposite lateral sides of the cover assembly 102.

The cover assembly 102 also includes a rear cover wall 108 extending between the lateral cover side walls 106. The cover assembly 102 also includes a front cover wall 109 extending between the lateral cover side walls 106. The rear cover wall 108 and the front cover wall 109 are spaced apart from each other.

Preferably, the cover assembly 102 provides (defines) a cover passageway 112 configured to permit passage (at least in part) of a drink container (for instance, the drink container 955 is depicted in the embodiment of FIG. 2). Preferably, the cover assembly 102 provides (defines) a first cover passageway 112A, a second cover passageway 112B and a third cover passageway 112C (which are spaced apart from each other, preferably positioned at the vertices of a triangle).

The liner 702 includes lateral liner side walls 706 positioned on the opposite lateral sides of the liner 702. Each of the opposite lateral sides of the liner 702 provides (defines) a liner side opening 714. The liner 702 also includes a rear liner wall 708 extending between the lateral liner side walls 706. The liner 702 also includes a front liner wall 709 extending between the lateral liner side walls 706. The rear liner wall 708 and the front liner wall 709 are spaced apart from each other.

Preferably, the liner 702 provides (defines) a liner passageway 712 configured to permit passage, at least in part, of a drink container 955 (of which an embodiment is depicted in FIG. 2). The liner passageway 712 and the cover passageway 112 are configured to be co-aligned (with each other) once the cover assembly 102 is positioned to cover, in use, the liner 702. Preferably, the liner 702 provides (defines) a first liner passageway 712A, a second liner passageway 712B and a third liner passageway 712C (which are spaced apart from each other, preferably positioned at the vertices of a triangle). The first liner passageway 712A, the second liner passageway 712B and the third liner passageway 712C correspond with the first cover passageway 112A, the second cover passageway 112B and the third cover passageway 112C (respectively).

Figure 12:
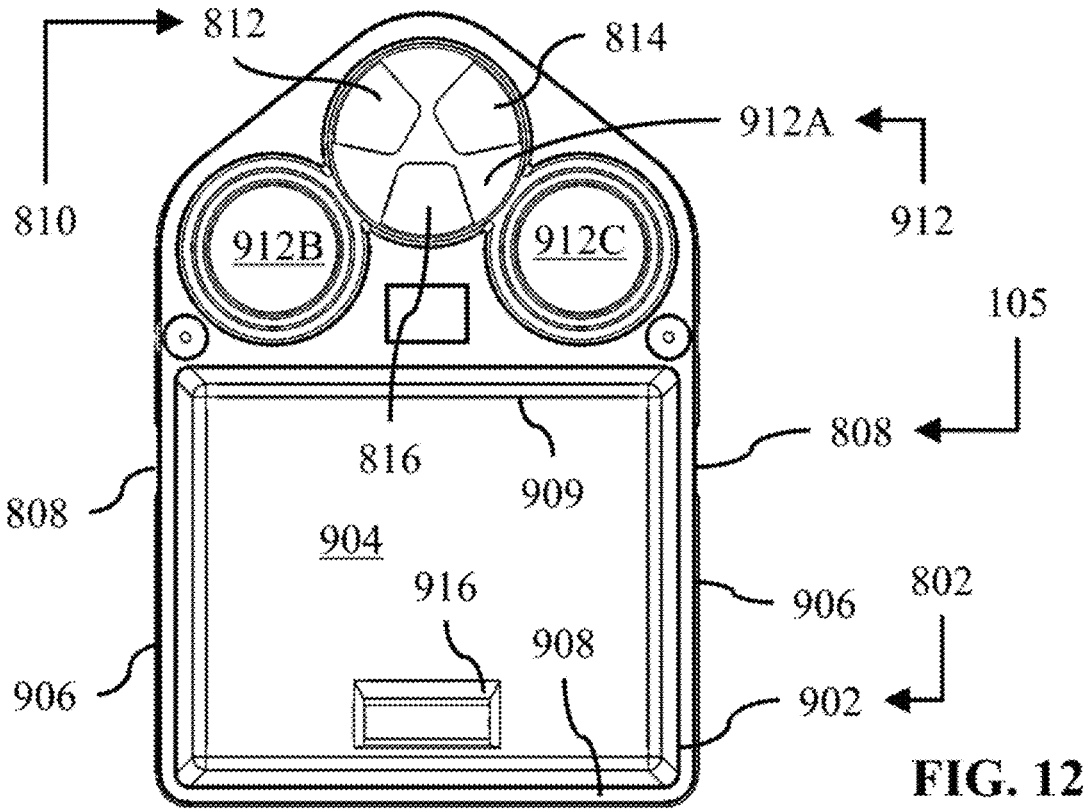
FIG. 12 and FIG. 13 depict a top view (FIG. 12) and a bottom view (FIG. 13) of the embodiments of the holder assembly of FIG. 3 or FIG. 10.

The food-service tray 902 includes lateral tray side walls 906 positioned on the opposite lateral sides of the food-service tray 902. The food-service tray 902 also includes a rear tray wall 908 extending between the lateral tray side walls 906. The food-service tray 902 also includes a front tray wall 909 extending between the lateral tray side walls 906 (it will be appreciated that the front tray wall 909 is hidden in FIG. 3, and is depicted in the embodiment of FIG. 12).

Preferably, the food-service tray 902 provides (defines) a tray passageway 912 configured to permit passage, at least in part, of a drink container 955 (of which an embodiment is depicted in FIG. 2). The cover passageway 112, the liner passageway 712 and the tray passageway 912 are configured to be co-aligned with each other once the cover assembly 102 is positioned to cover, in use, the liner 702, and once the liner 702 is positioned to cover, in use, the food-service tray 902.

Preferably, in general terms, the holder assembly 802 includes lateral holder side walls positioned on the opposite lateral sides of the holder assembly 802. A rear holder wall extends between the lateral holder side walls. A front holder wall extends between the lateral holder side walls (in a manner that may be similar to the food-service tray 902, etc.).

More preferably, the holder assembly 802 defines a holder passageway 811 configured to permit passage, at least in part, of a drink container 955 (of which an embodiment is depicted in FIG. 2). The cover passageway 112, the liner passageway 712 and the holder passageway 811 are configured to be co-aligned with each other once the cover assembly 102 is positioned to cover, in use, the liner 702, and once the liner 702 is positioned to cover, in use, the holder assembly 802.

Preferably, the food-service tray 902 provides (defines) a first tray passageway 912A, a second tray passageway 912B and a third tray passageway 912C. The first tray passageway 912A, the second tray passageway 912B and the third tray passageway 912C correspond with the first liner passageway 712A, the second liner passageway 712B and the third liner passageway 712C (respectively). The first tray passageway 912A, the second tray passageway 912B and the third tray passageway 912C correspond with the first cover passageway 112A, the second cover passageway 112B and the third cover passageway 112C (respectively).

Preferably, the food-service tray 902 also includes a front tray stand 914 configured to support the food-service tray 902 once the food-service tray 902 is positioned on a horizontal working surface.

Referring to the embodiment as depicted in FIG. 3, the liner 702 is movable along the positioning direction 956 so that the liner 702 is receivable, at least in part, by (in) the food-service tray 902. The cover assembly 102 is movable along the positioning direction 956 so that the cover assembly 102 is receivable, at least in part, by (in) the liner 702. A peripheral cover wall of the cover assembly 102 is configured to surround (cover), at least in part, a peripheral liner wall of the liner 702 (once the cover assembly 102, in use, is received, at least in part, by the liner 702). A peripheral liner walls of the liner 702 is configured to surround (cover), at least in part, a peripheral food-service tray wall of the food-service tray 902 (once the liner 702, in use, is received, at least in part, by the food-service tray 902). The peripheral liner wall of the liner 702 is configured to surround (cover), at least in part, the peripheral holder wall of the holder assembly 802 (once the liner 702, in use, is received, at least in part, by the holder assembly 802). Once the cover assembly 102 is placed (positioned) over the lateral liner side walls 706, the liner image 705 is shown (revealed) to the observer 950. The cover assembly 102 is configured to shield or protect the liner image 705 from inadvertent or unwanted damage.

In accordance with a preferred embodiment (which may be applicable to all of the drawings that depict embodiments of the liner 702), the liner 702 is configured to form (provide) a foldable flat surface. The foldable flat surface is configured to be folded in such a way that the liner 702, in use, forms (once folded as such) a shape that is configured to conform (to mimic), at least in part, with an aspect (a structure) of an outer shape (a portion) of the holder assembly 802 and/or the food-service tray 902. For instance, the liner 702 may include lines of weakness, perforations, etc., any other kind, and any equivalent thereof). The lines of weakness are configured to facilitate predetermined folding of the liner 702 along the lines of weakness (in accordance with the techniques known to persons of skill in the art of foldable flat surfaces, and therefore are not described here in any further detail). It will be appreciated that in accordance with an option, the liner 702 is not foldable.

In accordance with a preferred embodiment (which is applicable to all of the drawings that depict embodiments of the liner 702), the liner 702 (preferably) forms a two dimensional shape (formation) configured to be folded to form a three dimensional shape (configuration or arrangement). Once folded as such, the liner 702 is configured to conform, at least in part, to an outer shape of or an aspect of (such as the outward-facing contours of) the holder assembly 802 and/or the food-service tray 902.

In accordance with a preferred embodiment (which is applicable to all of the drawings that depict embodiments of the liner 702), the liner 702 is configured to be applied (either directly or indirectly), at least in part, to an aspect of or the outward-facing contours of the holder assembly 802 and/or the food-service tray 902. For instance, the liner 702 may be painted on (spray painted on, etc.), at least in part, an aspect of or the outward-facing contours of the holder assembly 802 and/or the food-service tray 902. For instance, the liner 702 may include a shrink-wrap material configured to be shrink wrapped (at least in part) to an aspect of or the outward-facing contours of the holder assembly 802 and/or the food-service tray 902. For instance, the liner 702 may be laminated, if so desired.

FIG. 4 depicts a perspective view of the embodiments of the cover assembly 102, the holder assembly 802, and the liner 702 of FIG. 3.

Referring to the embodiment as depicted in FIG. 4, the holder assembly 802 (or the food-service tray 902) further includes a joiner assembly 810. In accordance with one embodiment, the joiner assembly 810 is configured to selectively join (connect or couple) the holder assembly 802 (or the food-service tray 902) to the first drink hole feature 502 (as depicted in FIG. 2). Preferably, the joiner assembly 810 is configured to be received in the first drink hole 503 of the first drink hole feature 502.

Figure 16:
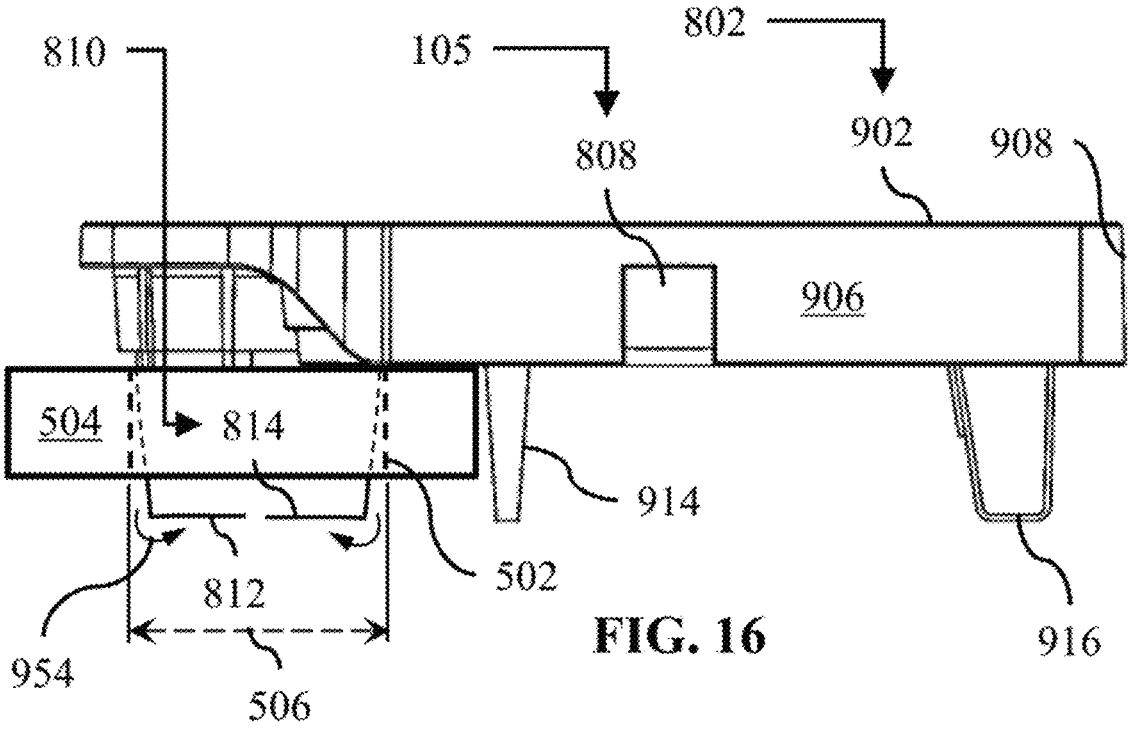
FIG. 16 and FIG. 17 depict side views of the embodiments of the holder assembly of FIG. 3 or FIG. 10.
Figure 17:
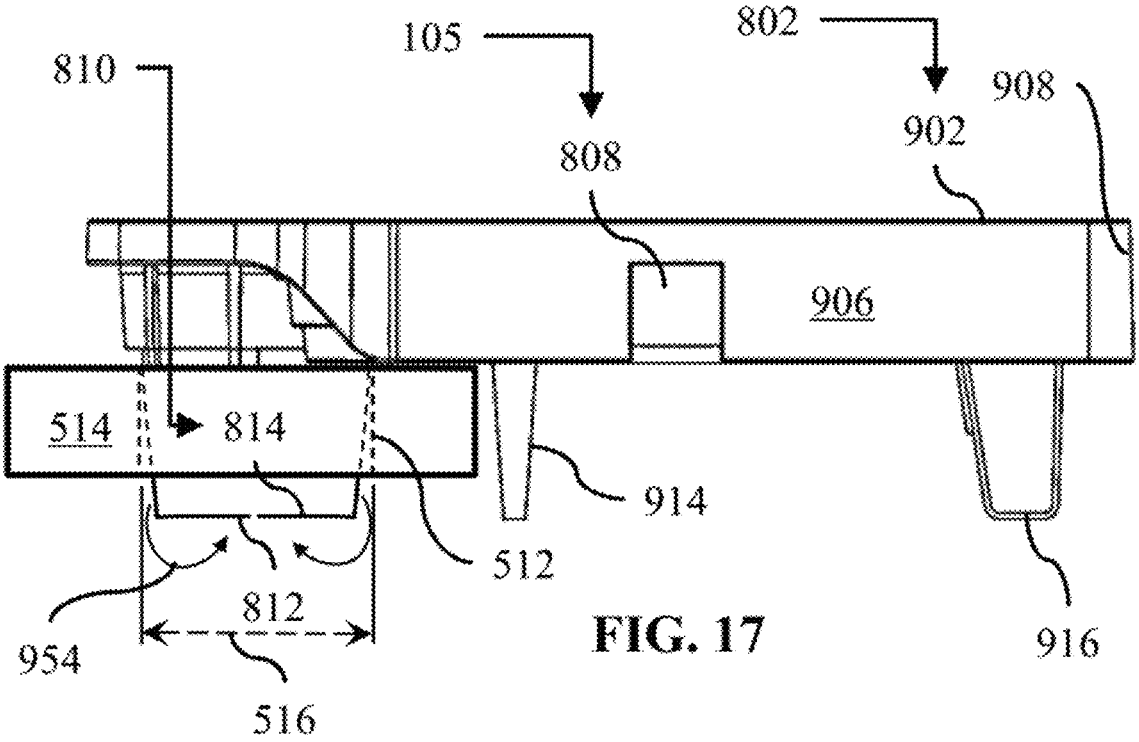

In accordance with a most preferred embodiment of the joiner assembly 810 (as depicted in FIG. 16 and FIG. 17), the joiner assembly 810 includes a first joiner finger 812, a second joiner finger 814 and a third joiner finger 816 (or any number of joiner fingers, or at least two or more joiner fingers). The joiner assembly 810 is configured to be resiliently deformable. The first joiner finger 812, the second joiner finger 814 and the third joiner finger 816 are configured to be resiliently deformable. At least two or more joiner fingers are configured to be resiliently deformable.

The cover assembly 102 is also configured to reveal (such as to an observer 950), at least in part, the liner image 705 formed on the liner 702 (once the liner 702, in use, is selectively positioned over, at least in part, the holder assembly 802).

The cover assembly 102 is also configured to reveal (such as to an observer 950), at least in part, the liner image 705 formed on the liner 702 (once the cover assembly 102, in use, selectively covers, at least in part, the liner image 705 formed on the liner 702).

Figure 5:
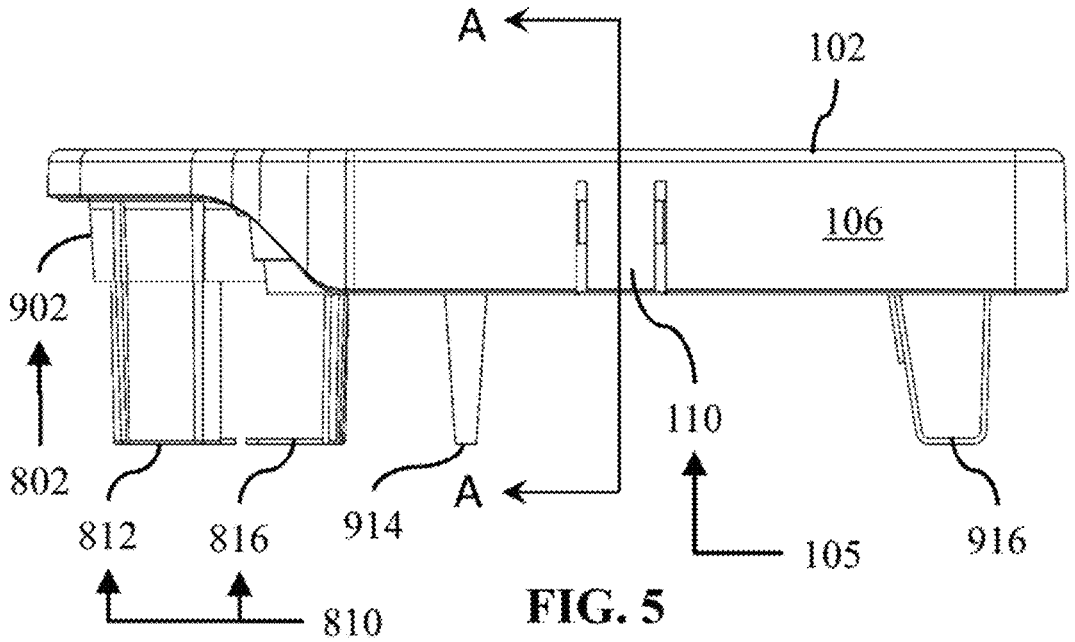
FIG. 5 and FIG. 6 depict a side view (FIG. 5) and a cross-sectional view (FIG. 6, in which the view of FIG. 6 is taken through a cross-sectional line A-A of FIG. 5) of the embodiments of the cover assembly, the holder assembly, and the liner of FIG. 3.
Figure 6:
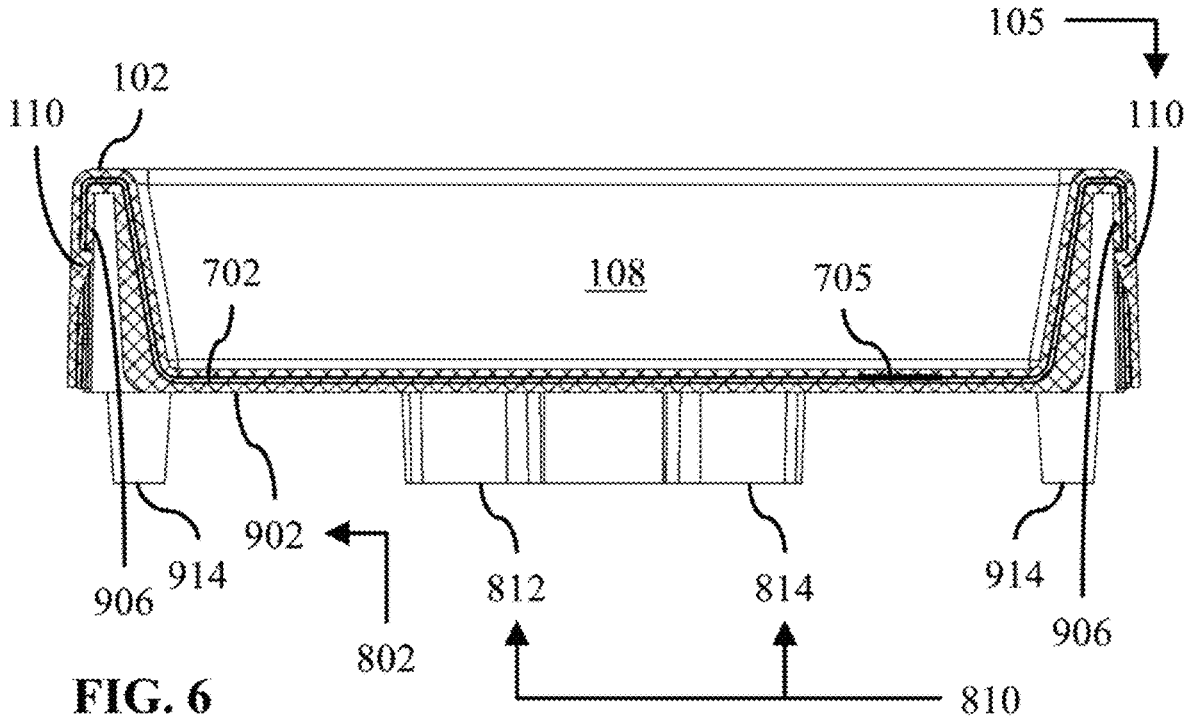

FIG. 5 and FIG. 6 depict a side view (FIG. 5) and a cross-sectional view (FIG. 6, in which the view of FIG. 6 is taken through a cross-sectional line A-A of FIG. 5) of the embodiments of the cover assembly 102, the holder assembly 802, and the liner 702 of FIG. 3.

Referring to the embodiments as depicted in FIG. 5 and FIG. 6, the food-service tray 902 includes a front tray stand 914 and a rear tray stand 916. The rear tray stand 916 is spaced apart from the front tray stand 914. The front tray stand 914 and the rear tray stand 916 are configured to support the food-service tray 902 once the food-service tray 902 is placed on a working surface.

Referring to the embodiments as depicted in FIG. 5 and FIG. 6, the liner 702 is placed over (at least in part), and/or contacts, at least in part, the holder assembly 802 (or the food-service tray 902). The cover assembly 102 is positioned over, at least in part, and/or contacts, at least in part, the liner 702.

Figure 7:
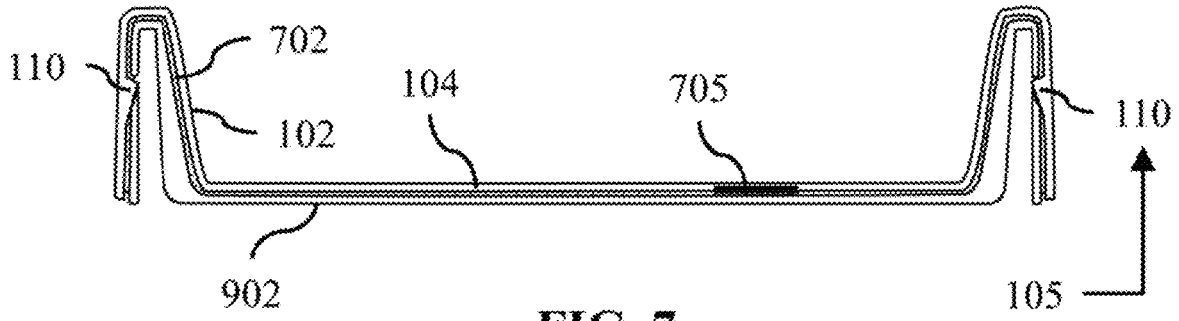
FIG. 7 to FIG. 9 depict cross-sectional views (which are taken through a cross-sectional line A-A of FIG. 5) of the embodiments of the cover assembly, the holder assembly, and the liner of FIG. 3.
Figure 8:
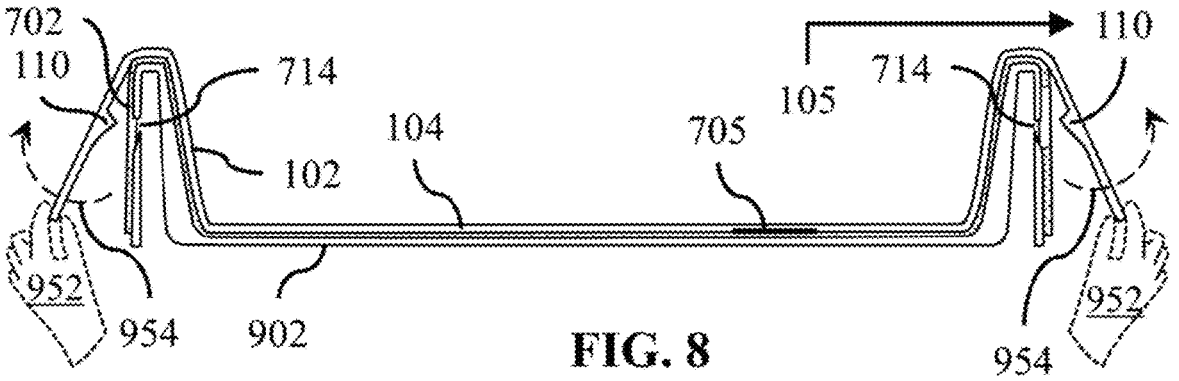
Figure 9:
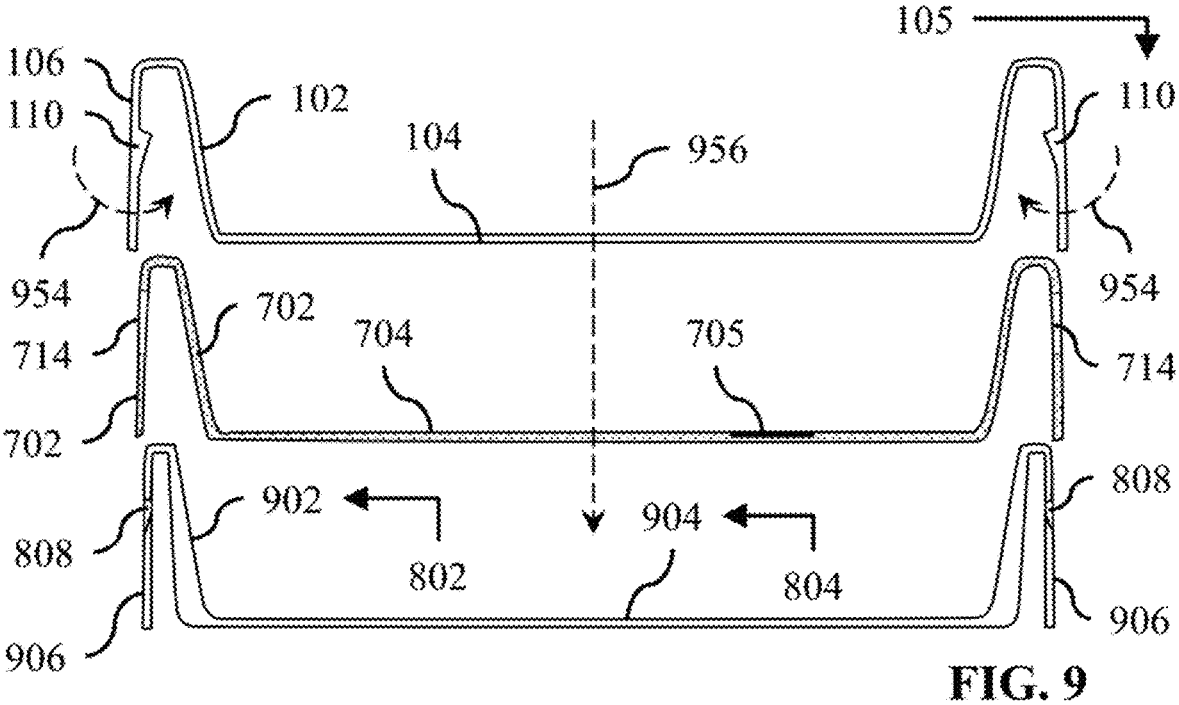

FIG. 7 to FIG. 9 depict cross-sectional views (which are taken through a cross-sectional line A-A of FIG. 5) of the embodiments of the cover assembly 102, the holder assembly 802, and the liner 702 of FIG. 3.

Referring to the embodiments as depicted in FIG. 7, the liner image 705 is positioned under the cover assembly 102. The cover assembly 102 is configured to protect, at least in part, the liner 702 (and/or the liner image 705) (from unwanted damage and/or unwanted removal from a position located proximate (adjacent) to the food-service tray 902). The side walls of the cover assembly 102 include the cover-engagement feature 110. The cover-engagement feature 110 of the cover assembly 102 is selectively coupled (at least in part) to the side walls of the food-service tray 902. Preferably, the cover-engagement feature 110 includes a detent section, and the food-service tray 902 includes the holder-engagement feature 808 (as depicted in FIG. 9, also called a notched section, for the detent section of the cover-engagement feature 110). The detent section of the cover-engagement feature 110 is selectively coupled to the holder-engagement feature 808 of the food-service tray 902.

Referring to the embodiments as depicted in FIG. 8, a user 952 grabs (grips) spaced apart portions of the cover assembly 102 (such as the opposite side walls of the cover assembly 102). The user 952 then peels (rotates) back the portions of the cover assembly 102 along a movement direction 954 (a rotational movement). Once the portions of the cover assembly 102 are moved back along the movement direction 954 a sufficient distance, the cover assembly 102 becomes selectively decoupled from the food-service tray 902. Preferably, the user 952 selectively decouples the cover-engagement feature 110 relative to the holder-engagement feature 808 of the food-service tray 902. The cover-engagement feature 110 is removed from the liner side opening 714 of the liner 702.

Referring to the embodiments as depicted in FIG. 9, the cover assembly 102, the liner 702 and the food-service tray 902 are positioned in a spaced-apart relationship relative to each other. The cover assembly 102 and the liner 702 are movable along the positioning direction 956 toward (or away from) the food-service tray 902.

Figure 10:
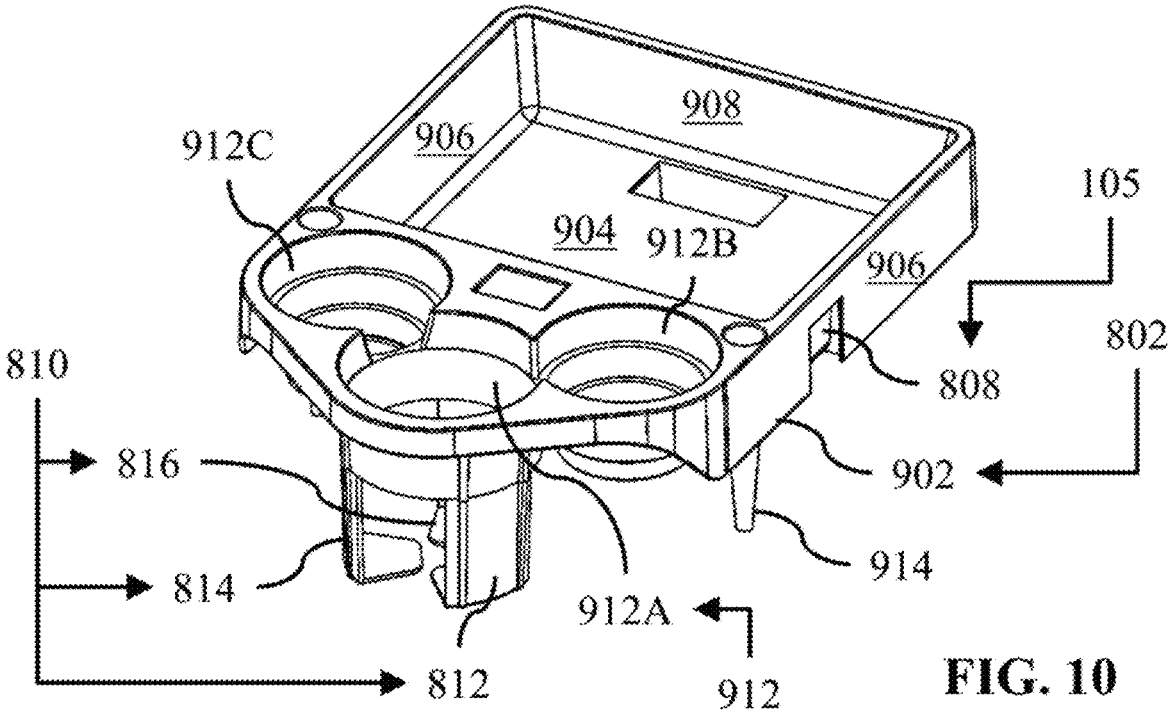
FIG. 10 and FIG. 11 depict a top perspective view (FIG. 10) and a bottom perspective view (FIG. 11) of the embodiments of a holder assembly (in which the embodiments of FIG. 10 and FIG. 11 may be applicable to the embodiment of FIG. 3, and in which the embodiments of FIG. 10 and FIG. 11 may be utilized independently of the embodiment of FIG. 3)
Figure 11:
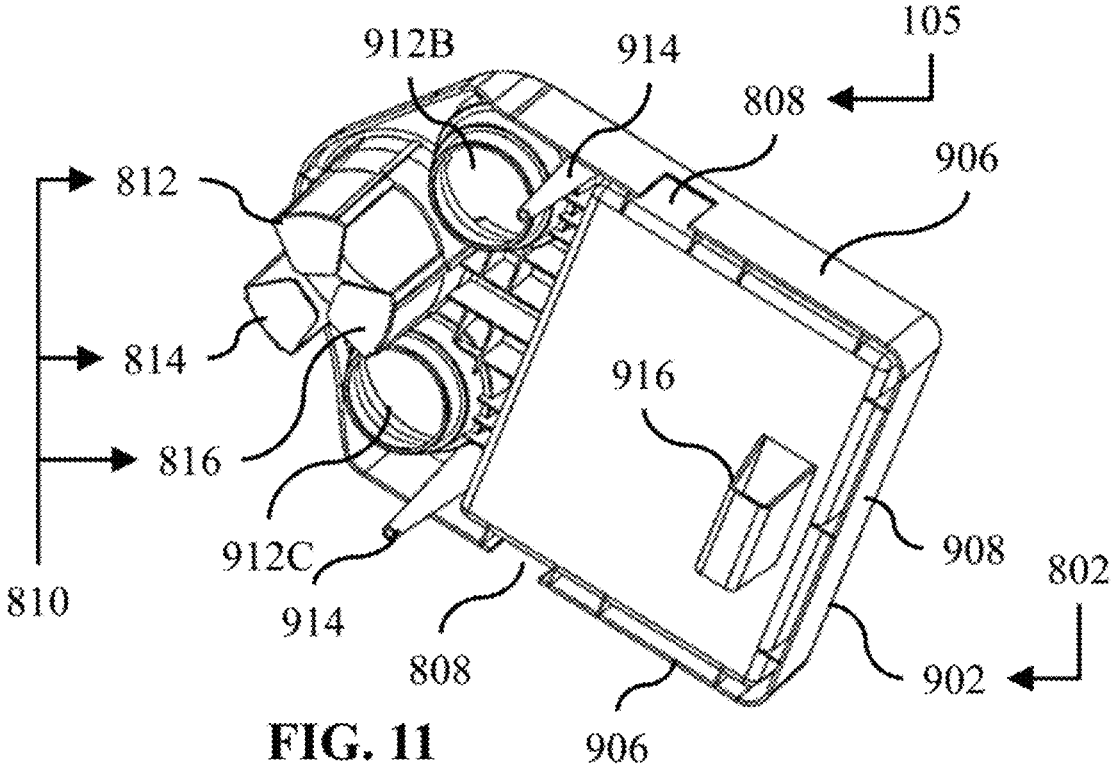
Figure 13:
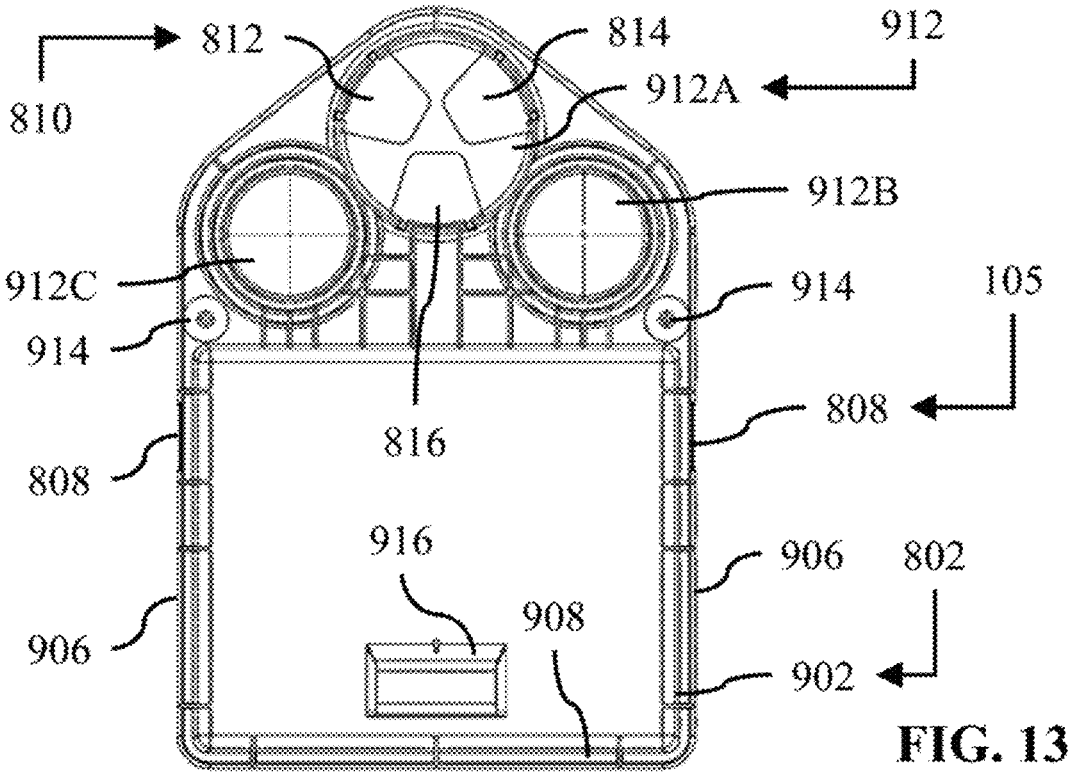
Figure 14:
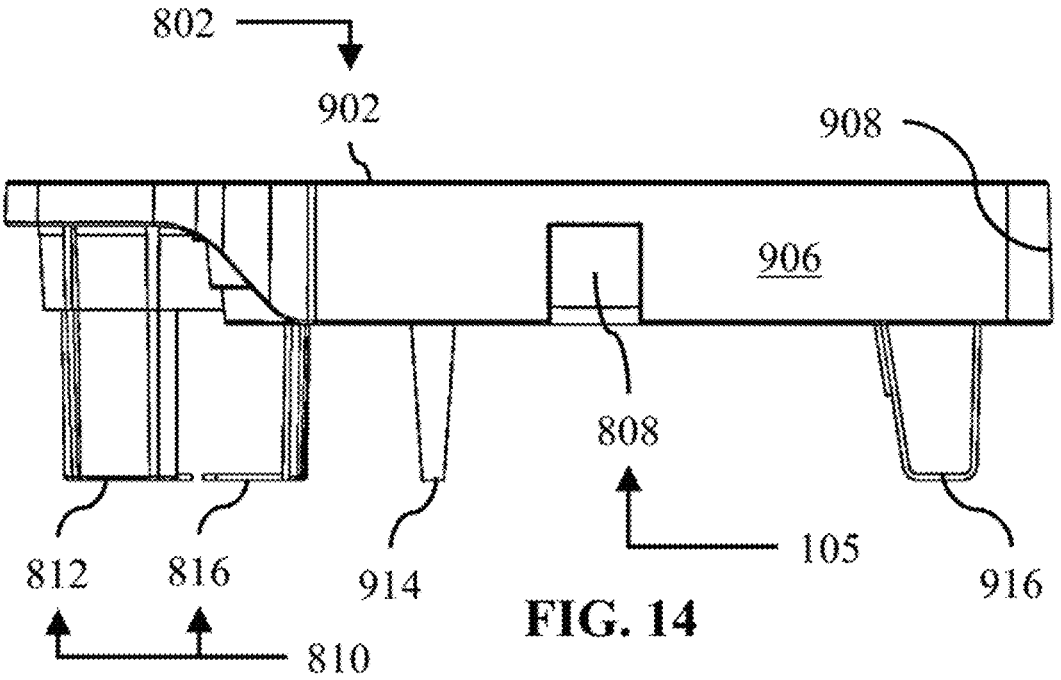
FIG. 14 and FIG. 15 depict a side view (FIG. 14) and a front view (FIG. 15) of the embodiments of the holder assembly of FIG. 3 or FIG. 10.
Figure 15:
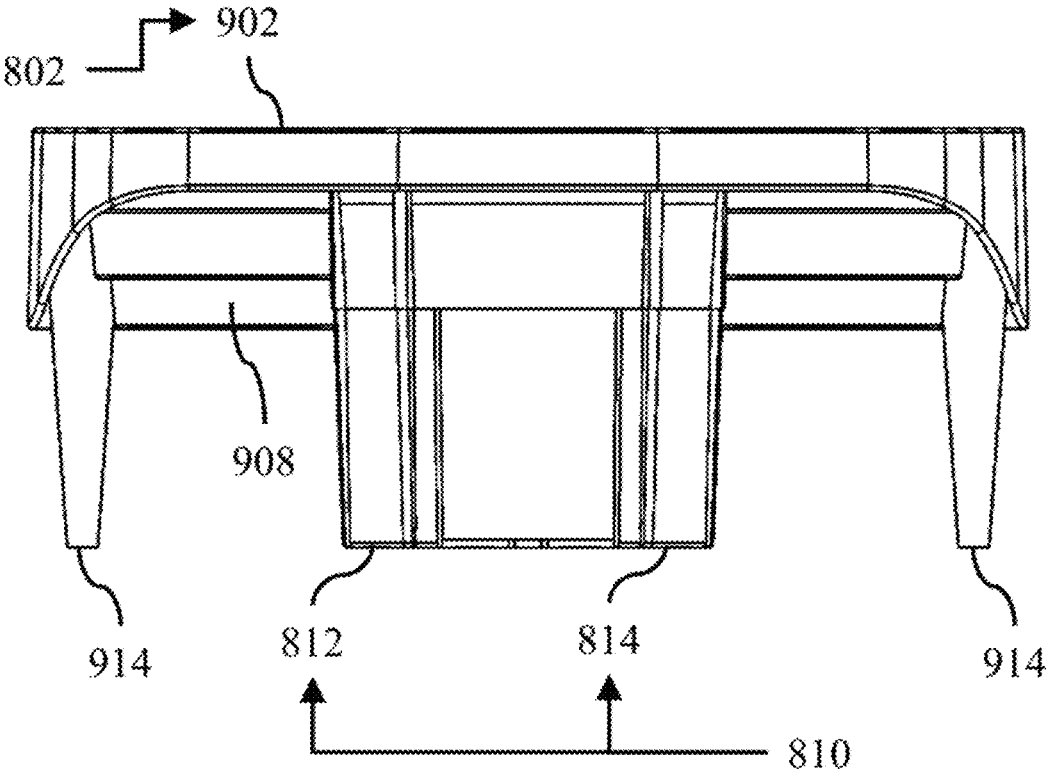

FIG. 10 to FIG. 17 depict views of the embodiments of a holder assembly 802. It will be appreciated that the embodiments of FIG. 10 and FIG. 11 may be applicable to the embodiment of FIG. 3. It will be appreciated that the embodiments of FIG. 10 and FIG. 11 may be utilized independently of the embodiment of FIG. 3. FIG. 10 depicts a top perspective view of the food-service tray 902. FIG. 11 depicts a bottom perspective view of the food-service tray 902. FIG. 12 depicts a top view of the food-service tray 902. FIG. 13 depicts a bottom view of the food-service tray 902. FIG. 14 depicts a side view of the food-service tray 902. FIG. 15 depicts a front view of the food-service tray 902. FIG. 16 depicts a side view of the food-service tray 902. FIG. 17 depicts a side view of the food-service tray 902.

Referring to the embodiments as depicted in FIG. 16 and FIG. 17, an apparatus includes and is not limited to (comprises) a holder assembly 802 (also called a universal tray, etc.). The holder assembly 802 has (includes) a holder surface (also called a tray surface). The holder assembly 802 also has a joiner assembly 810 (also called a connector, an engagement, etc., any other kind, and any equivalent thereof). The joiner assembly 810 is configured to extend from the holder assembly 802. The joiner assembly 810 may be integral with (integrated with) the holder assembly 802 (if so desired), or the joiner assembly 810 may be selectively coupled to (and removable from) the holder assembly 802 (if so desired). The joiner assembly 810 is configured to be selectively receivable, at least in part, in a first drink hole feature 502 of a first seating system 504. The joiner assembly 810 is also configured to be selectively receivable, at least in part, in a second drink hole feature 512 of a second seating system 514. The joiner assembly 810 is also configured to selectively securely engage with the first drink hole feature 502 of the first seating system 504 once the joiner assembly 810 is received, at least in part, in the first drink hole feature 502 of the first seating system 504. The joiner assembly 810 is also configured to selectively securely engage with the second drink hole feature 512 of the second seating system 514 once the joiner assembly 810 is received, at least in part, in the second drink hole feature 512 of the second seating system 514. The joiner assembly 810 is also being configured to cooperate with the first drink hole feature 502 of the first seating system 504, in which the first drink hole feature 502 has a first inner diameter 506. The joiner assembly 810 is also being configured to cooperate with the second drink hole feature 512 of the second seating system 514 having a second inner diameter 516. The first inner diameter 506 of the first drink hole feature 502 and the second inner diameter 516 of the second drink hole feature 512 are different from each other.

Referring to the embodiments as depicted in FIG. 16 and FIG. 17, preferably, the joiner assembly 810 includes a first joiner finger 812, a second joiner finger 814 and a third joiner finger 816, or any number of joiner fingers, or at least two or more joiner fingers, as also depicted in FIG. 4 (in which it will be appreciated that FIG. 16 and FIG. 17 do not depict the third joiner finger 816 as depicted in FIG. 4).

Referring to the embodiments as depicted in FIG. 16 and FIG. 17, the apparatus is further adapted such that the joiner assembly 810 is also configured to selectively disengage from the first drink hole feature 502 of the first seating system 504. The joiner assembly 810 is also configured to selectively disengage from the second drink hole feature 512 of the second seating system 514.

Figure 18:
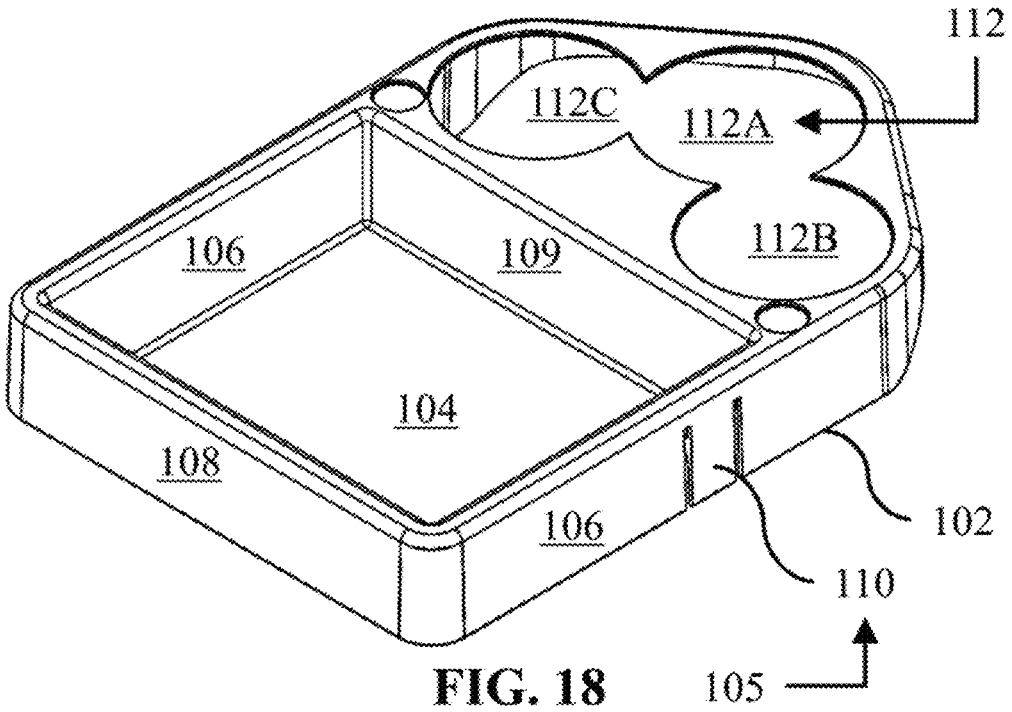
FIG. 18 and FIG. 19 depict a perspective view (FIG. 18) of the cover assembly of FIG. 3, and a perspective view (FIG. 19) of the liner of FIG. 3.
Figure 19:
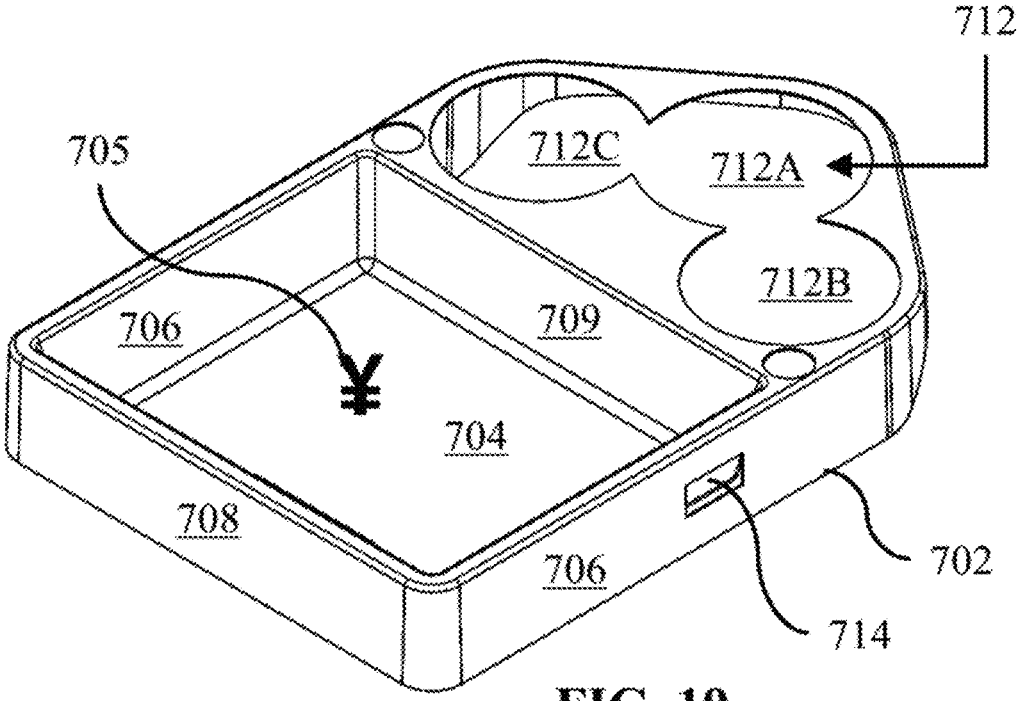

FIG. 18 and FIG. 19 depict a perspective view (FIG. 18) of the cover assembly 102 of FIG. 3, and a perspective view (FIG. 19) of the liner 702 of FIG. 3.

Referring to the embodiment as depicted in FIG. 18, the cover assembly 102 includes lateral cover side walls 106 positioned on opposite sides of the cover assembly 102. The cover assembly 102 also includes a rear cover wall 108 that spans across the opposite sides of the cover assembly 102. The cover assembly 102 also includes a front cover wall 109 spaced apart from the rear cover wall 108, and spans across the opposite sides of the cover assembly 102. The cover assembly 102 also includes (provides or defines) a cover passageway 112 configured to receive and/or permit passage of a drink container. Preferably, the cover passageway 112 includes a first cover passageway 112A, a second cover passageway 112B and a third cover passageway 112C.

Referring to the embodiment as depicted in FIG. 19, the liner 702 includes lateral liner side walls 706 positioned on opposite sides of the liner 702. The lateral liner side walls 706 corresponds with the lateral cover side walls 106 of the cover assembly 102 (as depicted in FIG. 18). Each of the lateral liner side walls 706 provides (defines) the liner side opening 714 (the engagement feature of the holder assembly 802 and/or the engagement feature of the cover assembly 102 are configured to engage (at least in part) with the liner side opening 714). The liner 702 also includes a rear liner wall 708 that corresponds with the rear cover wall 108 of the cover assembly 102 (as depicted in FIG. 18). The rear liner wall 708 extends between opposite sides of the liner 702. The liner 702 also includes a front liner wall 709. The front liner wall 709 corresponds with the front cover wall 109 of the cover assembly 102 (as depicted in FIG. 18). The front liner wall 709 is spaced apart from the rear liner wall 708, and spans across the opposite sides of the liner 702. The liner 702 also includes (defines or provides) a liner passageway 712 (configured to receive and/or permit passage of a drink container). The liner passageway 712 corresponds to the cover passageway 112 of the cover assembly 102 (as depicted in FIG. 18). Preferably, the liner passageway 712 includes a first liner passageway 712A, a second liner passageway 712B and a third liner passageway 712C. Preferably, the first liner passageway 712A, the second liner passageway 712B and the third liner passageway 712C correspond to the first cover passageway 112A, the second cover passageway 112B and the third cover passageway 112C (respectively) of the cover assembly 102 (as depicted in FIG. 18).

Figure 20:
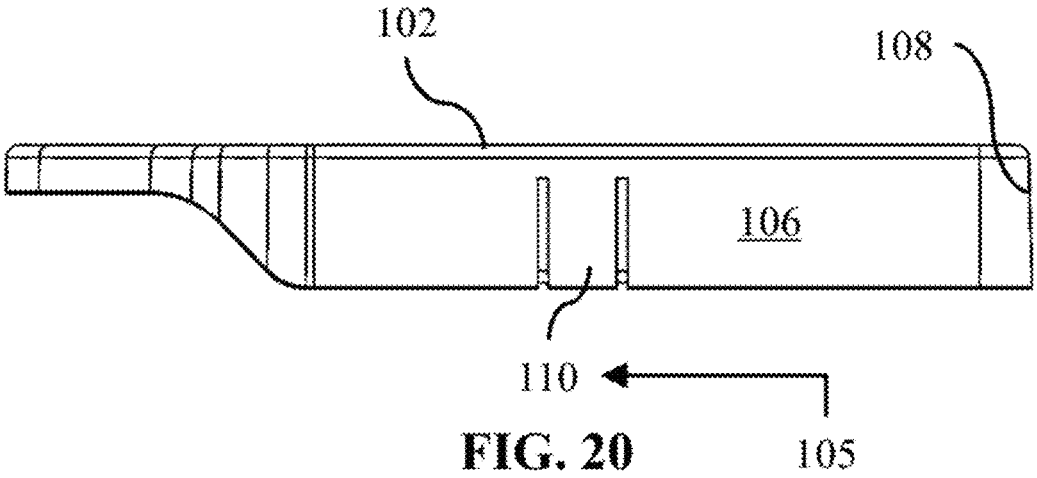
FIG. 20 and FIG. 21 depict a side view (FIG. 20) and a top view (FIG. 21) of the embodiments of the cover assembly of FIG. 3.
Figure 21:
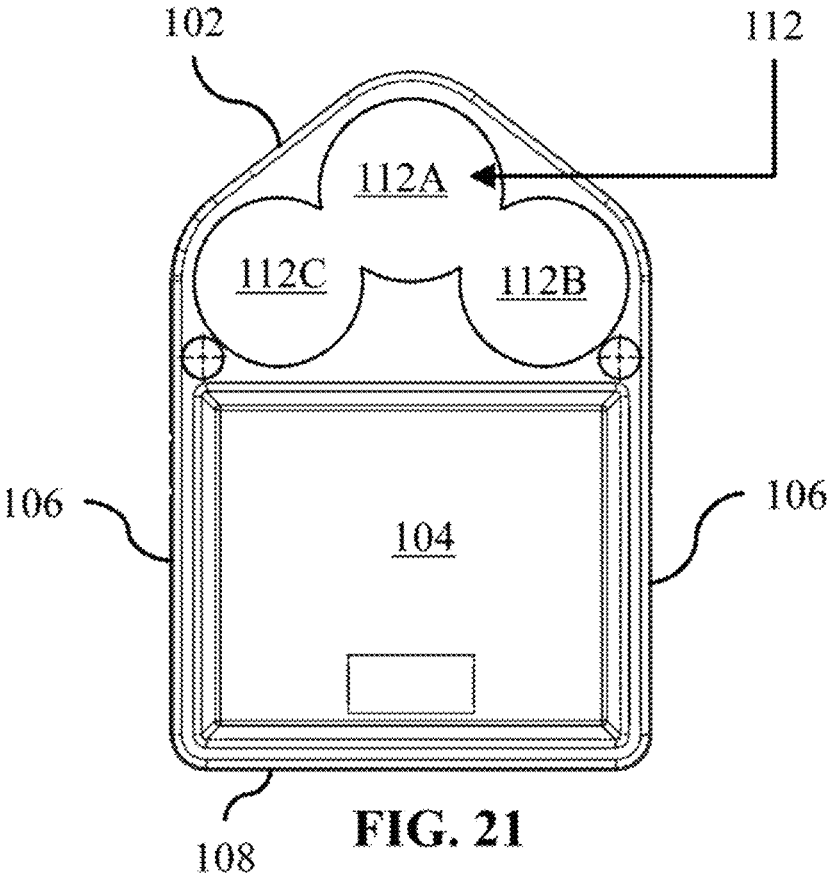

FIG. 20 and FIG. 21 depict a side view (FIG. 20) and a top view (FIG. 21) of the embodiments of the cover assembly 102 of FIG. 3.

Referring to the embodiments as depicted in FIG. 20 and FIG. 21, the lateral cover side walls 106 of the cover assembly 102 has a vertical height. The cover-engagement feature 110 is positioned midway between the front and rear sections of the cover assembly 102.

Figure 22:
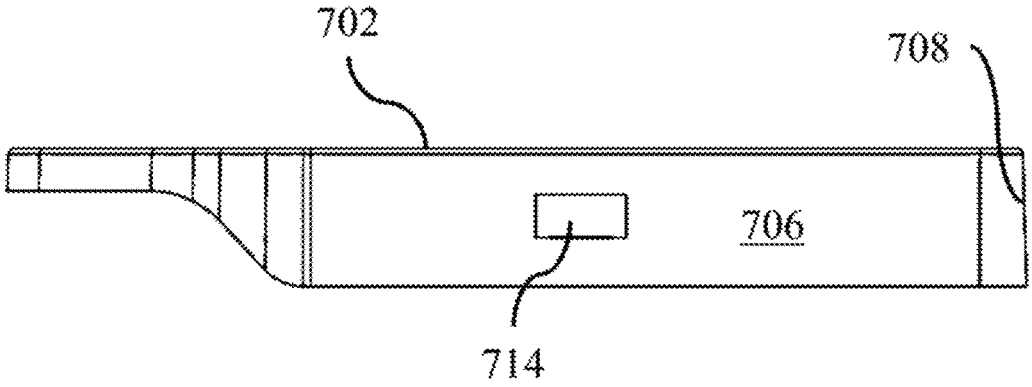
FIG. 22 and FIG. 23 depict a side view (FIG. 22) and a top view (FIG. 23) of the embodiments of the liner of FIG. 3.
Figure 23:
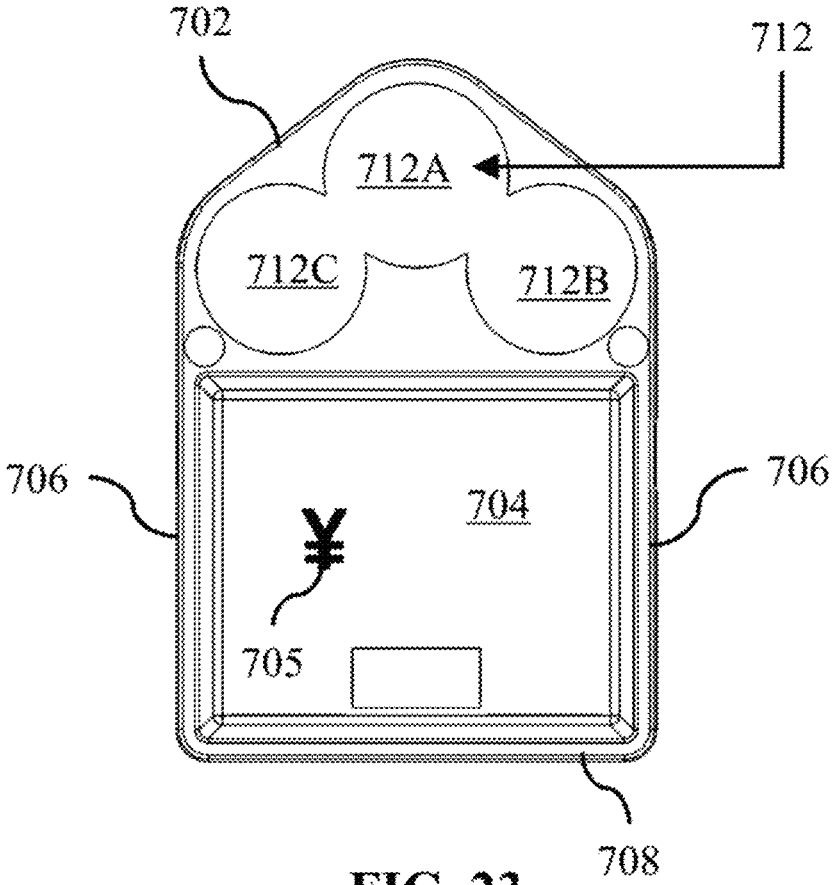

FIG. 22 and FIG. 23 depict a side view (FIG. 22) and a top view (FIG. 23) of the embodiments of the liner 702 of FIG. 3.

Referring to the embodiments as depicted in FIG. 22 and FIG. 23, the lateral liner side walls 706 of the liner 702 has a vertical height. The liner side opening 714 is positioned midway between the front and rear sections of the liner 702.

Figure 24:
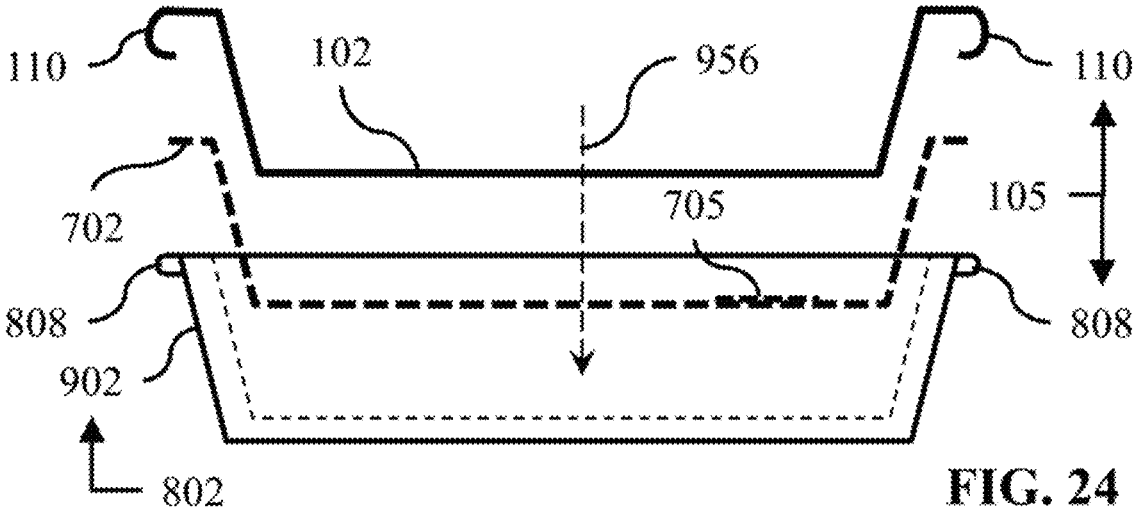
FIG. 24 to FIG. 26 depict side views of the embodiments of the cover assembly, the holder assembly, and the liner of FIG. 3.
Figure 25:
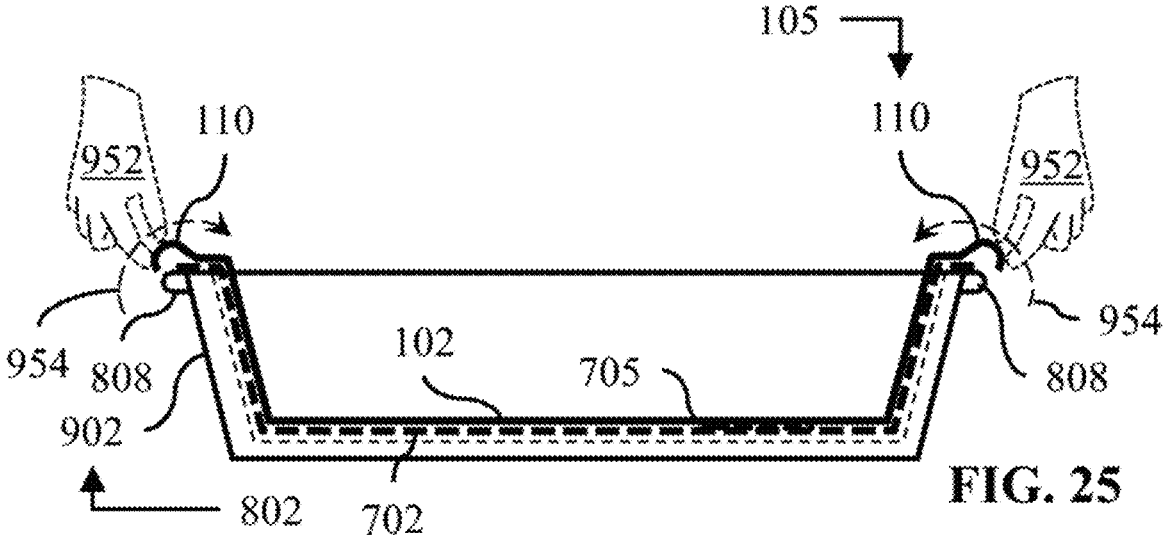
Figure 26:
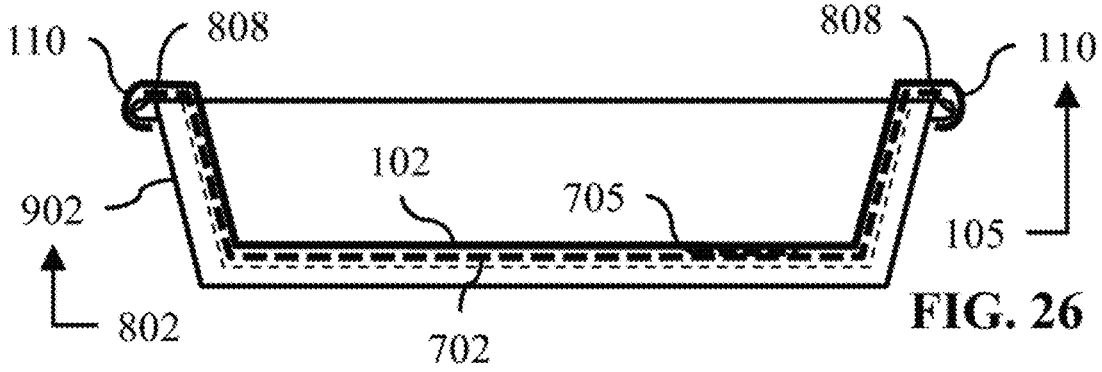

FIG. 24 to FIG. 26 depict side views of the embodiments of the cover assembly 102, the holder assembly 802, and the liner 702 of FIG. 3.

Referring to the embodiment as depicted in FIG. 24 (showing a side view), the food-service tray 902 provides depth with side walls extending from the outer periphery of the food-service tray 902. The cover assembly 102 is positioned above the liner 702 (having the liner image 705 thereon) in a spaced-apart relationship. The liner 702 is positioned above the food-service tray 902 in a spaced-apart relationship. Preferably, instances of the holder-engagement feature 808 are positioned or located on opposite lateral sides of the tray surface 904 (of the food-service tray 902). The holder-engagement feature 808 may include, for instance, a portion of the peripheral edge of the food-service tray 902. The holder-engagement feature 808 includes a mechanical feature (a geometric formation) positioned on the food-service tray 902. In accordance with an option, instances of the holder-engagement feature 808 are positioned on all of the opposite sides (outer peripheral sides) of the food-service tray 902. Preferably, the instances of the cover-engagement feature 110 of the cover assembly 102 are positioned or located on opposite sides of the cover assembly 102 with the cover surface 104 positioned (at least in part) between the instances of the cover-engagement feature 110.

In accordance with an option, it will be appreciated that the liner 702 and the cover assembly 102 are formed as an integral unit (fused as a single unit). In accordance with an option, it will be appreciated that the liner 702 and the holder assembly 802 are formed as an integral unit (fused as a single unit). In accordance with an option, it will be appreciated that the cover assembly 102 and the liner 702 and the holder assembly 802 are formed as an integral unit (fused as a single unit).

Referring to the embodiment as depicted in FIG. 25 (showing a side view), the liner 702 is positioned on (and/or covers, at least in part) the food-service tray 902, with the liner image 705 facing upwardly in such a way that the liner image 705 is visible. In this manner, the liner image 705, in use, provides visual enhancement of the food-service tray 902. The liner surface spans between (at least in part) the instances of the holder-engagement feature 808 of the food-service tray 902. The cover assembly 102 is positioned on (at least in part) and covers (at least in part) the liner 702, with the liner image 705 facing upwardly in such a way that the liner image 705 is visible (through the cover assembly 102, while the liner 702 is positioned on, and covers the food-service tray 902).

Preferably, the user 952 (which is not necessarily the user of the food-service tray 902) moves the cover-engagement feature 110 along the movement direction 954 in such a way that the cover-engagement feature 110 selectively engages (selectively securely engages or connects) with the holder-engagement feature 808 of the food-service tray 902. For instance, the cover-engagement feature 110 and the holder-engagement feature 808 are configured to be selectively snap fitted (snap connectable and selectively snap de-connectable) with each other.

Referring to the embodiment as depicted in FIG. 26 (showing a side view), the cover-engagement feature 110, in use, securely engages the holder-engagement feature 808.

Figure 27:
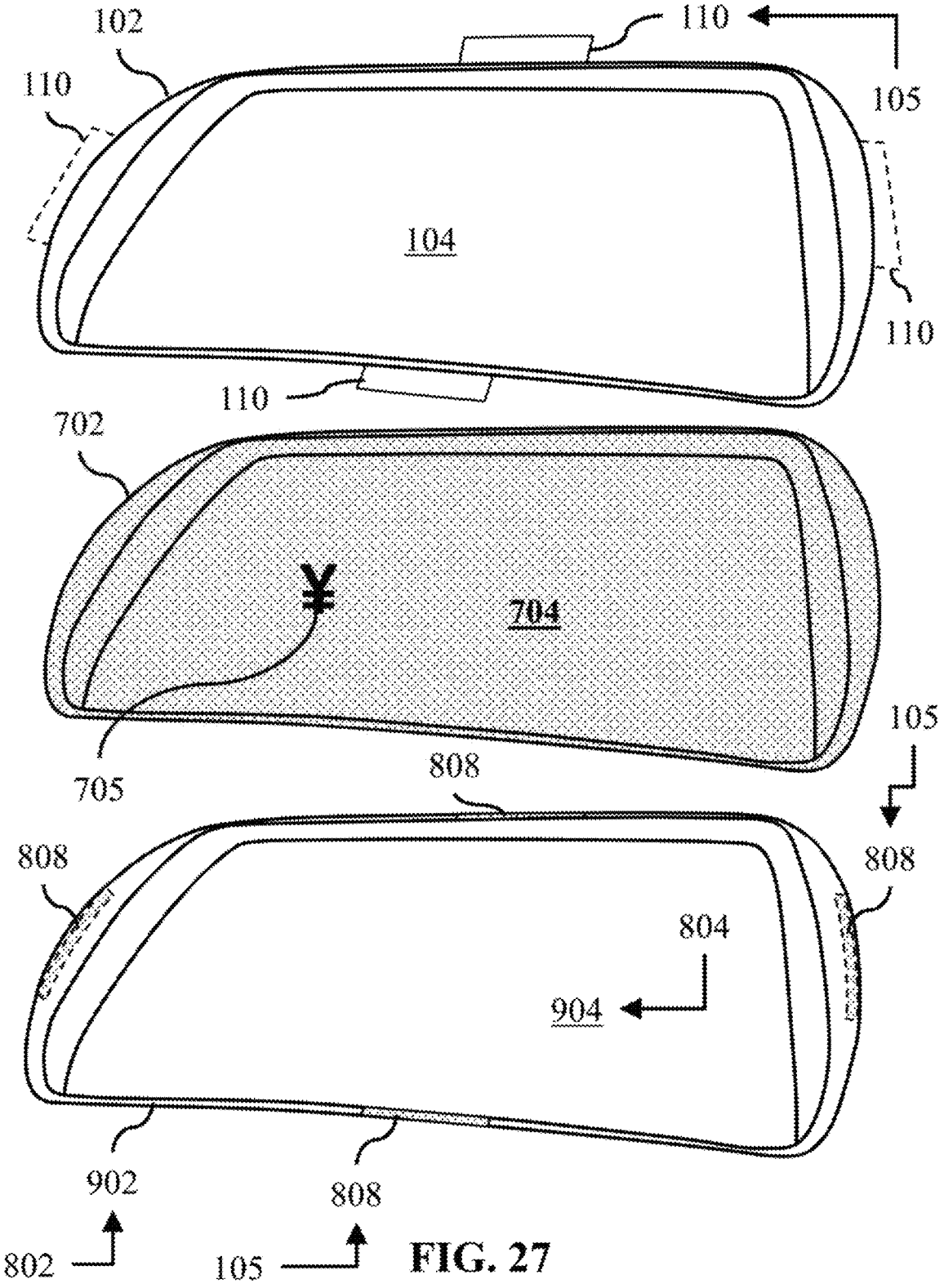
FIG. 27 depicts a perspective view of the embodiments of the cover assembly, the holder assembly, and the liner of FIG. 3.

FIG. 27 depicts a perspective view of the embodiments of the cover assembly 102, the holder assembly 802, and the liner 702 of FIG. 3.

Figure 28:
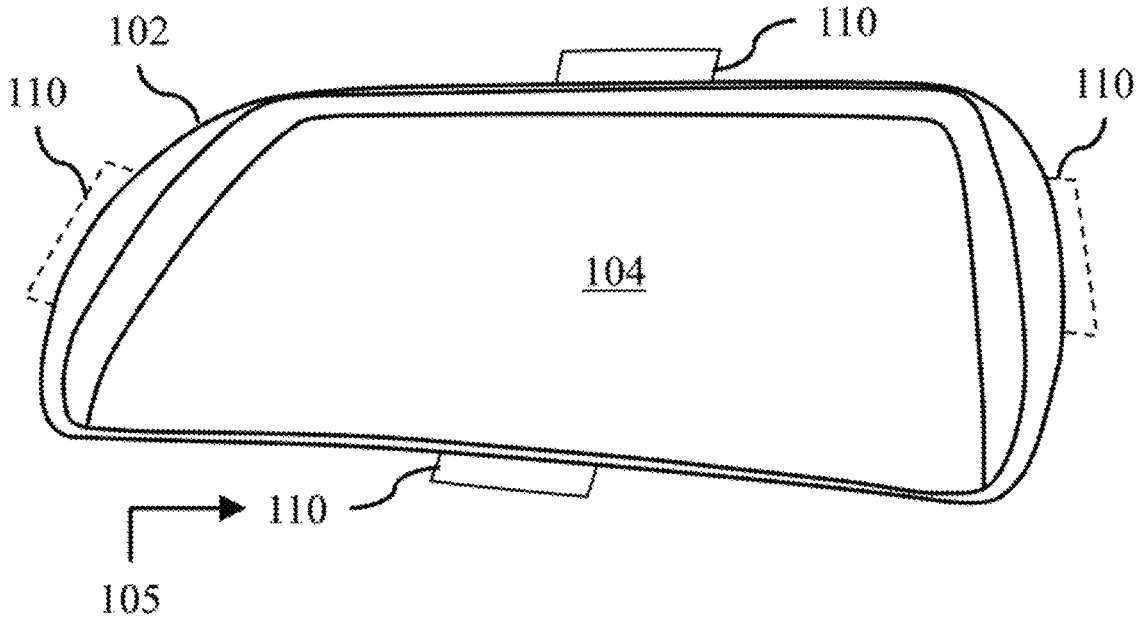
FIG. 28 depicts a perspective view of the embodiments of the cover assembly, the holder assembly, and the liner of FIG. 27.
Figure 28:
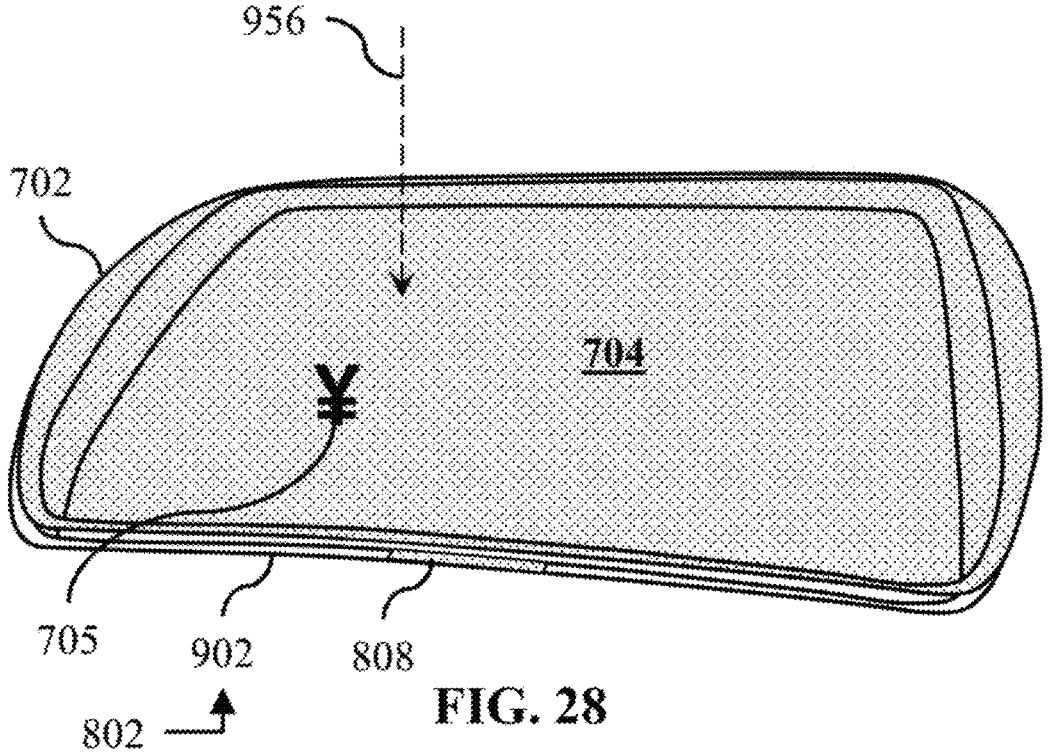

FIG. 28 depicts a perspective view of the embodiments of the cover assembly 102, the holder assembly 802, and the liner 702 of FIG. 27.

Figure 29:
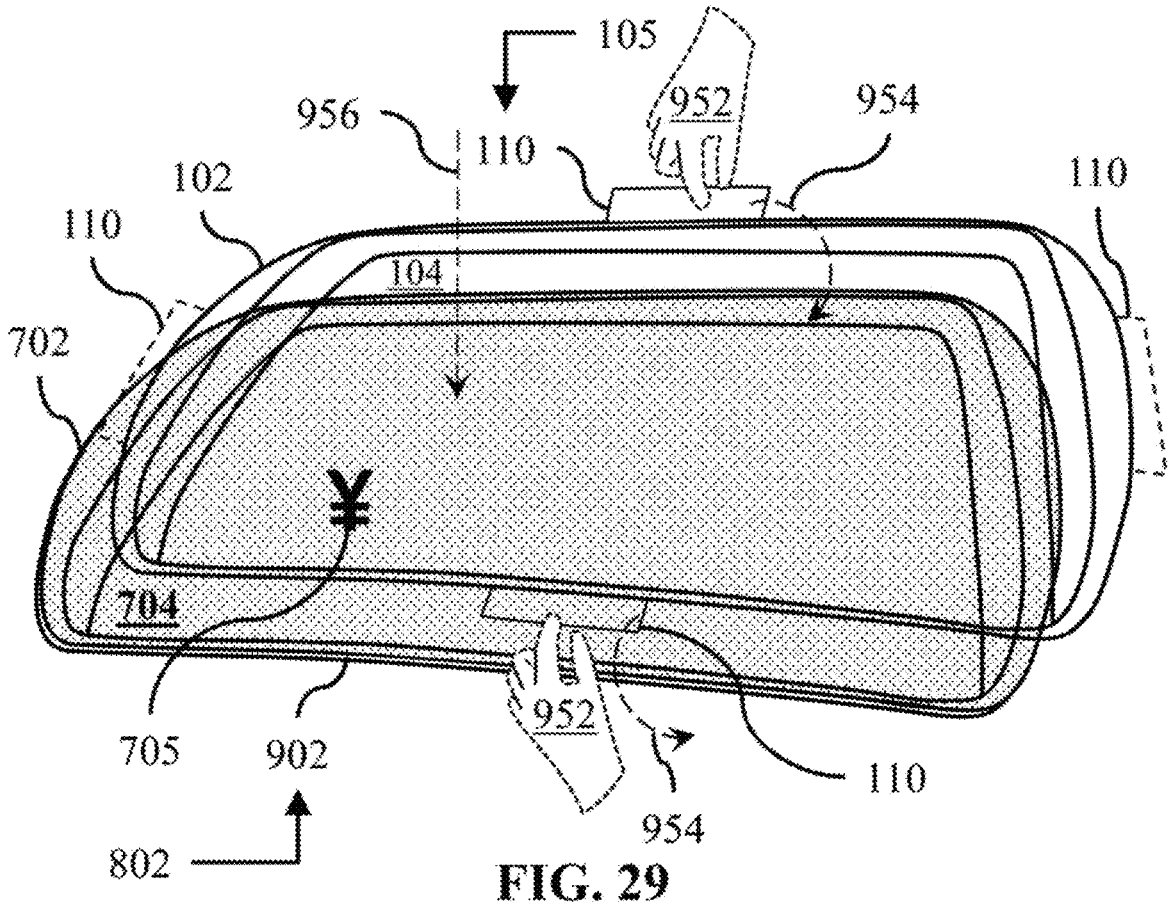
FIG. 29 and FIG. 30 depict perspective views of the embodiments of the cover assembly, the holder assembly, and the liner of FIG. 27.
Figure 30:
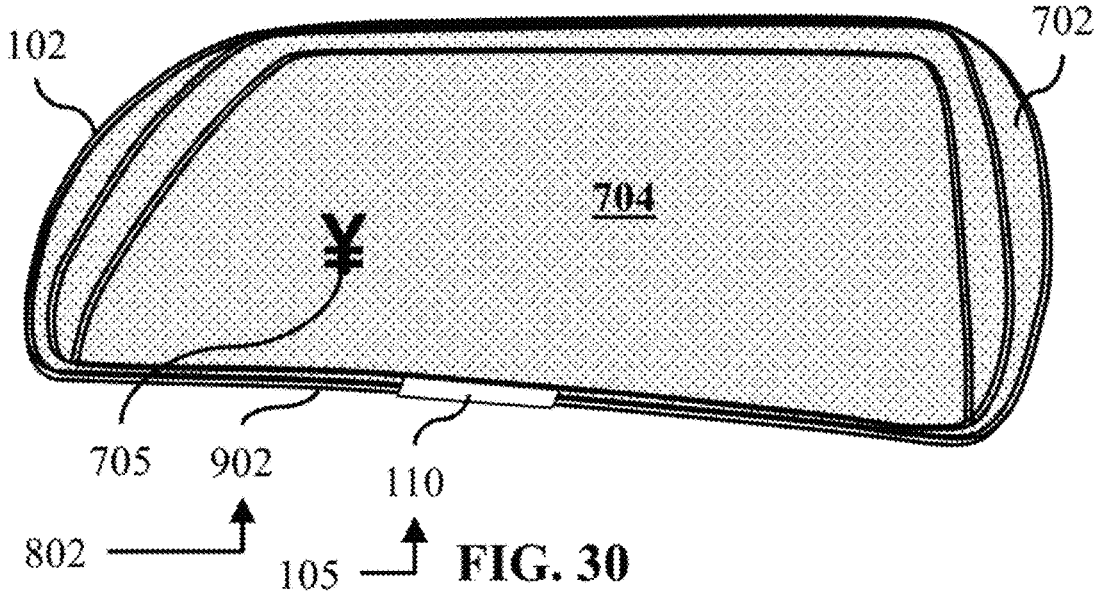

FIG. 29 and FIG. 30 depict perspective views of the embodiments of the cover assembly 102, the holder assembly 802, and the liner 702 of FIG. 27.

Referring to the embodiment as depicted in FIG. 27 (showing a top perspective view), the food-service tray 902 includes (and is not limited to) a food-service tray 902. The cover assembly 102 is positioned above the liner 702 (having the liner image 705 thereon) in a spaced-apart relationship. The liner 702 is positioned above the food-service tray 902 in a spaced-apart relationship.

Preferably, instances of the holder-engagement feature 808 are positioned or located on opposite lateral sides of the tray surface 904 (of the food-service tray 902). The holder-engagement feature 808 may include, for instance, a portion of the peripheral edge of the food-service tray 902. The holder-engagement feature 808 includes a mechanical feature (a geometric formation) positioned on the food-service tray 902. In accordance with an option, instances of the holder-engagement feature 808 are positioned on all of the opposite sides (outer peripheral sides) of the food-service tray 902. Preferably, the instances of the cover-engagement feature 110 of the cover assembly 102 are positioned or located on opposite sides of the cover assembly 102 with the cover surface 104 positioned (at least in part) between the instances of the cover-engagement feature 110.

In accordance with an option, it will be appreciated that the liner 702 and the cover assembly 102 are formed as an integral unit (fused as a single unit). In accordance with an option, it will be appreciated that the liner 702 and the holder assembly 802 are formed as an integral unit (fused as a single unit). In accordance with an option, it will be appreciated that the cover assembly 102 and the liner 702 and the holder assembly 802 are formed as an integral unit (fused as a single unit).

Referring to the embodiment as depicted in FIG. 28 (showing a top perspective view), the liner 702 is positioned on (and/or covers, at least in part) the food-service tray 902, with the liner image 705 facing upwardly in such a way that the liner image 705 is visible. In this manner, the liner image 705, in use, provides visual enhancement of the food-service tray 902. The cover assembly 102 is positioned over the liner 702 (in a spaced-apart relationship). The liner surface spans between (at least in part) the instances of the holder-engagement feature 808 of the food-service tray 902.

Referring to the embodiments as depicted in FIG. 29, (showing a top perspective view), the cover assembly 102 is partially positioned on (and partially covers) the liner 702, with the liner image 705 facing upwardly in such a way that the liner image 705 is visible through the cover assembly 102 (while the liner 702 is positioned on, and covers the food-service tray 902).

Preferably, the user 952 (which is not necessarily the user of the food-service tray 902) moves the cover-engagement feature 110 along the movement direction 954 in such a way that the cover-engagement feature 110 selectively engages (selectively securely engages or connects) with the holder-engagement feature 808 of the food-service tray 902. For instance, the cover-engagement feature 110 and the holder-engagement feature 808 are configured to be selectively snap fitted (selectively snap connectable and selectively snap de-connectable) with each other.

Referring to the embodiments as depicted in FIG. 30, (showing a top perspective view), the cover assembly 102 is positioned on (and/or covers, at least in part) the liner 702, with the liner image 705 facing upwardly in such a way that the liner image 705 is visible through the cover assembly 102 (while the liner 702 is positioned on, and covers the food-service tray 902). The cover assembly 102 is configured to cover (at least in part) the liner 702.

Figure 31:
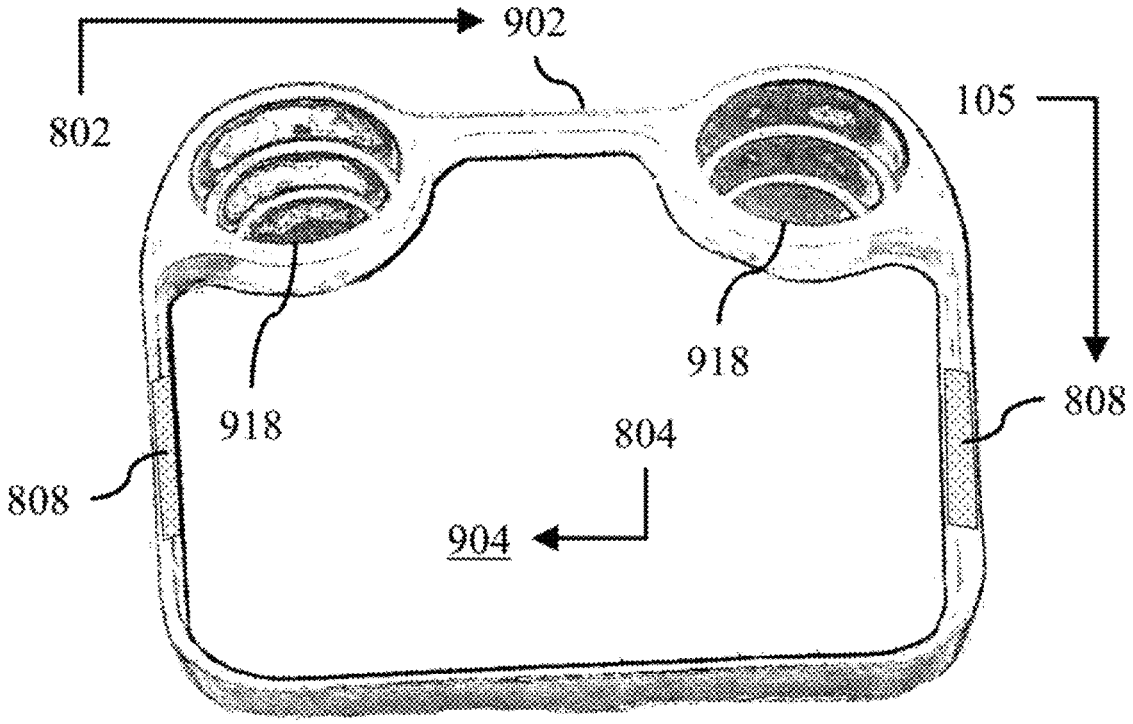
FIG. 31 and FIG. 32 depict a top perspective view (FIG. 31) and a side view (FIG. 32) of the embodiments of the holder assembly of FIG. 27.
Figure 32:
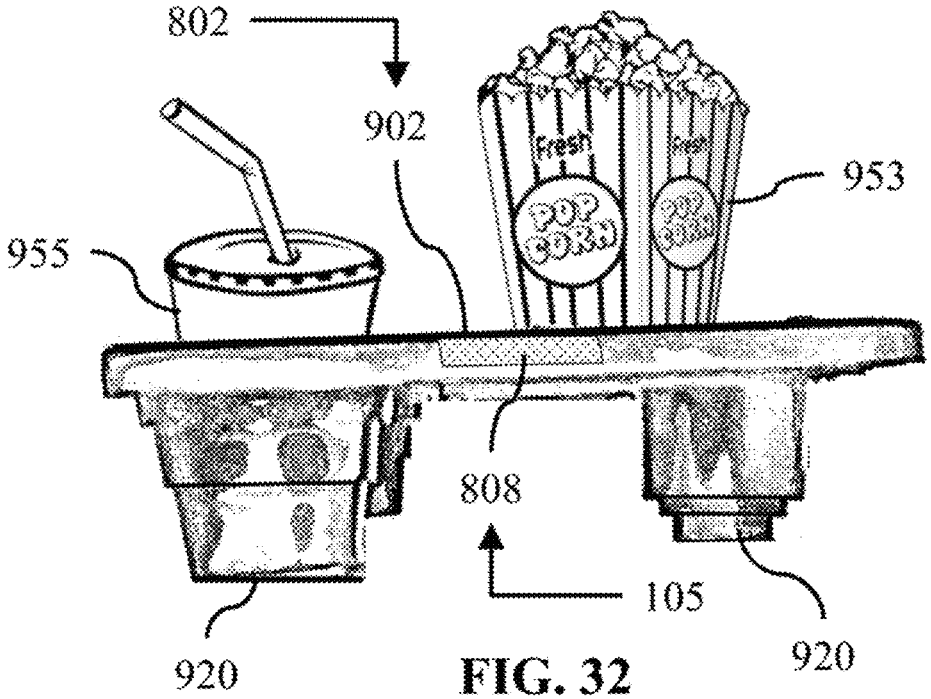

FIG. 31 and FIG. 32 depict a top perspective view (FIG. 31) and a side view or a side perspective view (FIG. 32) of the embodiments of the holder assembly 802 of FIG. 27.

Figure 33:
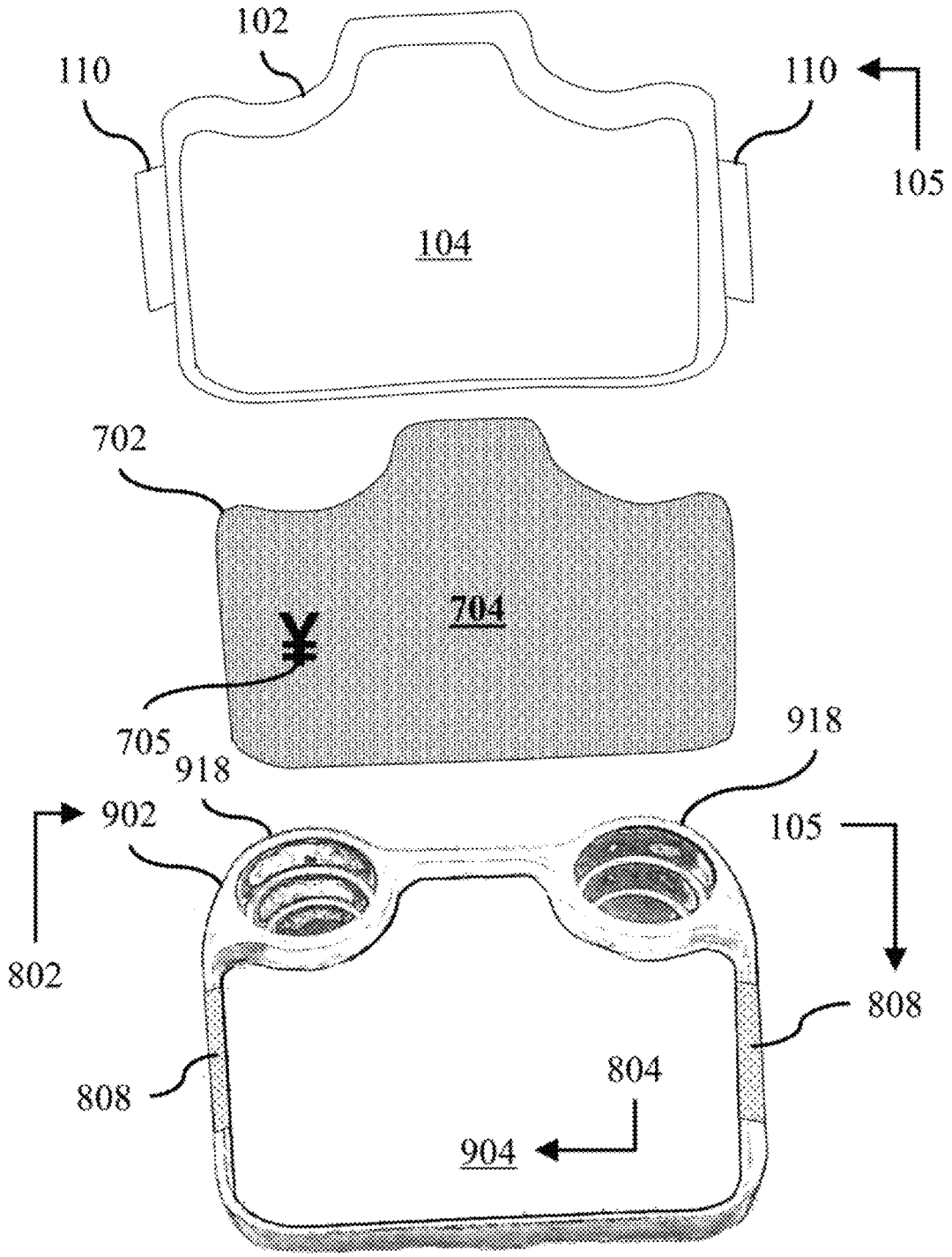
FIG. 33 depicts a top perspective view of the embodiments of the holder assembly of FIG. 3, and of the cover assembly of FIG. 3, and of the liner of FIG. 3.

FIG. 33 depicts a top perspective view of the embodiments of the holder assembly 802 of FIG. 3, and of the cover assembly 102 of FIG. 3, and of the liner 702 of FIG. 3.

Figure 34:
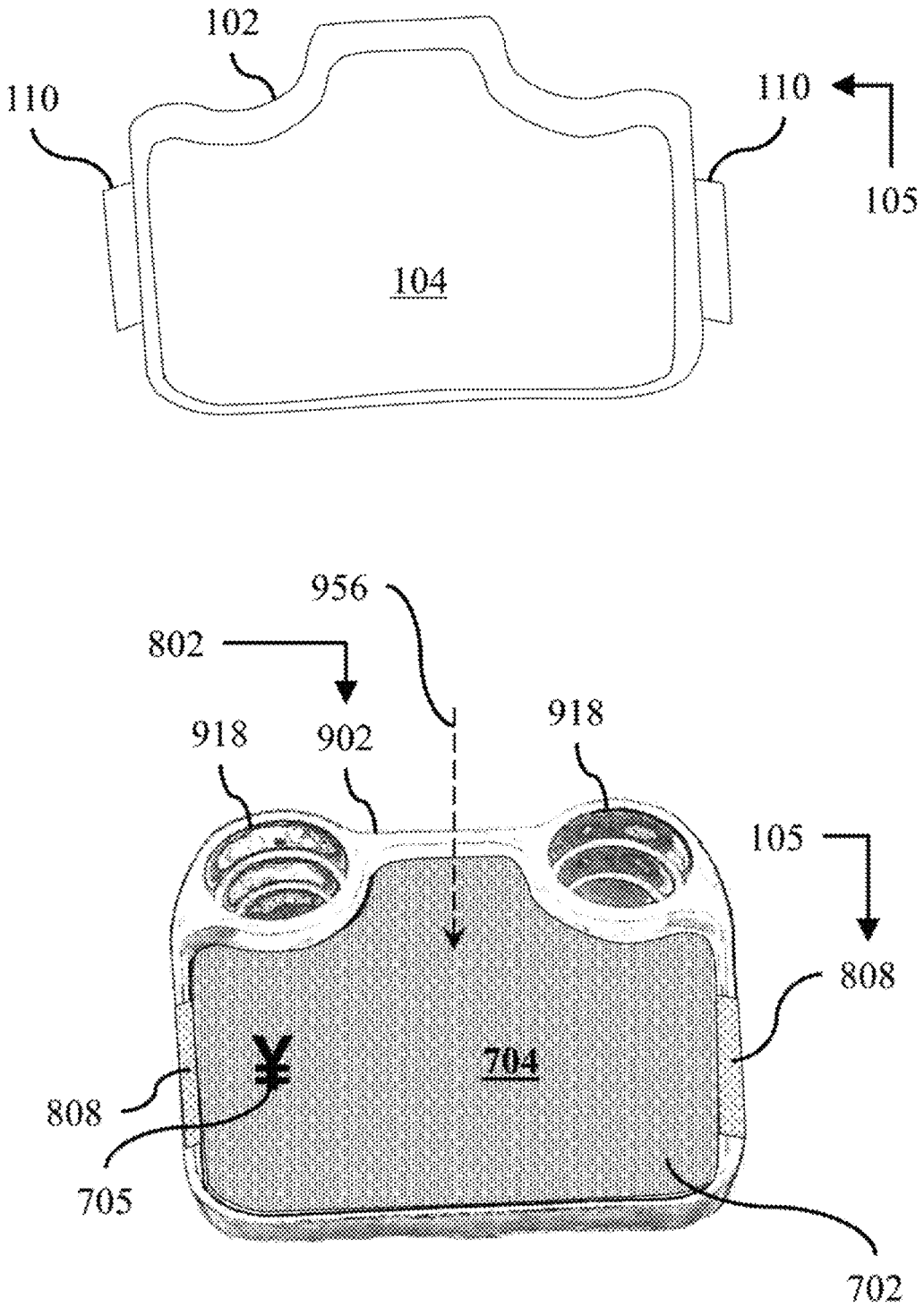
FIG. 34 depicts a top perspective view of the embodiments of the holder assembly, the cover assembly and the liner of FIG. 33.

FIG. 34 depicts a top perspective view of the embodiments of the holder assembly 802, the cover assembly 102 and the liner 702 of FIG. 33.

Figure 35:
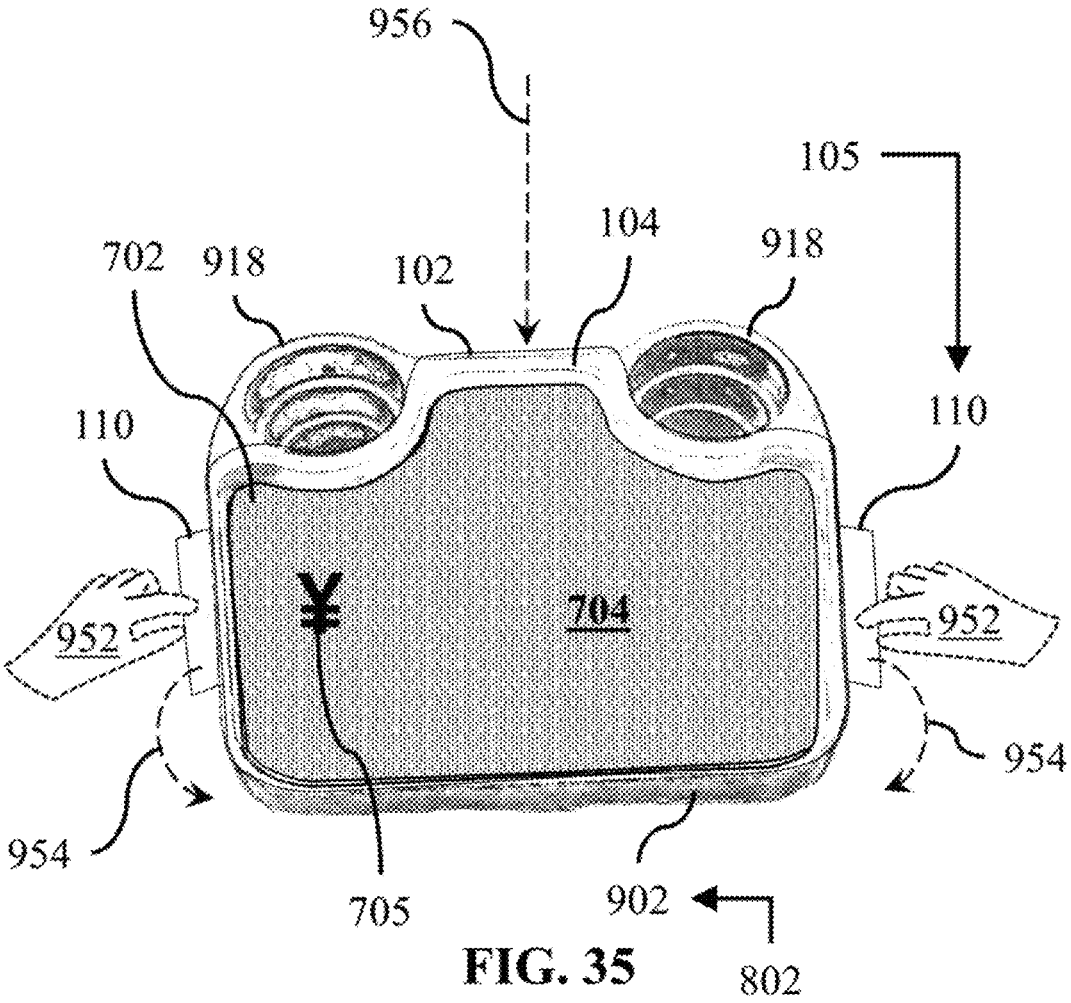
FIG. 35 depicts a top perspective view of the embodiments of the holder assembly, the cover assembly and the liner of FIG. 33.

FIG. 35 depicts a top perspective view of the embodiments of the holder assembly 802, the cover assembly 102 and the liner 702 of FIG. 33.

Referring to the embodiments as depicted in FIG. 31 and FIG. 31, the food-service tray 902 includes (and is not limited to) a food-service tray. The food-service tray 902 defines (provides) at least one or more instances of the drink holder 918, which may be positioned, for instance, on opposite sides of the food-service tray 902 (such as, at the front corner sections of the food-service tray 902).

Preferably, instances of the holder-engagement feature 808 are positioned or located on opposite lateral sides of the tray surface 904 (of the food-service tray 902). The holder-engagement feature 808 may include, for instance, a portion of the peripheral edge of the food-service tray 902. The holder-engagement feature 808 includes a mechanical feature (a geometric formation) positioned on the food-service tray 902.

Referring to the embodiments as depicted in FIG. 32, the food-service tray 902 further includes instances of the stand assembly 920 extending (depending) downwardly from the food-service tray 902. The food-service tray 902 is configured to receive and/or support at least one or more food items, such as the drink container 955 and/or the food item 953. The stand assembly 920 may be configured to receive, at least in part, a portion of at least one or more food items.

Referring to the embodiment as depicted in FIG. 33 (showing a top perspective view), the cover assembly 102 is positioned above the liner 702 (having the liner image 705 thereon) in a spaced-apart relationship. The liner 702 is positioned above the food-service tray 902 in a spaced-apart relationship. Instances of the cover-engagement feature 110 of the cover assembly 102 are positioned or located on opposite sides of the cover assembly 102 with the cover surface 104 positioned (at least in part) between the instances of the cover-engagement feature 110. The liner 702 is configured to surround (at least in part) the drink holder 918. The liner 702 is configured to cover (at least in part) the food-service tray 902.

In accordance with an option, it will be appreciated that the liner 702 and the cover assembly 102 are formed as an integral unit (fused as a single unit). In accordance with an option, it will be appreciated that the liner 702 and the holder assembly 802 are formed as an integral unit (fused as a single unit). In accordance with an option, it will be appreciated that the cover assembly 102 and the liner 702 and the holder assembly 802 are formed as an integral unit (fused as a single unit).

Referring to the embodiment as depicted in FIG. 34 (showing a top perspective view), the liner 702 is positioned on (and/or covers, at least in part) the food-service tray 902, with the liner image 705 facing upwardly so that the liner image 705 (in such a way that the liner image 705) is visible. In this manner, the liner image 705, in use, provides visual enhancement of the food-service tray 902. The cover assembly 102 is positioned over the liner 702 (in a spaced-apart relationship). The liner surface 704 spans between (at least in part) the instances of the holder-engagement feature 808 of the food-service tray 902.

Referring to the embodiment as depicted in FIG. 35 (showing a top perspective view), the cover assembly 102 is positioned on (and/or covers, at least in part) the liner 702, with the liner image 705 facing upwardly in such a way that the liner image 705 is visible through the cover assembly 102 (while the liner 702 is positioned on, and covers the food-service tray 902). The cover assembly 102 is configured to cover (at least in part) the liner 702 (thus protecting, at least in part, the liner 702).

Preferably, the user 952 (which is not necessarily the user of the food-service tray 902) moves the cover-engagement feature 110 along the movement direction 954 in such a way that the cover-engagement feature 110 selectively engages (selectively securely engages or connects) with the holder-engagement feature 808 of the food-service tray 902. For instance, the cover-engagement feature 110 and the holder-engagement feature 808 are configured to be selectively snap fitted (snap connectable and snap de-connectable) with each other.

Figure 36:
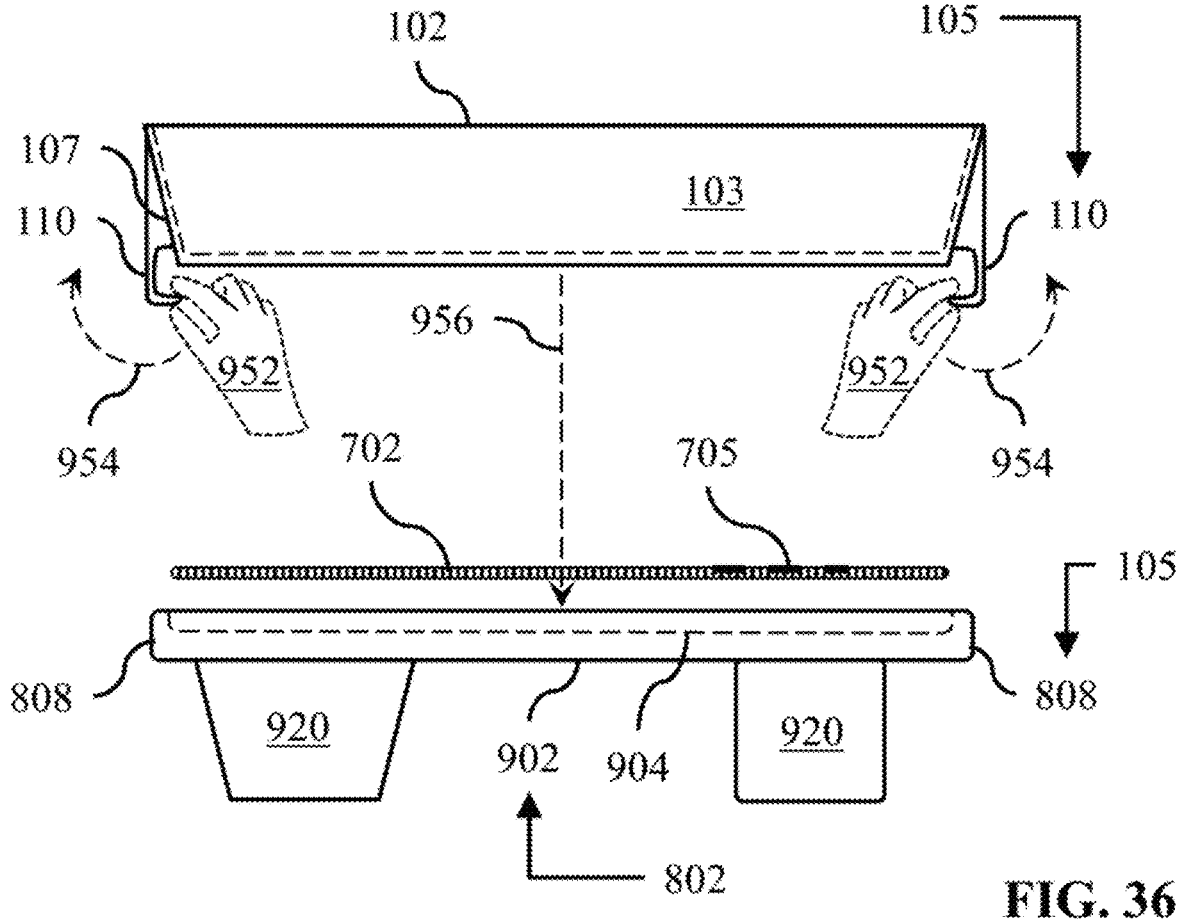
FIG. 36 and FIG. 37 depict side views of the embodiments of the cover assembly, the holder assembly, and the liner of FIG. 3.
Figure 37:
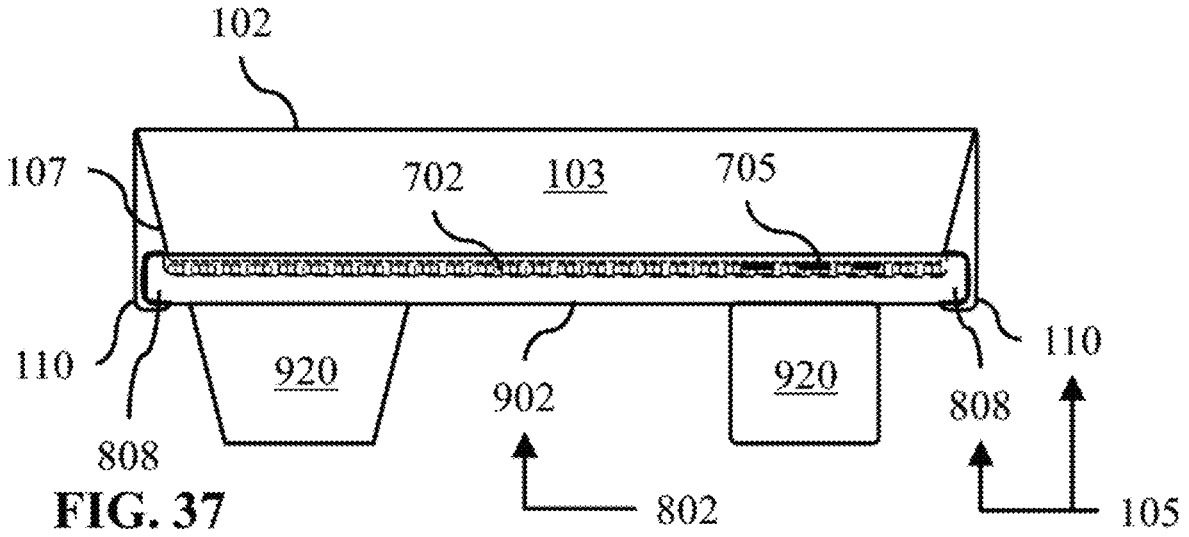

FIG. 36 and FIG. 37 depict side views of the embodiments of the cover assembly 102, the holder assembly 802, and the liner 702 of FIG. 3.

Referring to the embodiment as depicted in FIG. 36, the cover assembly 102 includes the cover-engagement feature 110. The cover assembly 102 includes an interior zone 103 configured to receive an item therein. The cover assembly 102 includes an upstanding wall 107 surrounding (at least in part) the interior zone 103. The tray surface 904 is recessed, at least in part, into the interior of the food-service tray 902. The liner 702 is received (at least in part) on the tray surface 904, with the liner image 705 of the liner 702 facing upwardly (once the tray surface 904 is received in the interior of the food-service tray 902).

In accordance with a preferred embodiment, the food-service tray 902 includes a stand assembly 920.

The liner 702 is configured to be positioned between the cover assembly 102 and the food-service tray 902. The liner 702 is configured to be movable along the positioning direction 956 toward the tray surface 904. The cover assembly 102 is configured to be movable along the positioning direction 956 toward the tray surface 904 (with the liner 702 positioned between the cover assembly 102 and the food-service tray 902).

The cover-engagement feature 110 is configured to be selectively connectable to (at least in part) a portion of the peripheral edge of the food-service tray 902. More specifically, the holder-engagement feature 808 includes a portion of the peripheral edge of the food-service tray 902. Preferably, the cover-engagement feature 110 is configured to selectively snap fit with a portion of the peripheral edge of the food-service tray 902. More preferably, the cover-engagement feature 110 and the cover assembly 102, in combination, form a C-shaped section configured to selectively snap fit with a portion of the peripheral edge of the food-service tray 902. Even more preferably, the cover-engagement feature 110 and the cover assembly 102, in combination, form a C-shaped section configured to selectively snap fit with the holder-engagement feature 808, which includes a portion of the peripheral edge of the food-service tray 902.

The user 952 grabs (grips) the cover-engagement feature 110, and moves the cover-engagement feature 110 along the movement direction 954 (this is done in such a way that the cover-engagement feature 110 may contact the underside of the food-service tray 902 once the cover assembly 102 is positioned proximate (adjacent) to the tray surface 904, as depicted in FIG. 37).

In accordance with an option, it will be appreciated that the liner 702 and the cover assembly 102 are formed as an integral unit (fused as a single unit). In accordance with an option, it will be appreciated that the liner 702 and the holder assembly 802 are formed as an integral unit (fused as a single unit). In accordance with an option, it will be appreciated that the cover assembly 102 and the liner 702 and the holder assembly 802 are formed as an integral unit (fused as a single unit).

Referring to the embodiments as depicted in FIG. 36 and FIG. 37, the cover-engagement feature 110, in use, selectively securely engages and/or contacts (at least in part) the underside of the food-service tray 902. The liner image 705, in use, improves the visual appeal (enhancement) of the food-service tray 902 for the user of the food-service tray 902 (to improve their mood, enjoyment, appreciation, etc.). The liner 702 may be selectively changed as needed in order the change the visual enhancement of the food-service tray 902 (as may be needed from time to time).

Figures 38, 39:
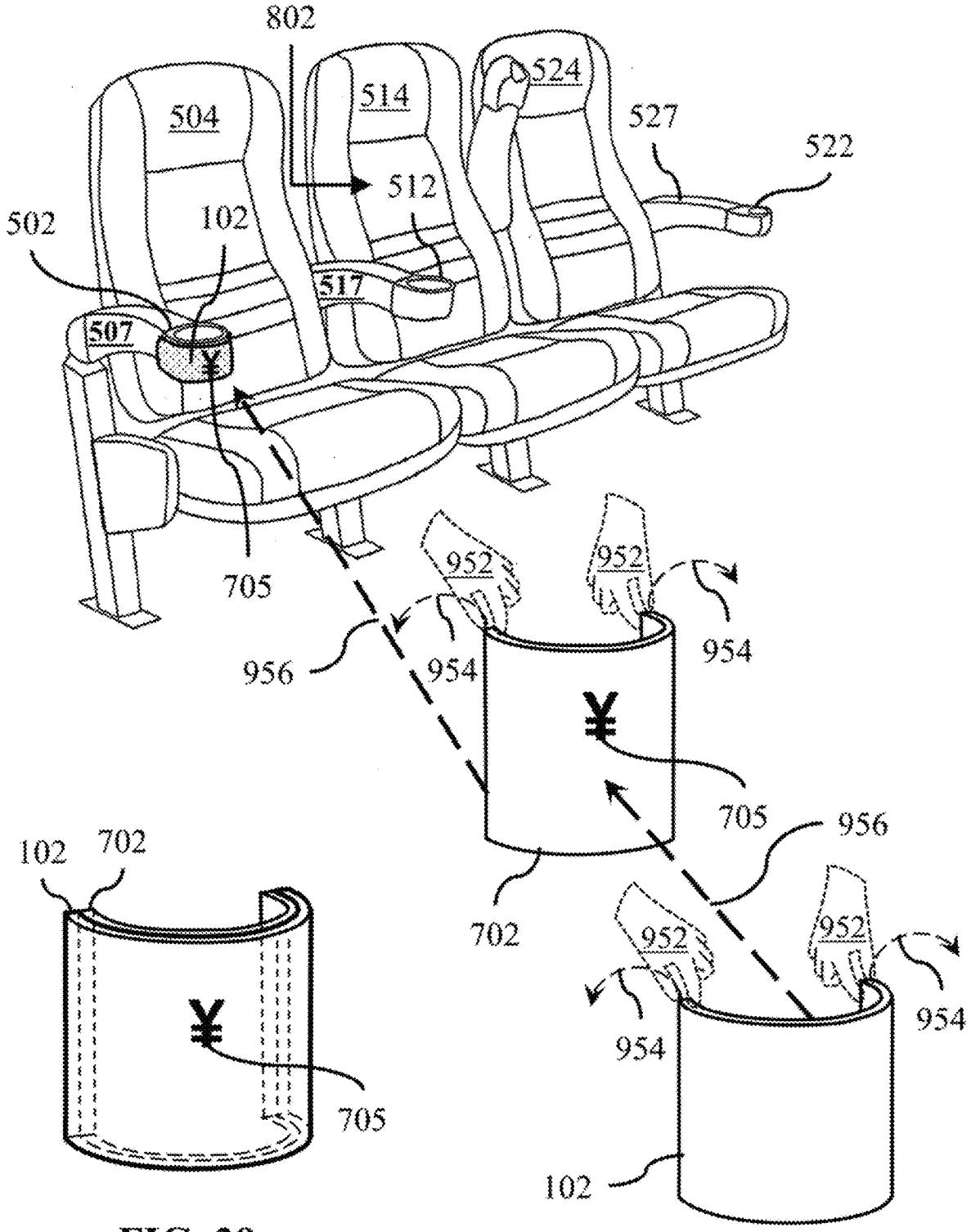
FIG. 38 and FIG. 39 depict perspective views of the embodiments of the cover assembly, the holder assembly, and the liner of FIG. 3.

FIG. 38 and FIG. 39 depict perspective views of the embodiments of the cover assembly 102, the holder assembly 802, and the liner 702 of FIG. 3.

Figure 40:
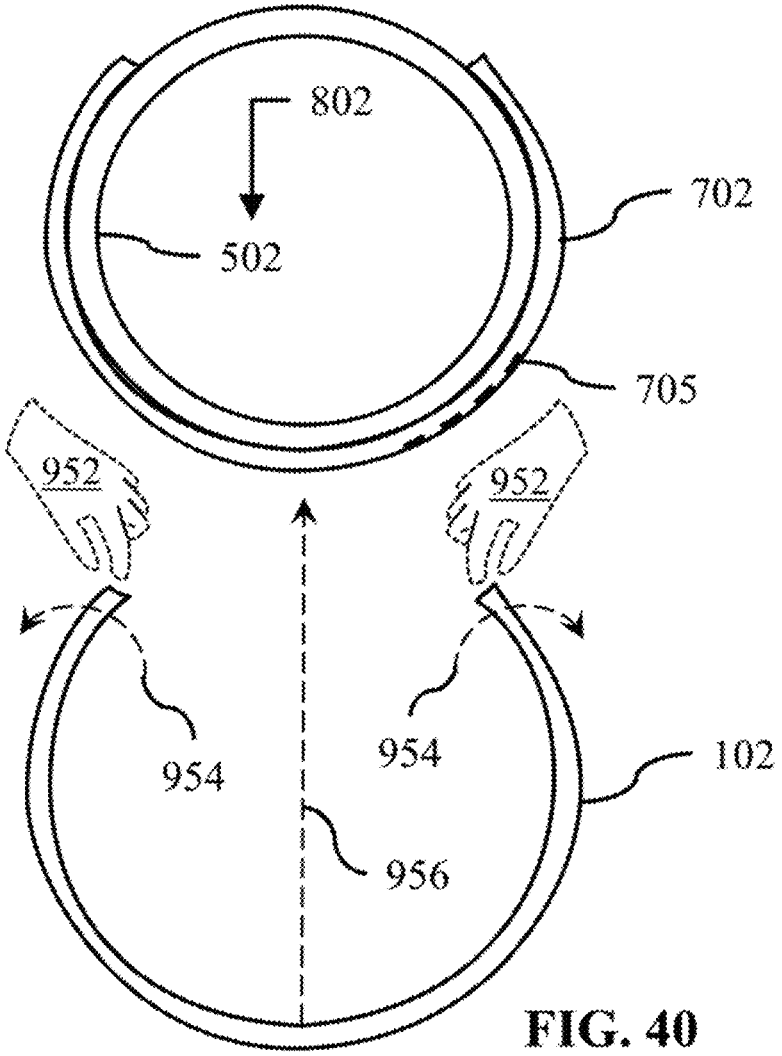
FIG. 40 and FIG. 41 depict top views of the cover assembly, the holder assembly, and the liner of FIG. 38.
Figure 41:
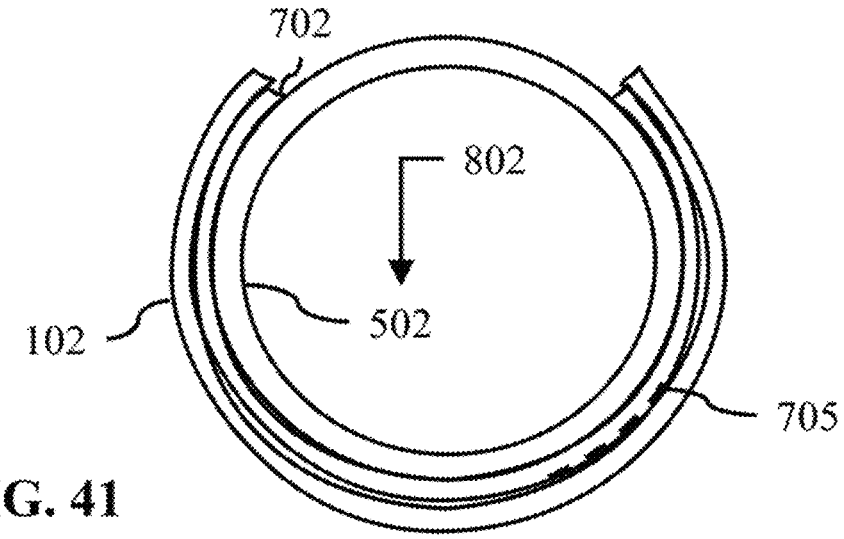

FIG. 40 and FIG. 41 depict top views of the cover assembly 102, the holder assembly 802, and the liner 702 of FIG. 38.

Figure 42:
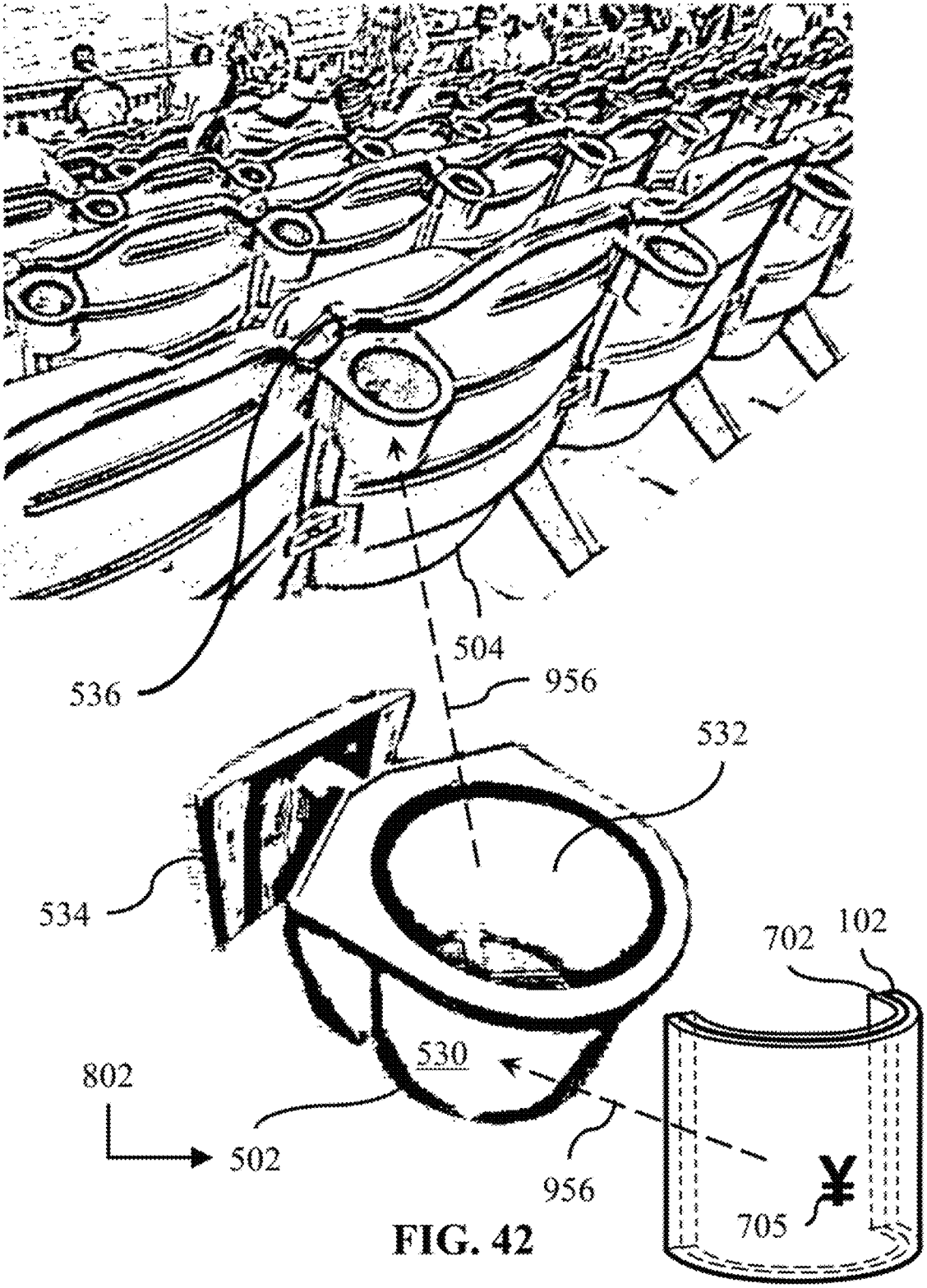
FIG. 42 depicts a perspective view of the embodiments of the cover assembly, the holder assembly, and the liner of FIG. 3.

FIG. 42 depicts a perspective view of the embodiments of the cover assembly 102, the holder assembly 802, and the liner 702 of FIG. 3.

Referring to the embodiments as depicted in FIG. 38 and FIG. 39, a first seating system 504 includes a first chair arm 507 with a first drink hole feature 502 formed on (provided by) the first chair arm 507. A second seating system 514 includes a second chair arm 517 with a second drink hole feature 512 formed on (provided by) the second chair arm 517. A third seating system 524 includes a third chair arm 527 with a third drink hole feature 522 formed on (provided by) the third chair arm 527. The first seating system 504, the second seating system 514, and the third seating system 524 are, for instance, seating systems configured to be installed in a movie theater, a sports arena, an entertainment center, any other kind, and any equivalent thereof.

The first drink hole feature 502 includes a curved outer surface (an outer facing surface). Preferably, the first drink hole feature 502 is configured to receive and support a food item, such as a drink container (known and not depicted).

The liner 702 is configured to conform (at least in part) to the curved outer surface of the first drink hole feature 502. Preferably, the liner 702 includes a flexible material (a flexible plastic material and/or a paper material, etc.) that has a normally (unbiased shape) flat surface (flat shape). Alternatively, the cover assembly 102 includes a flexible material (a flexible plastic material) that has a normally (biased shape) flat surface (or a biased curved shape if desired). Preferably, the liner 702 is configured to be selectively snap fitted to (selectively coupled with) the outer surface of the first drink hole feature 502. Alternatively, the liner 702 is fitted (at least in part) to the outer surface of the first drink hole feature 502. The liner image 705 is printed (formed on) the outer surface of the liner 702. Once the liner 702 is positioned over the curved outer surface of the first drink hole feature 502, the liner image 705, in use, faces outwardly (away from the first drink hole feature 502).

The cover assembly 102 is configured to conform (at least in part) to the curved outer surface of the first drink hole feature 502 (that is, once or after the liner 702 is placed onto the first drink hole feature 502). For instance, the cover assembly 102 includes a flexible material (a flexible plastic material) that has a normally (unbiased shape) flat surface. Alternatively, the cover assembly 102 includes a flexible material (a flexible plastic material) that has a normally (biased shape) flat surface (or a curved shape if so desired). The cover assembly 102 includes a light-transmissive material configured to permit (at least in part) transmission of light through the cover assembly 102. Preferably, the cover assembly 102 is configured to be selectively snap fitted to the outer surface of the first drink hole feature 502. Alternatively, the cover assembly 102 is configured to be fitted to the outer surface of the first drink hole feature 502. Once the cover assembly 102 is positioned over the liner 702 (which is placed over the first drink hole feature 502), the liner image 705, in use, is visually exposed (since the liner image 705 faces outwardly away from the first drink hole feature 502). In this manner, the liner image 705 (in use) is visually detectable by patrons and/or users (such as the user of the first seating system 504, such as when the user is moving toward the first seating system 504, etc.).

The user 952 (not the user of the first seating system 504) may grab or grip the edges of the liner 702, and move the edges of the liner 702, and then position (locate) the liner 702 against the curved outer surface of the first drink hole feature 502.

Preferably, the cover assembly 102 is configured to be selectively snap fitted to the first drink hole feature 502, with the liner 702 captured between the inner surface of the cover assembly 102 and the outer surface of the first drink hole feature 502.

In accordance with an option, it will be appreciated that the liner 702 and the cover assembly 102 are formed as an integral unit (fused as a single unit). In accordance with an option, it will be appreciated that the liner 702 and the holder assembly 802 are formed as an integral unit (fused as a single unit). In accordance with an option, it will be appreciated that the cover assembly 102 and the liner 702 and the holder assembly 802 are formed as an integral unit (fused as a single unit).

Referring to the embodiment as depicted in FIG. 40, the liner 702 is configured to be positioned (located) over the outer surface of the first drink hole feature 502. The liner image 705, in use, faces outwardly away from the outer surface of the first drink hole feature 502 (once or after the liner 702 is positioned over the outer surface of the first drink hole feature 502). The liner 702 may include a flexible, normally flat piece of resilient plastic material, any other kind, and any equivalent thereof.

In accordance with an embodiment, the cover assembly 102 is configured to have a resilient-shaped body (such as a C-shaped body) made of a resilient (flexible) plastic material, any other kind, and any equivalent thereof. The user 952, in use, grabs (grips) the opposite edges of the cover assembly 102 and moves the opposite edges along the movement direction 954 (this is done in such a way that the cover assembly 102 becomes splayed apart). Once the cover assembly 102 is splayed apart, the cover assembly 102 is fitted over the liner 702 (which is positioned on the outer surface of the first drink hole feature 502).

It will be appreciated that in accordance with an option (and would be easily understood by persons of skill in the art), the cover assembly 102 includes the cover-engagement feature 110 (not depicted in FIG. 40, and depicted in other FIGS.), and the first drink hole feature 502 includes the holder-engagement feature 808 (not depicted in FIG. 40, and depicted in other FIGS.). In this manner, the cover assembly 102 and the first drink hole feature 502 may be securely coupled to each other by way of utilization of the cover-engagement feature 110 and the holder-engagement feature 808 (both of which are not depicted in FIG. 40, and are depicted in other FIGS.).

Referring to the embodiment as depicted in FIG. 41, the liner 702 is positioned between the cover assembly 102 and the first drink hole feature 502, with the liner image 705 facing outwardly. The cover assembly 102 includes (at least in part) a light-transmissive material (a translucent material or a transparent material). The user of the first drink hole feature 502 (or other patrons) may receive visual enhancement or enjoyment of the first drink hole feature 502, and/or with an event being held at a movie theater and/or a sporting arena, any other kind, and any equivalent thereof.

Referring to the embodiment as depicted in FIG. 42, the first drink hole feature 502 is configured to be mounted to the rear portion of the first seating system 504. For instance, the first drink hole feature 502 includes a cup holder 530 defining an interior holder zone 532. An interface structure 534 extends from the cup holder 530. The first seating system 504 includes a complementary interface structure 536 configured to securely connect (mate) with the interface structure 534 of the cup holder 530.

Figure 43:
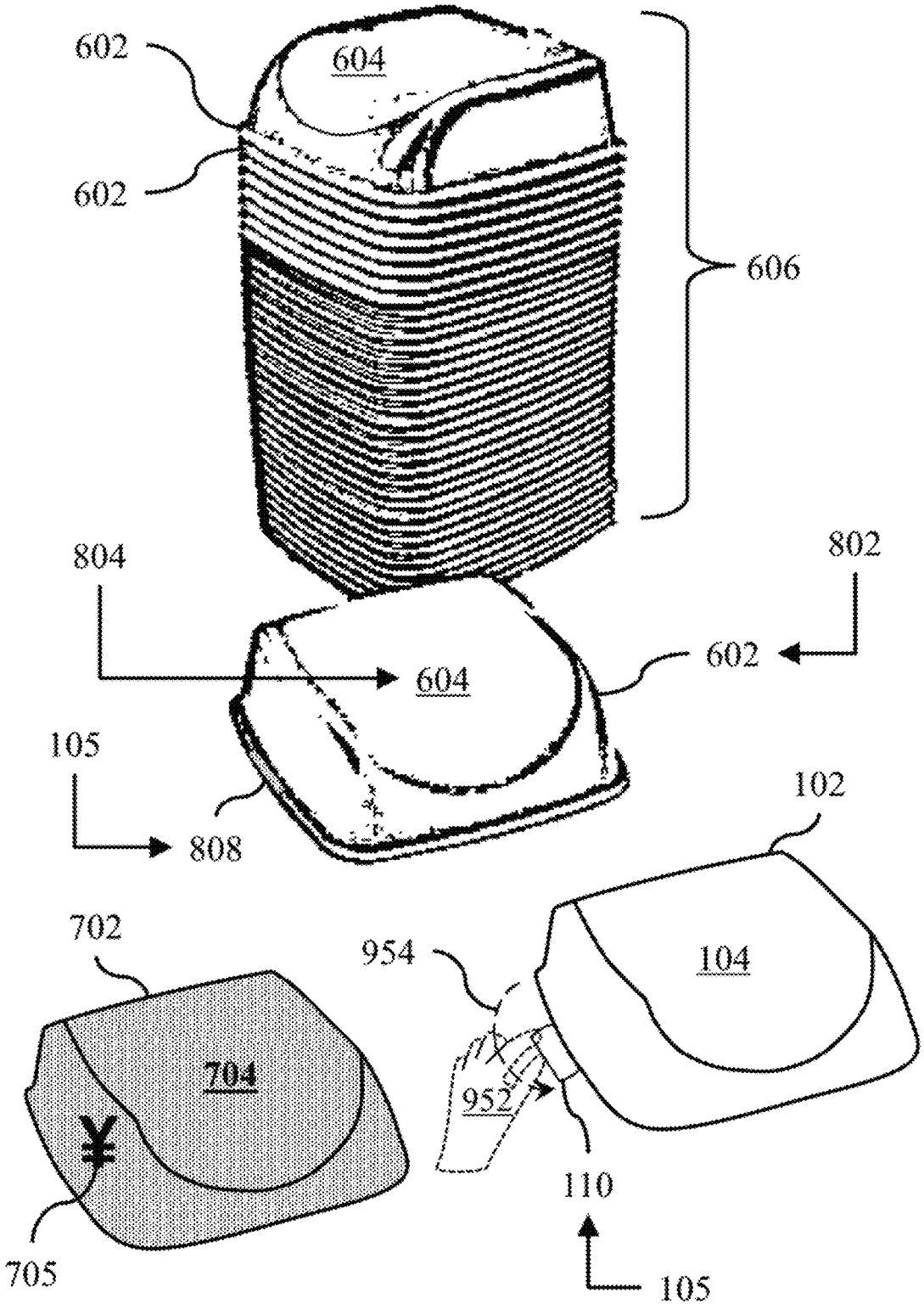
FIG. 43 depicts a perspective view of the embodiments of the cover assembly, the holder assembly, and the liner of FIG. 3.

FIG. 43 depicts a perspective view of the embodiments of the cover assembly 102, the holder assembly 802, and the liner 702 of FIG. 3.

Figure 44:
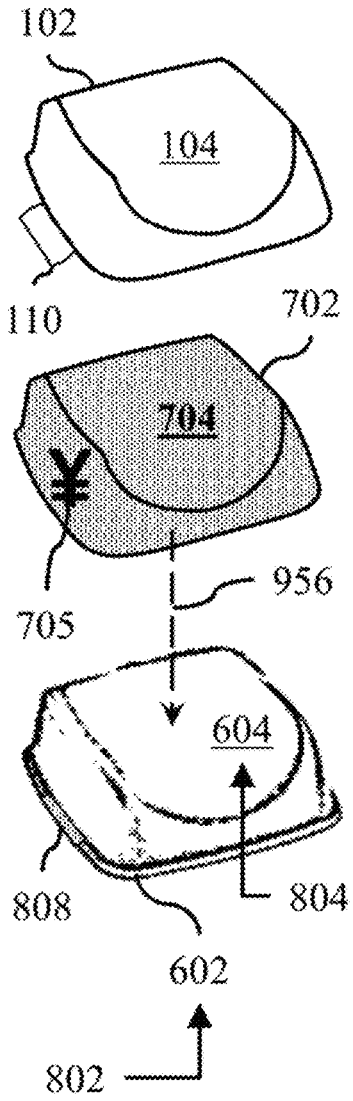
FIG. 44 to FIG. 46 depict perspective views of the embodiments of the cover assembly, the holder assembly, and the liner of FIG. 43.
Figure 45:
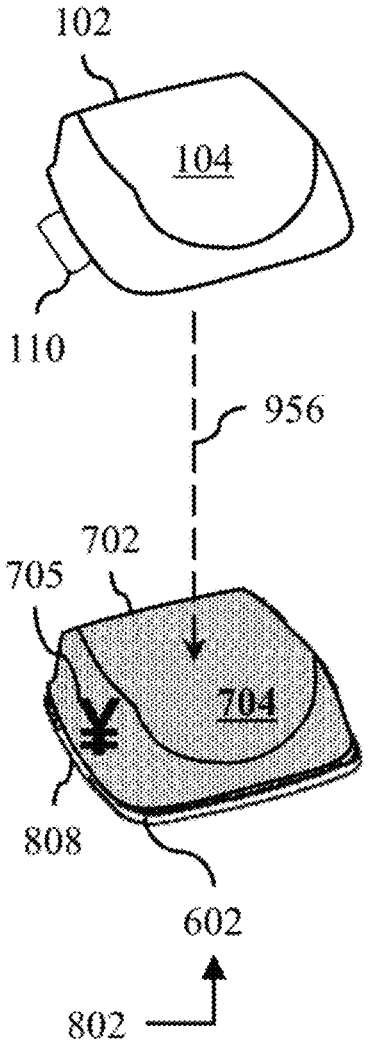
Figure 46:
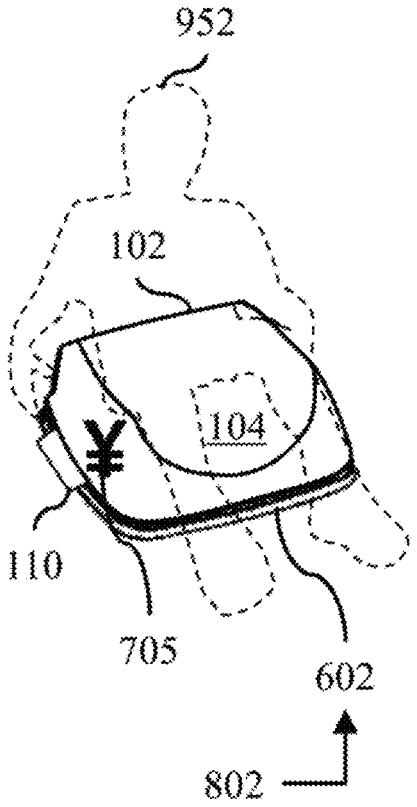

FIG. 44 to FIG. 46 depict perspective views of the embodiments of the cover assembly 102, the holder assembly 802, and the liner 702 of FIG. 43.

Referring to the embodiment as depicted in FIG. 43, the apparatus is adapted such that the holder assembly 802 includes a booster seat assembly 602 (such as a child booster seat), and the holder surface 804 includes a booster-seat surface 604 provided by the booster seat assembly 602.

In accordance with an option, it will be appreciated that the liner 702 and the cover assembly 102 are formed as an integral unit (fused as a single unit). In accordance with an option, it will be appreciated that the liner 702 and the holder assembly 802 are formed as an integral unit (fused as a single unit). In accordance with an option, it will be appreciated that the cover assembly 102 and the liner 702 and the holder assembly 802 are formed as an integral unit (fused as a single unit).

Referring to the embodiment as depicted in FIG. 43, the booster seat assembly 602 is configured to be stackable and/or nestable (one vertically positioned over the other in a nested relationship), or positioned in a stacked formation 606 (in order to reduce storage space, for relatively easier transportation, etc.). The booster seat assembly 602 is (includes) an extra seat and/or a cushion. The booster seat assembly 602 is configured to be positioned or placed on an existing seat (such as a movie theater seat, etc.). The booster seat assembly 602 may be, for instance, configured for a small child (or a relatively smaller person) to sit thereon. In accordance with a preferred embodiment, the booster seat assembly 602 is configured for use in a theatre, an arena and/or an auditorium, etc., any other kind, and any equivalent thereof. The booster seat assembly 602 includes a contoured seating surface for a comfortable seating experience. The booster seat assembly 602 has a seating surface that may accommodate a variety of child sizes. The booster seat assembly 602 is constructed of a plastic material with rounded corners.

The booster seat assembly 602 includes the holder-engagement feature 808, in which (preferably) the holder-engagement feature 808 is positioned on opposite sides of the booster seat assembly 602. The holder-engagement feature 808 is, preferably, located on an outer rim portion (or a peripheral edge portion) of the booster seat assembly 602.

The liner 702 is configured to be positioned on (received on) an outer surface of the booster seat assembly 602 (this is done in such a way that the liner surface 704 is placed over, at least in part, the booster-seat surface 604 of the booster seat assembly 602). The shape (interior shape) of the liner 702 conforms, at least in part, to the outer shape of the booster seat assembly 602. The liner image 705 is positioned on any suitable part of the liner 702, such as a side or a portion of the liner surface 704 (of the liner 702). For instance, the liner image 705 is positioned on any desired positioned located on an outer side wall of the liner surface 704 (as depicted). It will be appreciated that, in general terms, the liner image 705 may be positioned on (or in) at any location on or in the liner surface 704 (for instance, not just on the side wall of the liner surface 704).

The liner 702 is configured to be positioned over (at least in part) a portion of the booster seat assembly 602. It will be appreciated that, in general terms, the liner image 705 (or the liner 702) may be positioned on (or in) at any location on or in the booster seat assembly 602 (for instance, not just on the side wall of the booster seat assembly 602).

The cover assembly 102 includes the cover-engagement feature 110, in which the cover-engagement feature 110 is configured to be engageable (securely engageable) with the holder-engagement feature 808 of the booster seat assembly 602 (preferably, once the liner 702 is positioned, at least in part, on the booster seat assembly 602). The cover-engagement feature 110 is, preferably, located on an outer rim portion (a peripheral edge portion) of the cover assembly 102. Preferably, the cover-engagement feature 110 is positioned on opposite sides of the cover surface 104 (for improved secured connection of the cover assembly 102 to the booster seat assembly 602).

The user 952, in use, grabs and moves the cover-engagement feature 110 along the movement direction 954 (a rotational movement). The cover-engagement feature 110 is configured to be pivotally movable along the movement direction 954. The cover-engagement feature 110 is configured to be selectively snap fitted to the holder-engagement feature 808. It will be appreciated that, in an equivalent manner, the cover-engagement feature 110 may be mounted to the booster-seat surface 604, and the holder-engagement feature 808 may be mounted to the cover-engagement feature 110 (and achieve an equivalent connection result between the cover assembly 102 and the booster seat assembly 602).

Referring to the embodiment as depicted in FIG. 44, the cover assembly 102 is positioned over the liner 702, and the liner 702 is positioned over the booster seat assembly 602. The liner 702 is movable along the positioning direction 956 toward the exposed outer surface of the booster seat assembly 602.

Referring to the embodiment as depicted in FIG. 45, the liner 702 is placed on (positioned over) and/or contacts (at least in part) the exposed outer surface of the booster seat assembly 602. The holder-engagement feature 808 of the booster seat assembly 602 remains exposed (at least in part) while the liner 702 is placed on (positioned over) and/or contacts (at least in part) the exposed outer surface of the booster seat assembly 602. The cover assembly 102 is movable along the positioning direction 956 toward the exposed outer surface of the liner 702.

Referring to the embodiment as depicted in FIG. 46, the cover assembly 102 is placed on (positioned over) and/or contacts (at least in part) the exposed outer surface of the liner 702.

The liner 702 conforms (at least in part) to the outer shape of the booster seat assembly 602, and the cover assembly 102 conforms (at least in part) to the outer shape of the liner 702 and the booster seat assembly 602.

The cover-engagement feature 110 (of the cover assembly 102) is positioned proximate (adjacent) to the holder-engagement feature 808 (of the booster seat assembly 602).

The holder-engagement feature 808 and the cover-engagement feature 110 are coupled (securely connectable)

with (to) each other (after the cover assembly 102 is placed on, at least in part, the exposed outer surface of the liner 702).

The user 952 (such as a child), in use, sits on the outer surface of the cover assembly 102. The cover assembly 102, in use, protects the liner 702 from unwanted or inadvertent damage. The cover assembly 102, in use, permits exposure of the liner image 705 of the liner 702.

Once the liner 702 is placed on the booster seat assembly 602, the liner image 705, in use, enhances utilization of (provides visual enhancement of) the booster seat assembly 602 by the child (the user 952). The liner image 705 may assist the child in developing a positive emotional experience when using the combination of the cover assembly 102, the liner 702 and the booster seat assembly 602.

Figure 47:
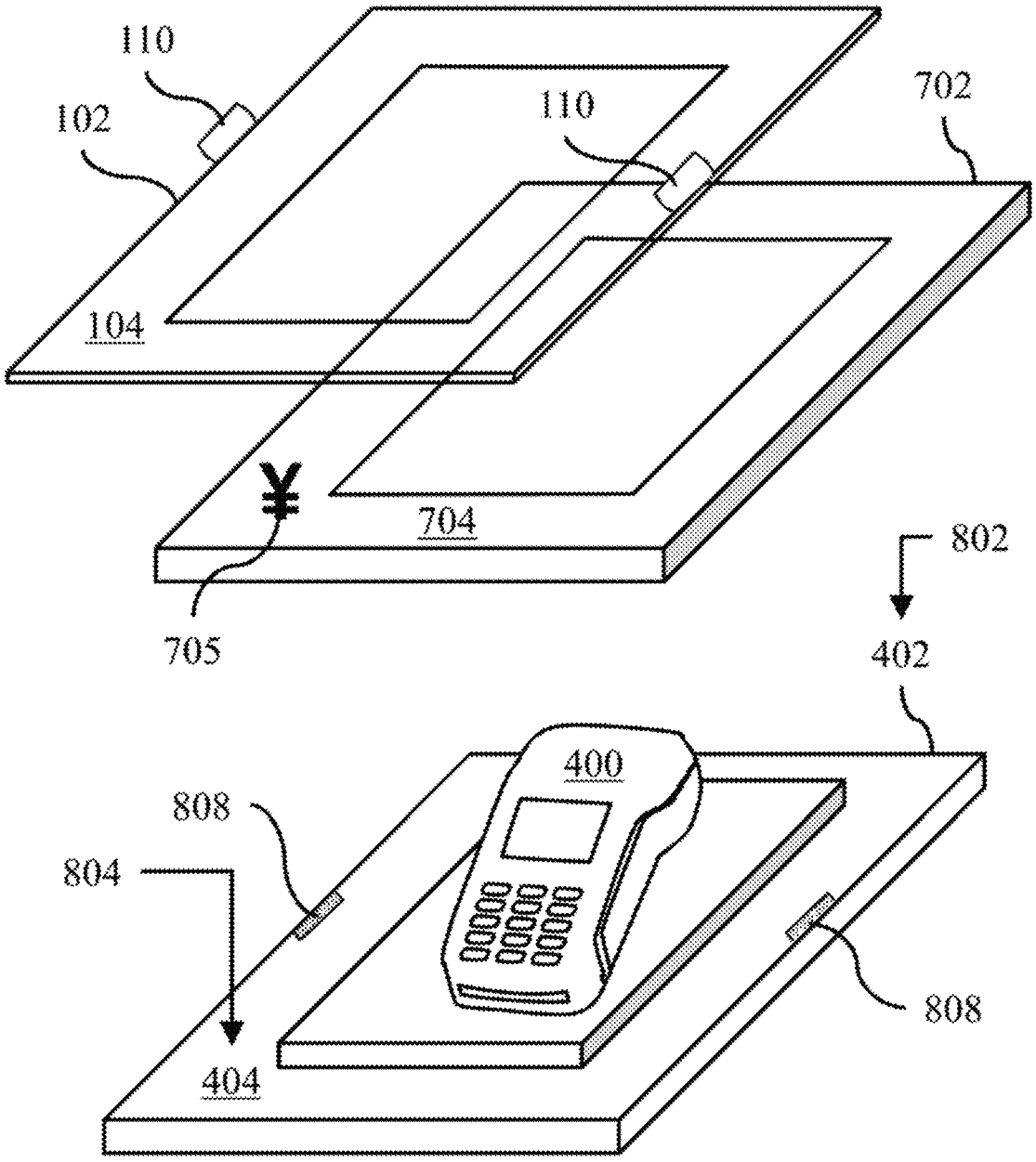
FIG. 47 depicts a perspective view of an embodiment of the cover assembly, the holder assembly, and the liner of FIG. 3.

FIG. 47 depicts a perspective view of an embodiment of the cover assembly 102, the holder assembly 802, and the liner 702 of FIG. 3.

Figure 48:
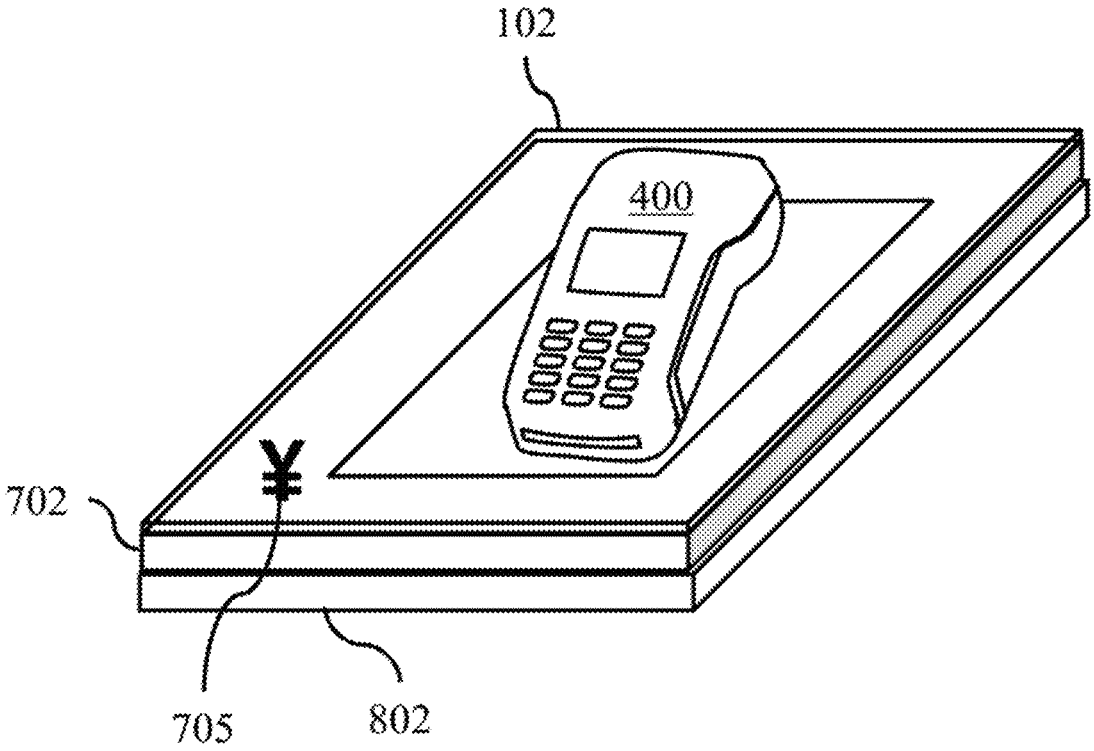
FIG. 48 depicts a perspective view of an embodiment of the cover assembly, the holder assembly, and the liner of FIG. 47.

FIG. 48 depicts a perspective view of an embodiment of the cover assembly 102, the holder assembly 802, and the liner 702 of FIG. 47.

Figure 49:
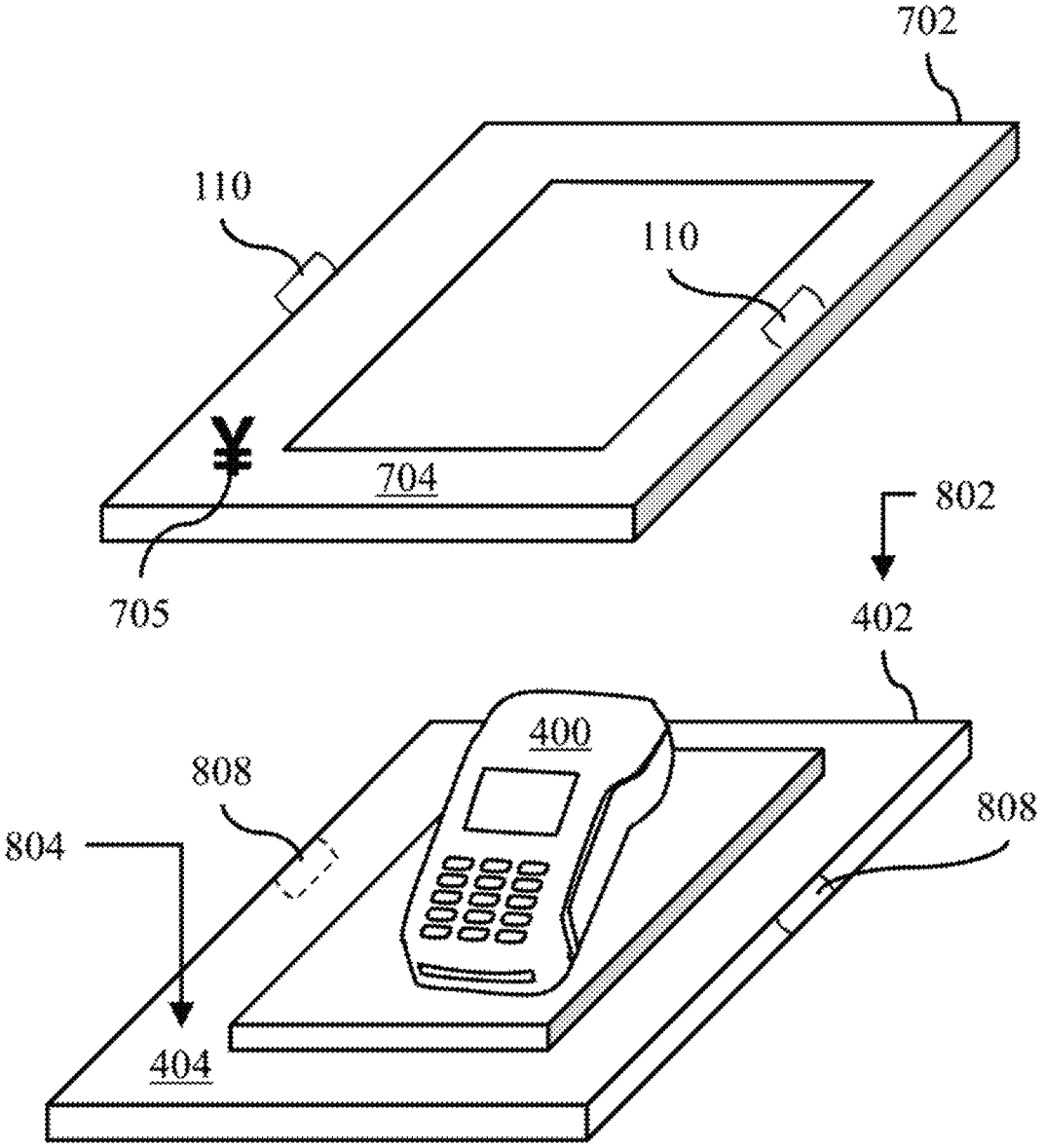
FIG. 49 depicts a perspective view of an embodiment of the holder assembly and the liner of FIG. 47.

FIG. 49 depicts a perspective view of an embodiment of the holder assembly 802 and the liner 702 of FIG. 47.

Referring to the embodiment as depicted in FIG. 47, there is depicted a point-of-sale device 400 (POS device). A POS device may include a credit card processing unit, and any other kind and any equivalent thereof. The point of sale (POS) device 400 (also called a point of purchase (POP) device) is configured to transact a purchase (such as a retail purchase). At the point of sale, the merchant calculates the amount owed by the customer, indicates that amount, may prepare an invoice for the customer (which may be a cash register printout), and indicates the options for the customer to make payment. It is also the point at which a customer makes a payment to the merchant in exchange for goods or after provision of a service. After receiving payment, the merchant may issue a receipt for the transaction, which is usually printed and may be dispensed with or sent electronically.

The holder assembly 802 includes a POS holder 402 (a point-of-sale device holder or a holder, etc.). The POS holder 402 may or may not be configured to support the point-of-sale device 400 (POS device). The holder surface 804 includes a POS holder surface 404. The point-of-sale device 400 may be positioned (at least in part) on top (or positioned proximate to, or adjacent to) the POS holder 402. The POS holder 402 is configured to be located proximate (adjacent) to the point-of-sale device 400.

In accordance with an embodiment, the POS holder 402 is configured to be selectively affixed to the point-of-sale device 400 (this is done in such a way that the point-of-sale device 400 is available for user viewing).

In accordance with an embodiment, the POS holder 402 is configured to be selectively positioned (at least in part) proximate (adjacent) to the point-of-sale device 400 (this is done in such a way that the point-of-sale device 400 is available for user viewing).

A liner 702 is configured to be positioned (at least in part) above the POS holder 402 (in a spaced-apart relationship). A cover assembly 102 is configured to be positioned (at least in part) above the liner 702 (in a spaced-apart relationship).

The cover assembly 102 includes the cover-engagement feature 110. The cover-engagement feature 110 is configured to securely connect the cover assembly 102 to the POS holder 402. Preferably, the cover-engagement feature 110 is configured to extend from the cover assembly 102. Preferably, the cover-engagement feature 110 is connected to the cover assembly 102 (extends from the cover assembly 102). The cover-engagement feature 110 is formed to an outer edge portion of the cover assembly 102. The cover-engagement feature 110 is configured to connect the cover assembly 102 to the POS holder 402 (to the edge portion of the POS holder 402). The POS holder 402 includes the holder-engagement feature 808. The cover-engagement feature 110 is configured to connect to the holder-engagement feature 808 of the POS holder 402.

Referring to the embodiment as depicted in FIG. 48, the liner 702 is configured to be positioned (at least in part) to contact (at least in part) the POS holder 402 (and to cover at least in part the POS holder 402).

The cover assembly 102 is positioned (at least in part) to cover (at least in part) the liner 702. The cover assembly 102 is configured to reveal (at least in part, an observer 950, as depicted in FIG. 4 for instance) the liner image 705 formed on the liner 702. The liner image 705, in use, improves or enhances the appearance of the point-of-sale device 400 (once the liner 702 is positioned (at least in part) on (or proximate to, adjacent to) the POS holder 402, and once the POS holder 402 is positioned (at least in part) proximate (adjacent) to the point-of-sale device 400 (and/or on or near the POS holder 402)).

Preferably, the cover assembly 102 is configured to transmit (at least in part) light (configured to be light transmissive, at least in part). The cover assembly 102 is configured to protect (in use) the integrity of the liner 702 (once the cover assembly 102, in use, is positioned (at least in part) proximate (adjacent) to the liner 702).

In accordance with an option, it will be appreciated that the liner 702 and the cover assembly 102 are formed as an integral unit (fused as a single unit). In accordance with an option, it will be appreciated that the liner 702 and the holder assembly 802 are formed as an integral unit (fused as a single unit). In accordance with an option, it will be appreciated that the cover assembly 102 and the liner 702 and the holder assembly 802 are formed as an integral unit (fused as a single unit).

Referring to the embodiment as depicted in FIG. 49, it will be appreciated that in accordance with an embodiment, the liner 702 is positioned (at least in part) over the POS holder surface 404 (with the cover assembly 102 not being utilized). The liner 702 includes the cover-engagement feature 110.

The liner 702 includes the cover-engagement feature 110. The cover-engagement feature 110 is configured to securely connect the liner 702 to the POS holder 402. Preferably, the cover-engagement feature 110 is connected to the liner 702 (extends from the liner 702). The cover-engagement feature 110 is formed to an outer edge portion of the liner 702. The cover-engagement feature 110 is configured to connect the liner 702 to the POS holder 402 (to the edge portion of the POS holder 402). The POS holder 402 includes the holder-engagement feature 808. The cover-engagement feature 110 is configured to connect to the holder-engagement feature 808 of the POS holder 402.

FIG. 50, FIG. 51, FIG. 52, FIG. 53 and FIG. 54 depict schematic views of embodiments of a holder assembly 802, and it will be appreciated that these embodiments are relatively easier to understand in view of the description provided above for FIG. 1 to FIG. 49.

Figure 50:
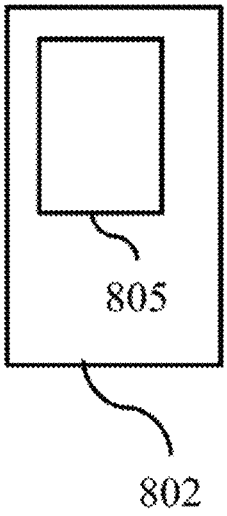
FIG. 50, FIG. 51, FIG. 52 and FIG. 53 depict schematic views of embodiments of a holder assembly.

Referring to the embodiment as depicted in FIG. 50, a holder image 805 is configured to be positioned, at least in part, proximate to (on an external surface of) a holder assembly 802. This is done in such a way that the holder image 805, in use, faces away from the holder assembly 802 once the holder image 805, in use, is positioned proximate to (on) the holder assembly 802. The holder image 805 is also configured to face away from the holder assembly 802 once the holder image 805, in use, is positioned, at least in part, proximate to (on) the holder assembly 802. The holder image 805, in use, visually enhances an appearance of the holder assembly 802 once the holder image 805, in use, is positioned proximate to the holder assembly 802. For instance, the holder image 805 may include a relief pattern extending from (formed to) the holder assembly 802, etc. In accordance with an option, the holder image 805 is configured to selectively connect (couple) with, and selectively disconnect from, the holder assembly 802. In accordance with an option, the holder image 805 is integrally formed to (with) the holder assembly 802, if so desired.

Figure 51:
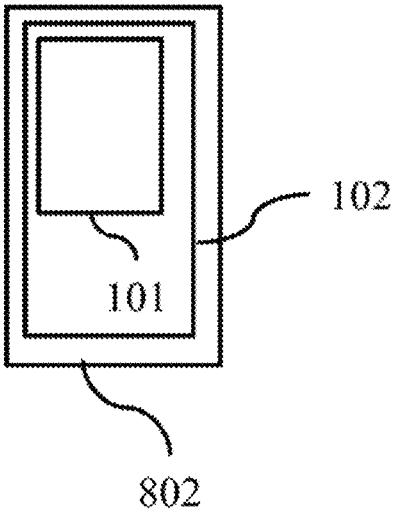

Referring to the embodiment as depicted in FIG. 51, a cover assembly 102 has a cover image 101 formed thereon or therein (that is, on or in the cover assembly 102). The cover assembly 102 is configured to be selectively positioned proximate to (over), at least in part, a holder assembly 802. This is done in such a way that the cover assembly 102, in use, positions the cover image 101 so that the cover image 101, in use, faces away from the holder assembly 802 once the cover assembly 102, in use, is selectively positioned proximate to, at least in part, the holder assembly 802. The cover assembly 102 is also configured to visually display, at least in part, the cover image 101 formed on the cover assembly 102 once the cover assembly 102, in use, is selectively positioned proximate to (over), at least in part, the holder assembly 802. The cover assembly 102, in use, visually enhances an appearance of the holder assembly 802 once the cover assembly 102 is selectively positioned proximate to (over) the holder assembly 802. The cover assembly 102 is configured to physically protect (protect) the appearance of the holder assembly 802 once the cover assembly 102 is selectively positioned proximate to the liner 702, and the liner 702 is positioned proximate to the holder assembly 802. In accordance with an option, the cover assembly 102 is configured to selectively connect (couple) with, and selectively disconnect from, the holder assembly 802. In accordance with an option, the cover assembly 102 is integrally formed with the holder assembly 802, if so desired.

Figure 52:
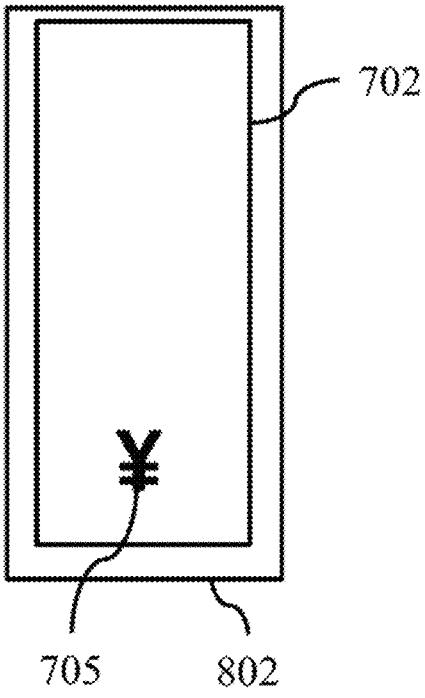

Referring to the embodiment as depicted in FIG. 52, a liner 702 has a liner image 705 formed thereon or therein (that is, on or in the liner 702). The liner 702 is configured to be selectively positioned proximate to (such as over), at least in part, a holder assembly 802. This is done in such a way that the liner 702, in use, positions the liner image 705 formed on the liner 702 so that the liner image 705, in use, faces away from the holder assembly 802 once the liner 702, in use, is selectively positioned, at least in part, proximate to the holder assembly 802. The liner 702 is also configured to visually display, at least in part, the liner image 705 formed on the liner 702 once the liner 702, in use, is selectively positioned proximate to (over), at least in part, the holder assembly 802. The liner 702, in use, visually enhances an appearance of the holder assembly 802 once the liner 702 is selectively positioned proximate to the holder assembly 802. In accordance with an option, the liner 702 is configured to selectively connect (couple) with, and selectively disconnect from, the holder assembly 802. In accordance with an option, the liner 702 is integrally formed with the holder assembly 802, if so desired.

Figure 53:
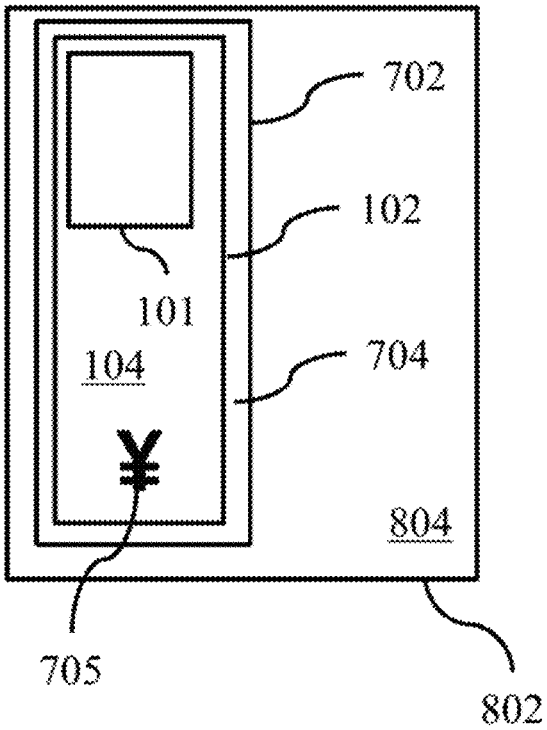

Referring to the embodiment as depicted in FIG. 53, a liner 702 has a liner image 705 formed thereon or therein (that is, on or in the liner 702). Preferably, the liner 702 has a liner surface 704 with the liner image 705 formed on the liner surface 704. The liner 702 is configured to be selectively positioned proximate to (over), at least in part, a holder surface 804 of a holder assembly 802. This is done in such a way that the liner 702, in use, positions the liner image 705 formed on the liner surface 704 so that the liner image 705, in use, faces away from the holder surface 804 of the holder assembly 802 once the liner 702, in use, is selectively positioned proximate to (over), at least in part, the holder surface 804 of the holder assembly 802. In addition, a cover assembly 102 has a cover surface 104. The cover assembly 102 is configured to selectively cover, at least in part, the liner image 705 formed on the liner surface 704 of the liner 702. The cover assembly 102 is also configured to reveal, at least in part, the liner image 705 formed on the liner surface 704 once (A) the liner 702, in use, is selectively positioned over, at least in part, the holder assembly 802, and (B) the cover assembly 102, in use, selectively covers, at least in part, the liner image 705 formed on the liner surface 704 of the liner 702. The cover assembly 102 has a cover image 101 formed on the cover surface 104 (this is done in such a way that the cover image 101, in use, is displayed once the cover assembly 102, in use, selectively covers, at least in part, the liner 702, in which the liner 702 is positioned proximate to the holder assembly 802). The liner 702, in use, visually enhances an appearance of the holder assembly 802 once the liner 702 is selectively positioned between the cover assembly 102 and the holder assembly 802. The cover assembly 102, in use, visually enhances the appearance of the holder assembly 802 once the cover assembly 102 is selectively positioned proximate to the liner 702, and the liner 702 is positioned proximate to the holder assembly 802. The cover assembly 102 is configured to physically protect (protect) the appearance of the holder assembly 802 once the cover assembly 102 is selectively positioned proximate to the liner 702, and the liner 702 is positioned proximate to the holder assembly 802. In accordance with an option, the liner 702 is configured to selectively connect (couple) with, and selectively disconnect from, the holder assembly 802. In accordance with an option, the cover assembly 102 is configured to selectively connect (couple) with, and selectively disconnect from, the holder assembly 802. In accordance with an option, the liner 702 is integrally formed with the holder assembly 802. In accordance with an option, the cover assembly 102 is integrally formed with the holder assembly 802. In accordance with an option, the cover assembly 102, the liner 702 and the holder assembly 802 are integrally formed, if so desired.

Figure 54:
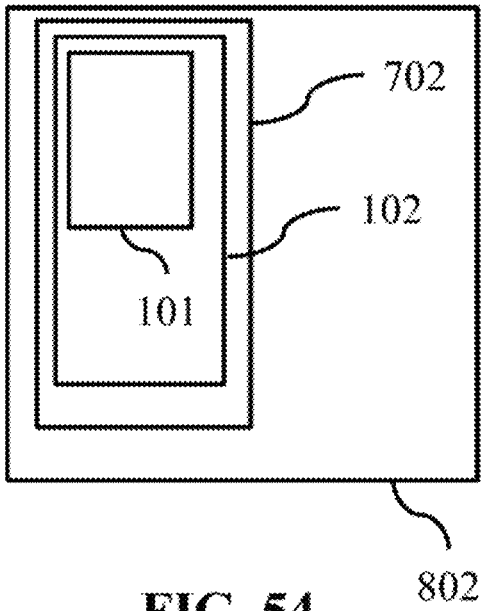
FIG. 54 depicts a schematic view of an embodiment of a holder assembly.

Referring to the embodiment as depicted in FIG. 54, a liner 702 is configured to be selectively positioned over, at least in part, a holder assembly 802. In addition, a cover assembly 102 is configured to selectively cover, at least in part, the liner 702 once the liner 702, in use, is selectively positioned over, at least in part, the holder assembly 802. The cover assembly 102 has a cover image 101 formed thereon (this is done in such a way that the cover image 101, in use, is displayed once the cover assembly 102, in use, selectively covers, at least in part, the liner 702, in which the liner 702 is positioned over, at least in part, the holder assembly 802). The cover assembly 102, in use, visually enhances the appearance of the holder assembly 802 and the liner 702 once the cover assembly 102 is selectively positioned over the liner 702, and the liner 702 is positioned over the holder assembly 802. The cover assembly 102 is configured to physically protect (protect) the appearance of the holder assembly 802 once the cover assembly 102 is selectively positioned proximate to the liner 702, and the liner 702 is positioned proximate to the holder assembly 802. In accordance with an option, the liner 702 is configured to selectively connect (couple) with, and selectively disconnect from, the holder assembly 802. In accordance with an option, the cover assembly 102 is configured to selectively connect (couple) with, and selectively disconnect from, the holder assembly 802. In accordance with an option, the cover assembly 102 is integrally formed with the holder assembly 802.

In accordance with a preferred embodiment (applicable to all of the FIGS.), it may be desirable to improve advertising revenue in association with the holder assembly 802 (that is, for monetizing the holder assembly 802). The advertisement provides a notice or announcement in a public medium promoting a product, service, or event or publicizing a job vacancy, etc., and any other kind, and any equivalent thereof.

In accordance with an embodiment (applicable to all of the FIGS.), there is provided a method for enhancing advertising revenue in association with a holder assembly 802. The method includes and is not limited to positioning a liner 702, at least in part, over a holder surface 804 of the holder assembly 802, in which the liner 702 has a liner surface 704 with a liner image 705 formed on the liner surface 704, in such a way that the liner 702, in use, positions the liner image 705 formed on the liner surface 704 in such a way that the liner image 705, in use, faces away from the holder surface 804 of the holder assembly 802. The method also includes and is not limited to selectively covering, at least in part, the liner image 705 formed on the liner surface 704 of the liner 702 with a cover assembly 102 having a cover surface 104, in which the cover surface 104 of the cover assembly 102 is configured to reveal, at least in part, the liner image 705 being formed on the liner surface 704 once: (A) the liner 702, in use, is selectively positioned over, at least in part, the holder surface 804 of the holder assembly 802; and (B) the cover surface 104 of the cover assembly 102, in use, selectively covers, at least in part, the liner image 705 being formed on the liner surface 704 of the liner 702, in which the cover assembly 102 is configured to protect, in use, the liner 702. The liner image 705 formed on the liner surface 704 of the liner 702 includes, at least in part, an advertisement. The liner image 705, in use, enhances advertising revenue in association with the holder assembly 802 once the liner image 705 is selectively positioned proximate to the holder assembly 802.

In accordance with an embodiment (applicable to all of the FIGS.), the liner image 705 includes (at least in part) the advertisement, and the liner image 705, in use, enhances advertising revenue in association with the holder assembly 802 once the liner image 705 is selectively positioned proximate to (relative to) the holder assembly 802. In accordance with an option, there is provided a method for enhancing advertising revenue in association with a holder assembly 802. The method includes positioning a liner 702, at least in part, proximate to the holder assembly 802, in which the liner 702 has a liner image 705. The liner image 705 includes, at least in part, an advertisement. The liner image 705, in use, enhances advertising revenue in association with the holder assembly 802 once the liner image 705 is selectively positioned proximate to the holder assembly 802.

In accordance with an embodiment (applicable to all of the FIGS.), the cover image 101 includes (at least in part) the advertisement, and the cover image 101, in use, enhances advertising revenue in association with the holder assembly 802 once the cover image 101 is selectively positioned proximate to (relative to) the holder assembly 802. In accordance with an option, there is provided a method for enhancing advertising revenue in association with a holder assembly 802. The method includes positioning a cover assembly 102, at least in part, proximate to the holder assembly 802, in which the cover assembly 102 has a cover image 101. The cover image 101 includes, at least in part, an advertisement. The cover image 101, in use, enhances advertising revenue in association with the holder assembly 802 once the cover image 101 is selectively positioned proximate to the holder assembly 802.

In accordance with an embodiment (applicable to all of the FIGS.), the holder image 805 includes (at least in part) the advertisement, and the holder image 805, in use, enhances advertising revenue in association with the holder assembly 802 once the holder image 805 is selectively positioned proximate to (relative to) the holder assembly 802. In accordance with an option, there is provided a method for enhancing advertising revenue in association with a holder assembly 802. The method includes positioning a holder image 805, at least in part, proximate to the holder assembly 802. The holder image 805 includes, at least in part, an advertisement. The holder image 805, in use, enhances advertising revenue in association with the holder assembly 802 once the holder image 805 is selectively positioned proximate to the holder assembly 802.

Additional Description

The following clauses are offered as further description of the examples of the apparatus. Any one or more of the following clauses may be combinable with any other one or more of the following clauses and/or with any subsection or a portion or portions of any other clause and/or combination and permutation of clauses. Any one of the following clauses may stand on its own merit without having to be combined with any other clause or with any portion of any other clause, etc.

Clause (1): an apparatus (either taken alone, or with an apparatus of any clause mentioned in this paragraph, or any portion of any clause mentioned in this paragraph), including and not limited to (comprising) a synergistic combination of a holder assembly 802, a liner 702, and a cover assembly 102; and/or in which the liner 702 has (is with) a liner image 705 formed thereon; and/or the liner 702 is configured to be selectively positioned over, at least in part, the holder assembly 802 (this is done in such a way that the liner 702, in use, positions the liner image 705 formed thereon so that (such that) the liner image 705, in use, faces away from the holder assembly 802); and/or the cover assembly 102 is configured to selectively cover, at least in part, the liner image 705 formed on the liner 702; and/or the cover assembly 102 is also configured to reveal (such as to an observer 950), at least in part, the liner image 705 formed on the liner 702 (once the liner 702, in use, is selectively positioned over, at least in part, the holder assembly 802); and/or the cover assembly 102 is also configured to reveal (such as to an observer 950), at least in part, the liner image 705 formed on the liner 702 (once the cover assembly 102, in use, selectively covers, at least in part, the liner image 705 formed on the liner 702); and/or the liner 702, in use, visually enhances (changes) an appearance of the holder assembly 802 once the liner 702 is (selectively) positioned between the cover assembly 102 and the holder assembly 802.

Clause (2): an apparatus (either taken alone, or with an apparatus of any clause mentioned in this paragraph, or any portion of any clause mentioned in this paragraph), including and not limited to (comprising) a holder assembly 802 configured to cooperate with a liner 702 with a liner image 705 formed thereon; and/or in which the liner 702 is configured to be selectively positioned over, at least in part, the holder assembly 802 (this is done in such a way that the liner 702, in use, positions the liner image 705 formed thereon so that (such that) the liner image 705, in use, faces away from the holder assembly 802); and/or the holder assembly 802 is also configured to cooperate with a cover assembly 102, in which the cover assembly 102 is configured to selectively cover, at least in part, the liner image 705 formed on the liner 702; and/or the cover assembly 102 is also configured to reveal (such as to an observer 950), at least in part, the liner image 705 formed on the liner 702 (once the liner 702, in use, is selectively positioned over, at least in part, the holder assembly 802); and/or the cover assembly 102 is also configured to reveal (such as to an observer 950), at least in part, the liner image 705 formed on the liner 702 (once the cover assembly 102, in use, selectively covers, at least in part, the liner image 705 formed on the liner 702); and/or the liner 702, in use, visually enhances (changes) an appearance of the holder assembly 802 once the liner 702 is selectively positioned between the cover assembly 102 and the holder assembly 802.

Clause (3): an apparatus (either taken alone, or with an apparatus of any clause mentioned in this paragraph, or any portion of any clause mentioned in this paragraph), including and not limited to (comprising) a synergistic combination of a liner 702 and a cover assembly 102; and/or in which the liner 702 has (is with) a liner image 705 formed thereon; and/or the liner 702 is configured to be selectively positioned over, at least in part, a holder assembly 802 (this is done in such a way that the liner 702, in use, positions the liner image 705 formed thereon so that (such that) the liner image 705, in use, faces away from the holder assembly 802); and/or the cover assembly 102 is configured to selectively cover, at least in part, the liner image 705 formed on the liner 702; and/or the cover assembly 102 is also configured to reveal (such as to an observer 950), at least in part, the liner image 705 formed on the liner 702 (once the liner 702, in use, is selectively positioned over, at least in part, the holder assembly 802); and/or the cover assembly 102 is also configured to reveal (such as to an observer 950), at least in part, the liner image 705 formed on the liner 702 (once the cover assembly 102, in use, selectively covers, at least in part, the liner image 705 formed on the liner 702); and/or the liner 702, in use, visually enhances (changes) an appearance of the holder assembly 802 once the liner 702 is selectively positioned between the cover assembly 102 and the holder assembly 802.

Clause (4): an apparatus (either taken alone, or with an apparatus of any clause mentioned in this paragraph, or any portion of any clause mentioned in this paragraph), including and not limited to (comprising) a liner 702 with a liner image 705 formed thereon; and/or in which the liner 702 is configured to be selectively positioned over, at least in part, a holder assembly 802 in such a way that the liner 702, in use, positions the liner image 705 formed thereon so that (such that) the liner image 705, in use, faces away from the holder assembly 802; and/or the liner 702 is configured to cooperate with a cover assembly 102, in which the cover assembly 102 is configured to selectively cover, at least in part, the liner image 705 formed on the liner 702; and/or the cover assembly 102 is also configured to reveal (such as to an observer 950), at least in part, the liner image 705 formed on the liner 702 (once the liner 702, in use, is selectively positioned over, at least in part, the holder assembly 802); and/or the cover assembly 102 is also configured to reveal (such as to an observer 950), at least in part, the liner image 705 formed on the liner 702 (once the cover assembly 102, in use, selectively covers, at least in part, the liner image 705 formed on the liner 702); and/or the liner 702, in use, visually enhances (changes) an appearance of the holder assembly 802 once the liner 702 is selectively positioned between the cover assembly 102 and the holder assembly 802.

Clause (5): an apparatus (either taken alone, or with an apparatus of any clause mentioned in this paragraph, or any portion of any clause mentioned in this paragraph), including and not limited to (comprising) a cover assembly 102 configured to selectively cover, at least in part, a liner image 705 formed on a liner 702, in which the liner 702 is configured to be selectively positioned over, at least in part, a holder assembly 802 (this is done in such a way that the liner 702, in use, positions the liner image 705 formed thereon so that (such that) the liner image 705, in use, faces away from the holder assembly 802); and/or the cover assembly 102 is also configured to reveal (such as to an observer 950), at least in part, the liner image 705 formed on the liner 702 (once the liner 702, in use, is selectively positioned over, at least in part, the holder assembly 802); and/or the cover assembly 102 is also configured to reveal (such as to an observer 950), at least in part, the liner image 705 formed on the liner 702 (once the cover assembly 102, in use, selectively covers, at least in part, the liner image 705 formed on the liner 702); and/or the liner 702, in use, visually enhances (changes) an appearance of the holder assembly 802 once the liner 702 is selectively positioned between the cover assembly 102 and the holder assembly 802.

Clause (6): an apparatus (either taken alone, or with an apparatus of any clause mentioned in this paragraph, or any portion of any clause mentioned in this paragraph), including and not limited to (comprising) a synergistic combination of a liner 702 and a cover assembly 102; and/or in which the liner 702 has a liner surface 704 with a liner image 705 formed on the liner surface 704; and/or the liner 702 is configured to be selectively positioned over, at least in part, (and/or to contact, at least in part) a holder surface 804 of a holder assembly 802 (this is done in such a way that the liner 702, in use, positions the liner image 705 being formed on the liner surface 704 so that (such as that) the liner image 705, in use, faces away from the holder surface 804 of the holder assembly 802); and/or the cover assembly 102 has a cover surface 104; and/or the cover surface 104 of the cover assembly 102 is configured to selectively cover, at least in part, the liner image 705 formed on the liner surface 704 of the liner 702; and/or the cover assembly 102 is also configured to reveal (such as to an observer 950), at least in part, the liner image 705 formed on the liner 702 (once the liner 702, in use, is selectively positioned over, at least in part, (and/or contacts, at least in part) the holder assembly 802); and/or the cover assembly 102 is also configured to reveal (such as to an observer 950), at least in part, the liner image 705 formed on the liner surface 704 of the liner 702 (once the cover assembly 102, in use, selectively covers, at least in part, the liner image 705 formed on the liner surface 704 of the liner 702); and/or the liner 702, in use, visually enhances (changes) an appearance of the holder assembly 802 once the liner 702 is selectively positioned between the cover assembly 102 and the holder assembly 802.

Clause (7) an apparatus (either taken alone, or with an apparatus of any clause mentioned in this paragraph, or any portion of any clause mentioned in this paragraph), including and not limited to (comprising) a liner 702 having a liner surface 704 with a liner image 705 formed on the liner surface 704; and/or in which the liner 702 is configured to be selectively positioned over, at least in part, (and/or to contact, at least in part) a holder surface 804 of a holder assembly 802 (this is done in such a way that the liner 702, in use, positions the liner image 705 being formed on the liner surface 704 so that (such as that) the liner image 705, in use, faces away from the holder surface 804 of the holder assembly 802); and/or the liner image 705 formed on the liner surface 704 of the liner 702 is configured to be selectively covered, at least in part, by a cover assembly 102 having a cover surface 104; and/or the cover assembly 102 is also configured to reveal (such as to an observer 950), at least in part, the liner image 705 formed on the liner 702 (once the liner 702, in use, is selectively positioned over, at least in part, (and/or contacts, at least in part) the holder surface 804 of the holder assembly 802); and/or the cover assembly 102 is also configured to reveal (such as to an observer 950), at least in part, the liner image 705 formed on the liner surface 704 of the liner 702 (once the cover assembly 102, in use, selectively covers, at least in part, the liner image 705 formed on the liner surface 704 of the liner 702); and/or the liner 702, in use, visually enhances (changes) an appearance of the holder assembly 802 once the liner 702 is selectively positioned between the cover assembly 102 and the holder assembly 802.

Clause (8): an apparatus (either taken alone, or with an apparatus of any clause mentioned in this paragraph, or any portion of any clause mentioned in this paragraph), including and not limited to (comprising) a holder assembly 802 also called a tray assembly) having a holder surface 804 (also called a tray surface); and/or in which the holder assembly 802 also has a joiner assembly 810; and/or the joiner assembly 810 is configured to be selectively receivable, at least in part, in a first drink hole feature 502 of a first seating system 504; and/or the joiner assembly 810 is also configured to be selectively receivable, at least in part, in a second drink hole feature 512 of a second seating system 514; and/or the joiner assembly 810 is also configured to selectively securely engage with the first drink hole feature 502 of the first seating system 504 once the joiner assembly 810 is received, at least in part, in the first drink hole feature 502 of the first seating system 504; and/or the joiner assembly 810 is also configured to selectively securely engage with the second drink hole feature 512 of the second seating system 514 once the joiner assembly 810 is received, at least in part, in the second drink hole feature 512 of the second seating system 514; and/or the joiner assembly 810 is also configured to cooperate with the first drink hole feature 502 of the first seating system 504, in which the first drink hole feature 502 has a first inner diameter 506; and/or the joiner assembly 810 is also configured to cooperate with the second drink hole feature 512 of the second seating system 514, in which the second drink hole feature 512 has a second inner diameter 516, in which the first inner diameter 506 of the first drink hole feature 502 and the second inner diameter 516 of the second drink hole feature 512 are different from each other.

Clause (9): an apparatus (either taken alone, or with an apparatus of any clause mentioned in this paragraph, or any portion of any clause mentioned in this paragraph), including and not limited to (comprising) a synergistic combination of a holder assembly 802, a liner 702, and a cover assembly 102; and/or in which the liner 702 has (is with) a liner image 705 formed thereon; and/or the liner 702 is configured to be selectively positioned, at least in part, between the holder assembly 802 and the cover assembly 102 (this is done in such a way that the liner 702, in use, positions the liner image 705 formed thereon so that (such that) the liner image 705, in use, faces away from the holder assembly 802); and/or the cover assembly 102 is also configured to reveal (such as to an observer 950), at least in part, the liner image 705 formed once the liner 702, in use, is selectively positioned, at least in part, between the holder assembly 802 and the cover assembly 102; and/or the liner 702, in use, enhances (changes) an appearance of the holder assembly 802 once the liner 702 is selectively positioned between the cover assembly 102 and the holder assembly 802.

Clause (10): an apparatus (either taken alone, or with an apparatus of any clause mentioned in this paragraph, or any portion of any clause mentioned in this paragraph), including and not limited to (comprising) a liner 702 (for use with a holder assembly 802 and a cover assembly 102); and/or in which the liner 702 has (is with) a liner image 705 formed thereon; and/or the liner 702 is configured to be selectively positioned, at least in part, between the holder assembly 802 and the cover assembly 102 (this is done in such a way that the liner 702, in use, positions the liner image 705 formed thereon so that (such that) the liner image 705, in use, faces away from the holder assembly 802); and/or the cover assembly 102 is also configured to reveal (such as to an observer 950), at least in part, the liner image 705 formed once the liner 702, in use, is selectively positioned, at least in part, between the holder assembly 802 and the cover assembly 102; and/or the liner 702, in use, enhances (changes) an appearance of the holder assembly 802 once the liner 702 is selectively positioned between the cover assembly 102 and the holder assembly 802.

Clause (11): an apparatus (either taken alone, or with an apparatus of any clause mentioned in this paragraph, or any portion of any clause mentioned in this paragraph), including and not limited to (comprising) a holder assembly 802 (for use with a liner 702 and a cover assembly 102); and/or in which the liner 702 has (is with) a liner image 705 formed thereon; and/or the liner 702 is configured to be selectively positioned, at least in part, between the holder assembly 802 and the cover assembly 102 (this is done in such a way that the liner 702, in use, positions the liner image 705 formed thereon so that (such that) the liner image 705, in use, faces away from the holder assembly 802); and/or the cover assembly 102 is also configured to reveal (such as to an observer 950), at least in part, the liner image 705 formed once the liner 702, in use, is selectively positioned, at least in part, between the holder assembly 802 and the cover assembly 102; and/or the liner 702, in use, enhances (changes) an appearance of the holder assembly 802 once the liner 702 is selectively positioned between the cover assembly 102 and the holder assembly 802.

Clause (12): an apparatus (either taken alone, or with an apparatus of any clause mentioned in this paragraph, or any portion of any clause mentioned in this paragraph), including and not limited to (comprising) a cover assembly 102 (for use with a holder assembly 802 and a liner 702); and/or in which the liner 702 has (is with) a liner image 705 formed thereon; and/or the liner 702 is configured to be selectively positioned, at least in part, between the holder assembly 802 and the cover assembly 102 (this is done in such a way that the liner 702, in use, positions the liner image 705 formed thereon so that (such that) the liner image 705, in use, faces away from the holder assembly 802); and/or the cover assembly 102 is also configured to reveal (such as to an observer 950), at least in part, the liner image 705 formed once the liner 702, in use, is selectively positioned, at least in part, between the holder assembly 802 and the cover assembly 102; and/or the liner 702, in use, enhances (changes) an appearance of the holder assembly 802 once the liner 702 is selectively positioned between the cover assembly 102 and the holder assembly 802.

Clause (13): an apparatus (either taken alone, or with an apparatus of any clause mentioned in this paragraph, or any portion of any clause mentioned in this paragraph), including and not limited to (comprising) a holder assembly 802 also called a tray assembly) having a holder surface 804 (also called a tray surface); and/or in which the holder assembly 802 also has a joiner assembly 810; and/or the joiner assembly 810 is configured to be selectively receivable, at least in part, in a first drink hole feature 502 of a first seating system 504; and/or the joiner assembly 810 is also configured to be selectively receivable, at least in part, in a second drink hole feature 512 of a second seating system 514; and/or the joiner assembly 810 is also configured to selectively securely engage with the first drink hole feature 502 of the first seating system 504 once the joiner assembly 810 is received, at least in part, in the first drink hole feature 502 of the first seating system 504; and/or the joiner assembly 810 is also configured to selectively securely engage with the second drink hole feature 512 of the second seating system 514 once the joiner assembly 810 is received, at least in part, in the second drink hole feature 512 of the second seating system 514; and/or the joiner assembly 810 is also configured to cooperate with the first drink hole feature 502 of the first seating system 504, in which the first drink hole feature 502 has a first inner diameter 506; and/or the joiner assembly 810 is also configured to cooperate with the second drink hole feature 512 of the second seating system 514, in which the second drink hole feature 512 has a second inner diameter 516, in which the first inner diameter 506 of the first drink hole feature 502 and the second inner diameter 516 of the second drink hole feature 512 are different from each other; and/or a liner 702 and/or a cover assembly 102; and/or the liner 702 has (is with) a liner image 705 formed thereon; and/or the liner 702 is configured to be selectively positioned over, at least in part, the holder assembly 802 (this is done in such a way that the liner 702, in use, positions the liner image 705 formed thereon in such a way that the liner image 705, in use, faces away from the holder assembly 802); and/or the cover assembly 102 is configured to selectively cover, at least in part, the liner image 705 formed on the liner 702; and/or the cover assembly 102 is also configured to reveal (such as to an observer 950), at least in part, the liner image 705 formed once the liner 702, in use, is selectively positioned over, at least in part, the holder assembly 802; and/or the cover assembly 102 is also configured to reveal (such as to an observer 950), at least in part, the liner image 705 formed on the liner 702 once the cover assembly 102, in use, selectively covers, at least in part, the liner image 705 formed on the liner 702; and/or the liner 702, in use, enhances (changes) an appearance of the holder assembly 802 once the liner 702 is (selectively) positioned between the cover assembly 102 and the holder assembly 802.

Clause (14): an apparatus (either taken alone, or with an apparatus of any clause mentioned in this paragraph, or any portion of any clause mentioned in this paragraph), including and not limited to (comprising) a holder assembly 802 including a POS holder 402 configured for utilization with a point-of-sale device 400 (POS device); and/or in which the POS holder 402 is configured to be located proximate (adjacent) to the point-of-sale device 400; and/or a liner 702 is configured to be positioned above the POS holder 402; and/or the liner has a liner image 705 formed thereon; and/or a cover assembly 102 is configured to be positioned above the liner 702; and/or the cover assembly 102 is also configured to reveal (such as to an observer 950), at least in part, the liner image 705 formed on the liner 702; and/or the liner image 705, in use, improves (changes) an appearance of the point-of-sale device 400 once the liner 702 is positioned proximate (adjacent) to the POS holder 402, and once the POS holder 402 is positioned proximate (adjacent) to the point-of-sale device 400; and/or the cover assembly 102 is configured to protect, in use, the liner 702 once the cover assembly 102, in use, is positioned proximate (adjacent) to the liner 702.

Clause (15): an apparatus (either taken alone, or with an apparatus of any clause mentioned in this paragraph, or any portion of any clause mentioned in this paragraph), including and not limited to (comprising) a holder assembly 802 including a POS holder 402 configured for utilization with a point-of-sale device 400 (POS device); and/or in which the POS holder 402 is configured to be located proximate (adjacent) to the point-of-sale device 400; and/or a liner 702 is configured to be positioned above the POS holder 402; and/or the liner having a liner image 705 formed thereon; and/or the liner image 705, in use, improves (changes) an appearance of the point-of-sale device 400 once the liner 702 is positioned proximate (adjacent) to the POS holder 402, and once the POS holder 402 is positioned proximate (adjacent) to the point-of-sale device 400.

Clause (16): an apparatus (either taken alone, or with an apparatus of any clause mentioned in this paragraph, or any portion of any clause mentioned in this paragraph), including (and not limited to) a liner 702 having a liner surface 704 with a liner image 705 formed on the liner surface 704; and/or in which the liner 702 is configured to be selectively positioned over, at least in part, a holder surface 804 of a holder assembly 802 in such a way that the liner 702, in use, positions the liner image 705 being formed on the liner surface 704 so that (such as that) the liner image 705, in use, faces away from the holder surface 804 of the holder assembly 802; and/or a cover assembly 102 having a cover surface 104, and the cover surface 104 of the cover assembly 102 being configured to selectively cover, at least in part, the liner image 705 being formed on the liner surface 704 of the liner 702, and the cover surface 104 of the cover assembly 102 also being configured to reveal, at least in part, the liner image 705 being formed on the liner surface 704 once: (A) the liner 702, in use, is selectively positioned over, at least in part, the holder surface 804 of the holder assembly 802; and/or (B) the cover surface 104 of the cover assembly 102, in use, selectively covers, at least in part, the liner image 705 being formed on the liner surface 704 of the liner 702; and/or whereby the liner 702, in use, visually enhances an appearance of the holder assembly 802 once the liner 702 is selectively positioned between the cover assembly 102 and the holder assembly 802.

Clause (17): an apparatus (either taken alone, or with an apparatus of any clause mentioned in this paragraph, or any portion of any clause mentioned in this paragraph), including and not limited to (comprising) an engagement feature 105 configured to selectively engage the cover assembly 102 and the holder assembly 802 with each other in such a way that the engagement feature 105 securely positions the cover surface 104, in use, to cover, at least in part, the liner image 705 being formed on the liner surface 704 of the liner 702, and in which the liner 702 is selectively positioned over, at least in part, the holder surface 804 of the holder assembly 802.

Clause (18): an apparatus (either taken alone, or with an apparatus of any clause mentioned in this paragraph, or any portion of any clause mentioned in this paragraph), including and not limited to (comprising) an engagement feature 105 configured to selectively engage the cover assembly 102 and the holder assembly 802 with each other in such a way that the engagement feature 105 securely positions the cover surface 104, in use, to cover, at least in part, the liner image 705 being formed on the liner surface 704 of the liner 702, and in which the liner 702 is selectively positioned over, at least in part, the holder surface 804 of the holder assembly 802.

Clause (19) an apparatus (either taken alone, or with an apparatus of any clause mentioned in this paragraph, or any portion of any clause mentioned in this paragraph), including and not limited to (comprising) the engagement feature 105 configured to selectively disengage the cover assembly 102 and the holder assembly 802 from each other.

Clause (20): an apparatus (either taken alone, or with an apparatus of any clause mentioned in this paragraph, or any portion of any clause mentioned in this paragraph), including and not limited to (comprising) the engagement feature 105 including a cover-engagement feature 110 being provided by the cover assembly 102.

Clause (21): an apparatus (either taken alone, or with an apparatus of any clause mentioned in this paragraph, or any portion of any clause mentioned in this paragraph), including and not limited to (comprising) the engagement feature 105 including a cover-engagement feature 110 being provided by the cover assembly 102; and/or also including a holder-engagement feature 808 being provided by the holder assembly 802; and/or wherein the cover-engagement feature 110 and the holder-engagement feature 808 are configured to selectively engage with each other.

Clause (22): an apparatus (either taken alone, or with an apparatus of any clause mentioned in this paragraph, or any portion of any clause mentioned in this paragraph), including and not limited to (comprising) the holder assembly 802 including a food-service tray 902; and/or the holder surface 804 includes a tray surface 904 being provided by the food-service tray 902.

Clause (23): an apparatus (either taken alone, or with an apparatus of any clause mentioned in this paragraph, or any portion of any clause mentioned in this paragraph), including and not limited to (comprising) the holder assembly 802 including a booster seat assembly 602; and/or the holder surface 804 includes a booster-seat surface 604 being provided by the booster seat assembly 602.

Clause (24): an apparatus (either taken alone, or with an apparatus of any clause mentioned in this paragraph, or any portion of any clause mentioned in this paragraph), including and not limited to (comprising) the liner 702 and the cover assembly 102 formed as an integral unit.

Clause (25): an apparatus (either taken alone, or with an apparatus of any clause mentioned in this paragraph, or any portion of any clause mentioned in this paragraph), including and not limited to (comprising) the liner 702 and the holder assembly 802 formed as an integral unit.

Clause (26): an apparatus (either taken alone, or with an apparatus of any clause mentioned in this paragraph, or any portion of any clause mentioned in this paragraph), including and not limited to (comprising) the cover assembly 102 and the liner 702 and the holder assembly 802 formed as an integral unit.

Clause (27): an apparatus (either taken alone, or with an apparatus of any clause mentioned in this paragraph, or any portion of any clause mentioned in this paragraph), including and not limited to (comprising) the cover assembly 102 including lateral cover side walls 106 positioned on opposite lateral sides of the cover assembly 102; and/or a rear cover wall 108 extending between the lateral cover side walls 106; and/or a front cover wall 109 extending between the lateral cover side walls 106; and/or the rear cover wall 108 and the front cover wall 109 are spaced apart from each other.

Clause (28): an apparatus (either taken alone, or with an apparatus of any clause mentioned in this paragraph, or any portion of any clause mentioned in this paragraph), including and not limited to (comprising) the liner 702 including lateral liner side walls 706 positioned on opposite lateral sides of the liner 702; and/or a rear liner wall 708 extending between the lateral liner side walls 706; and/or a front liner wall 709 extending between the lateral liner side walls 706; and/or the rear liner wall 708 and the front liner wall 709 are spaced apart from each other.

Clause (29): an apparatus (either taken alone, or with an apparatus of any clause mentioned in this paragraph, or any portion of any clause mentioned in this paragraph), including and not limited to (comprising) the holder assembly 802 including lateral holder side walls positioned on opposite lateral sides of the holder assembly 802; and/or a rear holder wall extending between the lateral holder side walls; and/or a front holder wall extending between the lateral holder side walls.

Clause (30): an apparatus (either taken alone, or with an apparatus of any clause mentioned in this paragraph, or any portion of any clause mentioned in this paragraph), including and not limited to (comprising) the cover assembly 102 providing a cover passageway 112 configured to permit passage, at least in part, of a drink container 955; and/or the liner 702 provides (defines) a liner passageway 712 configured to permit passage, at least in part, of the drink container 955; and/or the holder assembly 802 defines a holder passageway 811 configured to permit passage, at least in part, of the drink container 955; and/or the cover passageway 112, the liner passageway 712 and the holder passageway 811 are configured to be co-aligned with each other once the cover assembly 102 is positioned to cover, in use, the liner 702, and once the liner 702 is positioned to cover, in use, the holder assembly 802.

Clause (31): an apparatus (either taken alone, or with an apparatus of any clause mentioned in this paragraph, or any portion of any clause mentioned in this paragraph), including and not limited to (comprising) peripheral walls of the cover assembly 102 that are configured to surround, at least in part, peripheral walls of the liner 702 once the cover assembly 102, in use, is received, at least in part, by the liner 702.

Clause (32): an apparatus (either taken alone, or with an apparatus of any clause mentioned in this paragraph, or any portion of any clause mentioned in this paragraph), including and not limited to (comprising) peripheral walls of the liner 702 that are configured to surround (cover), at least in part, peripheral walls of the holder assembly 802 once the liner 702, in use, is received, at least in part, by the holder assembly 802.

Clause (33): an apparatus (either taken alone, or with an apparatus of any clause mentioned in this paragraph, or any portion of any clause mentioned in this paragraph), including and not limited to (comprising) a holder assembly 802 having a holder surface 804; and/or a joiner assembly 810 being configured to extend from the holder assembly 802;

and/or the joiner assembly 810 also being configured to be selectively receivable, at least in part, in a first drink hole feature 502 of a first seating system 504; and/or the joiner assembly 810 also being configured to be selectively receivable, at least in part, in a second drink hole feature 512 of a second seating system 514; and/or the joiner assembly 810 also being configured to selectively securely engage with the first drink hole feature 502 of the first seating system 504 once the joiner assembly 810 is received, at least in part, in the first drink hole feature 502 of the first seating system 504; and/or the joiner assembly 810 also being configured to selectively securely engage with the second drink hole feature 512 of the second seating system 514 once the joiner assembly 810 is received, at least in part, in the second drink hole feature 512 of the second seating system 514; and/or the joiner assembly 810 also being configured to cooperate with: (A) the first drink hole feature 502 of the first seating system 504, in which the first drink hole feature 502 has a first inner diameter 506; and/or (B) the second drink hole feature 512 of the second seating system 514, in which the second drink hole feature 512 has a second inner diameter 516, in which the first inner diameter 506 of the first drink hole feature 502 and the second inner diameter 516 of the second drink hole feature 512 are different from each other.

Clause (34): an apparatus (either taken alone, or with an apparatus of any clause mentioned in this paragraph, or any portion of any clause mentioned in this paragraph), including and not limited to (comprising) the joiner assembly 810 is also configured to selectively disengage from, the first drink hole feature 502 of the first seating system 504; and/or the joiner assembly 810 is also configured to selectively disengage from, the second drink hole feature 512 of the second seating system 514.

Clause (35): an apparatus (either taken alone, or with an apparatus of any clause mentioned in this paragraph, or any portion of any clause mentioned in this paragraph), including and not limited to (comprising) a holder image 805 configured to be positioned, at least in part, proximate to (on an external surface of) a holder assembly 802 in such a way that the holder image 805, in use, faces away from the holder assembly 802 once the holder image 805, in use, is positioned proximate to (on) the holder assembly 802. The holder image 805 is also configured to face away from the holder assembly 802 once the holder image 805, in use, is positioned, at least in part, proximate to (on) the holder assembly 802. The holder image 805, in use, visually enhances an appearance of the holder assembly 802 once the holder image 805, in use, is positioned proximate to the holder assembly 802. In accordance with an option, the holder image 805 is configured to selectively connect (couple) with, and selectively disconnect from, the holder assembly 802. In accordance with an option, the holder image 805 is integral with the holder assembly 802.

Clause (36): an apparatus (either taken alone, or with an apparatus of any clause mentioned in this paragraph, or any portion of any clause mentioned in this paragraph), including and not limited to (comprising) a cover assembly 102 having a cover image 101 formed thereon. The cover assembly 102 is configured to be selectively positioned proximate to (over), at least in part, a holder assembly 802 in such a way that the cover assembly 102, in use, positions the cover image 101 so that the cover image 101, in use, faces away from the holder assembly 802 once the cover assembly 102, in use, is selectively positioned proximate to, at least in part, the holder assembly 802. The cover assembly 102 is also configured to visually display, at least in part, the cover image 101 formed on the cover assembly 102 once the cover assembly 102, in use, is selectively positioned proximate to (over), at least in part, the holder assembly 802. The cover assembly 102, in use, visually enhances an appearance of the holder assembly 802 once the cover assembly 102 is selectively positioned proximate to (over) the holder assembly 802. In accordance with an option, the cover assembly 102 is configured to selectively connect (couple) with, and selectively disconnect from, the holder assembly 802.

Clause (37): an apparatus (either taken alone, or with an apparatus of any clause mentioned in this paragraph, or any portion of any clause mentioned in this paragraph), including and not limited to (comprising) a liner 702 having a liner image 705 formed thereon. The liner 702 is configured to be selectively positioned proximate to (over), at least in part, a holder assembly 802 in such a way that the liner 702, in use, positions the liner image 705 formed on the liner 702 so that the liner image 705, in use, faces away from the holder assembly 802 once the liner 702, in use, is selectively positioned, at least in part, proximate to the holder assembly 802. The liner 702 is also configured to visually display, at least in part, the liner image 705 being formed on the liner 702 once the liner 702, in use, is selectively positioned proximate to (over), at least in part, the holder assembly 802. The liner 702, in use, visually enhances an appearance of the holder assembly 802 once the liner 702 is selectively positioned proximate to the holder assembly 802. In accordance with an option, the liner 702 is configured to selectively connect (couple) with, and selectively disconnect from, the holder assembly 802.

Clause (38): an apparatus (either taken alone, or with an apparatus of any clause mentioned in this paragraph, or any portion of any clause mentioned in this paragraph), including and not limited to (comprising) a liner 702 having a liner surface 704 with a liner image 705 formed on the liner surface 704. The liner 702 is configured to be selectively positioned proximate to (over), at least in part, a holder surface 804 of a holder assembly 802 in such a way that the liner 702, in use, positions the liner image 705 formed on the liner surface 704 so that the liner image 705, in use, faces away from the holder surface 804 of the holder assembly 802 once the liner 702, in use, is selectively positioned proximate to (over), at least in part, the holder surface 804 of the holder assembly 802. The apparatus further includes a cover assembly 102 having a cover surface 104. The cover assembly 102 is configured to selectively cover, at least in part, the liner image 705 formed on the liner surface 704 of the liner 702. The cover assembly 102 is also configured to reveal, at least in part, the liner image 705 formed on the liner surface 704 once: (A) the liner 702, in use, is selectively positioned over, at least in part, the holder assembly 802; and (B) the cover assembly 102, in use, selectively covers, at least in part, the liner image 705 formed on the liner surface 704 of the liner 702. The cover assembly 102 has a cover image 101 formed on the cover surface 104 in such a way that the cover image 101, in use, is displayed once the cover assembly 102, in use, selectively covers, at least in part, the liner 702, in which the liner 702 is positioned proximate to the holder assembly 802. The liner 702, in use, visually enhances an appearance of the holder assembly 802 once the liner 702 is selectively positioned between the cover assembly 102 and the holder assembly 802.

The cover assembly 102, in use, visually enhances the appearance of the holder assembly 802 once the cover assembly 102 is selectively positioned proximate to the liner 702, and the liner 702 is positioned proximate to the holder assembly 802.

In accordance with an option, the liner 702 is configured to selectively connect (couple) with, and selectively disconnect from, the holder assembly 802. In accordance with an option, the cover assembly 102 is configured to selectively connect (couple) with, and selectively disconnect from, the holder assembly 802.

Clause (39): an apparatus (either taken alone, or with an apparatus of any clause mentioned in this paragraph, or any portion of any clause mentioned in this paragraph), including and not limited to (comprising) a liner 702 configured to be selectively positioned over, at least in part, a holder assembly 802. The apparatus also includes a cover assembly 102 configured to selectively cover, at least in part, the liner 702 once the liner 702, in use, is selectively positioned over, at least in part, the holder assembly 802. The cover assembly 102 has a cover image 101 formed thereon in such a way that the cover image 101, in use, is displayed once the cover assembly 102, in use, selectively covers, at least in part, the liner 702, in which the liner 702 is positioned over, at least in part, the holder assembly 802. The cover assembly 102, in use, visually enhances the appearance of the holder assembly 802 and the liner 702 once the cover assembly 102 is selectively positioned over the liner 702, and the liner 702 is positioned over the holder assembly 802. In accordance with an option, the liner 702 is configured to selectively connect (couple) with, and selectively disconnect from, the holder assembly 802. In accordance with an option, the cover assembly 102 is configured to selectively connect (couple) with, and selectively disconnect from, the holder assembly 802.

Clause (40): an apparatus (either taken alone, or with an apparatus of any clause mentioned in this paragraph, or any portion of any clause mentioned in this paragraph), including and not limited to (comprising) for the improvement of advertising revenue in association with the holder assembly 802 (that is, for monetizing the holder assembly 802). The advertisement provides a notice or announcement in a public medium promoting a product, service, or event or publicizing a job vacancy, etc., and any other kind, and any equivalent thereof.

Clause (41): an apparatus (either taken alone, or with an apparatus of any clause mentioned in this paragraph, or any portion of any clause mentioned in this paragraph), including and not limited to (comprising), in which the apparatus is for enhancing advertising revenue in association with a holder assembly 802. A liner 702 is positioned, at least in part, over a holder surface 804 of the holder assembly 802, in which the liner 702 has a liner surface 704 with a liner image 705 formed on the liner surface 704, in such a way that the liner 702, in use, positions the liner image 705 formed on the liner surface 704 in such a way that the liner image 705, in use, faces away from the holder surface 804 of the holder assembly 802. A cover assembly 102 is configured to selectively cover, at least in part, the liner image 705 formed on the liner surface 704 of the liner 702, and the cover assembly 102 has a cover surface 104, in which the cover surface 104 of the cover assembly 102 is configured to reveal, at least in part, the liner image 705 being formed on the liner surface 704 once: (A) the liner 702, in use, is selectively positioned over, at least in part, the holder surface 804 of the holder assembly 802; and (B) the cover surface 104 of the cover assembly 102, in use, selectively covers, at least in part, the liner image 705 being formed on the liner surface 704 of the liner 702, in which the cover assembly 102 is configured to protect, in use, the liner 702. The liner image 705 formed on the liner surface 704 of the liner 702 includes, at least in part, an advertisement. The liner image 705, in use, enhances advertising revenue in association with the holder assembly 802 once the liner image 705 is selectively positioned proximate to the holder assembly 802.

Clause (42): an apparatus (either taken alone, or with an apparatus of any clause mentioned in this paragraph, or any portion of any clause mentioned in this paragraph), including and not limited to (comprising), in which the apparatus is for enhancing advertising revenue in association with a holder assembly 802. A liner image 705 includes (at least in part) the advertisement, and the liner image 705, in use, enhances advertising revenue in association with the holder assembly 802 once the liner image 705 is selectively positioned proximate to (relative to) the holder assembly 802.

Clause (43): an apparatus (either taken alone, or with an apparatus of any clause mentioned in this paragraph, or any portion of any clause mentioned in this paragraph), including and not limited to (comprising), in which the apparatus is for enhancing advertising revenue in association with a holder assembly 802. A liner 702 is positioned, at least in part, proximate to the holder assembly 802, in which the liner 702 has a liner image 705. The liner image 705 includes, at least in part, an advertisement. The liner image 705, in use, enhances advertising revenue in association with the holder assembly 802 once the liner image 705 is selectively positioned proximate to the holder assembly 802.

Clause (44): an apparatus (either taken alone, or with an apparatus of any clause mentioned in this paragraph, or any portion of any clause mentioned in this paragraph), including and not limited to (comprising), in which the apparatus is for enhancing advertising revenue in association with a holder assembly 802. A cover image 101 includes (at least in part) the advertisement, and the cover image 101, in use, enhances advertising revenue in association with the holder assembly 802 once the cover image 101 is selectively positioned proximate to (relative to) the holder assembly 802.

Clause (44): an apparatus (either taken alone, or with an apparatus of any clause mentioned in this paragraph, or any portion of any clause mentioned in this paragraph), including and not limited to (comprising), in which the apparatus is for enhancing advertising revenue in association with a holder assembly 802. A cover assembly 102 is positioned, at least in part, proximate to the holder assembly 802, in which the cover assembly 102 has a cover image 101. The cover image 101 includes, at least in part, an advertisement. The cover image 101, in use, enhances advertising revenue in association with the holder assembly 802 once the cover image 101 is selectively positioned proximate to the holder assembly 802.

Clause (45): an apparatus (either taken alone, or with an apparatus of any clause mentioned in this paragraph, or any portion of any clause mentioned in this paragraph), including and not limited to (comprising), in which the apparatus is for enhancing advertising revenue in association with a holder assembly 802. A holder image 805 includes (at least in part) the advertisement, and the holder image 805, in use, enhances advertising revenue in association with the holder assembly 802 once the holder image 805 is selectively positioned proximate to (relative to) the holder assembly 802.

Clause (47): an apparatus (either taken alone, or with an apparatus of any clause mentioned in this paragraph, or any portion of any clause mentioned in this paragraph), including and not limited to (comprising), in which the apparatus is for enhancing advertising revenue in association with a holder assembly 802. A holder image 805 is positioned, at least in part, proximate to the holder assembly 802. The holder image 805 includes, at least in part, an advertisement. The holder image 805, in use, enhances advertising revenue in association with the holder assembly 802 once the holder image 805 is selectively positioned proximate to the holder assembly 802.

The following is offered as further description of the embodiments, in which any one or more of any technical feature (described in the detailed description, the summary and the claims) may be combinable with any other one or more of any technical feature (described in the detailed description, the summary and the claims). It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus (either explicitly or inherently). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, un-recited elements or method steps. Comprising (comprised of) is an "open" phrase and allows coverage of technologies that employ additional, un-recited elements. When used in a claim, the word "comprising" is the transitory verb (transitional term) that separates the preamble of the claim from the technical features of the invention. The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a liner having a liner surface with a liner image being formed on the liner surface, and the liner being configured to be selectively positioned over, at least in part, a holder surface of a holder assembly in such a way that the liner, in use, positions the liner image being formed on the liner surface in such a way that the liner image, in use, faces away from the holder surface of the holder assembly; and a cover assembly having a cover surface, and the cover surface of the cover assembly being configured to selectively cover, at least in part, the liner image being formed on the liner surface of the liner; and the cover surface of the cover assembly also being configured to reveal, at least in part, the liner image being formed on the liner surface once:

the liner, in use, is selectively positioned over, at least in part, the holder surface of the holder assembly; and the cover surface of the cover assembly, in use, selectively covers, at least in part; the liner image being formed on the liner surface of the liner; and whereby the liner, in use, visually enhances an appearance of the holder assembly once the liner is selectively positioned between the cover assembly and the holder assembly;

wherein a peripheral liner wall of the liner is configured to surround (cover), at least in part, a peripheral holder wall of the holder assembly once the liner, in use, is received, at least in part, by the holder assembly.

2. The apparatus of claim 1, further comprising:

an engagement feature being configured to selectively engage the cover assembly and the holder assembly with each other in such a way that the engagement feature, in use, securely positions the cover surface, in use, to cover, at least in part, the liner image being formed on the liner surface of the liner, and in which the liner is selectively positioned over, at least in part, the holder surface of the holder assembly.

3. The apparatus of claim 1, wherein:

the engagement feature is configured to selectively disengage the cover assembly and the holder assembly from each other.

4. The apparatus of claim 1, wherein:

the engagement feature includes:

a cover-engagement feature being provided by the cover assembly.

5. The apparatus of claim 1, wherein:

the engagement feature includes:

a cover-engagement feature being provided by the cover assembly; and a holder-engagement feature being provided by the holder assembly; and wherein the cover-engagement feature and the holder-engagement feature are configured to selectively engage with each other.

6. The apparatus of claim 1, wherein:

the holder assembly includes a food-service tray; and the holder surface includes a tray surface being provided by the food-service tray.

7. The apparatus of claim 1, wherein:

the holder assembly includes a booster seat assembly; and the holder surface includes a booster-seat surface being provided by the booster seat assembly.

8. The apparatus of claim 1, wherein:

the liner and the cover assembly are formed as an integral unit.

9. The apparatus of claim 1, wherein:

the liner and the holder assembly are formed as an integral unit.

10. The apparatus of claim 1, wherein:

the cover assembly and the liner and the holder assembly are formed as an integral unit.

11. The apparatus of claim 1, wherein;

the cover assembly includes:

lateral cover side wads positioned on opposite lateral sides of the cover assembly; and a rear cover wall extending between the lateral cover side walls; and a front cover wall extending between the lateral cover side walls; and the rear cover wall and the front cover wall are spaced apart from each other.

12. The apparatus of claim 1, wherein;

the liner includes:

lateral liner side walls positioned on opposite lateral sides of the liner; and a rear liner wall extending between the lateral liner side walls; and a front liner wall extending between the lateral liner side walls; and the rear liner wall and the front liner wall are spaced apart from each other.

13. The apparatus of claim 1, wherein:

the holder assembly includes:

lateral holder side walls positioned on opposite lateral sides of the holder assembly; and a rear holder wall extending between the lateral holder side walls; and a front holder wall extending between the lateral holder side walls.

14. The apparatus of claim 1, wherein:

the cover assembly provides a cover passageway configured to permit passage, at least in part, of a drink container; and the liner provides a liner passageway configured to permit passage, at least in part, of the drink container; and the holder assembly defines a holder passageway configured to permit passage, at least in part, of the drink container; and the cover passageway, the liner passageway and the holder passageway are configured to be coo-aligned with each other once the cover assembly is positioned to cover, in use, the liner, and once the liner is positioned to cover, in use, the holder assembly.

15. The apparatus of claim 1, wherein:

a peripheral cover wall of the cover assembly is configured to surround, at least in part, a peripheral liner wall of the liner once the cover assembly, in use, is received, at least in part, by the liner.

* * * * *